US012752965B2

(12) United States Patent
Niedzwiecki

(10) Patent No.: US 12,752,965 B2
(45) Date of Patent: Oct. 6, 2026

(54) SYSTEM, APPARATUS, ASSEMBLY AND METHOD FOR MOVING STACKABLE ITEMS

(71) Applicant: NILEC SOLUTIONS, LLC, Houston, TX (US)

(72) Inventor: Timothy Allen Niedzwiecki, Atlantic Mine, MI (US)

(73) Assignee: NILEC SOLUTIONS, LLC, Houston, TX (US)

( * ) Notice: Subject to any disclaimer, the term of this patent is extended or adjusted under 35 U.S.C. 154(b) by 0 days.

(21) Appl. No.: 19/080,858

(22) Filed: Mar. 15, 2025

(65) Prior Publication Data

US 2025/0296732 A1 Sep. 25, 2025

Related U.S. Application Data

(60) Provisional application No. 63/567,417, filed on Mar. 19, 2024.

(51) Int. Cl.
*B65D 19/00* (2006.01)
*B65D 19/38* (2006.01)

(52) U.S. Cl.
CPC ..... *B65D 19/0089* (2013.01); *B65D 19/385* (2013.01); *B65D 2519/00293* (2013.01); *B65D 2519/00323* (2013.01)

(58) Field of Classification Search
CPC ..... B65D 19/38; B65D 19/385; B65D 19/40; F16M 11/00; F16M 13/00
See application file for complete search history.

(56) References Cited

U.S. PATENT DOCUMENTS

| | | | | |
|---|---|---|---|---|
| 12,168,545 | B2 * | 12/2024 | Niedzwiecki | B65D 19/0018 |
| 2003/0094124 | A1 * | 5/2003 | Wishart | B65D 19/38 108/51.11 |
| 2014/0116300 | A1 * | 5/2014 | Brown | B65D 19/38 108/51.11 |
| 2015/0027917 | A1 * | 1/2015 | Goddard | B65D 19/18 206/386 |
| 2020/0346908 | A1 * | 11/2020 | Macalus | B65D 19/06 |
| 2021/0053783 | A1 * | 2/2021 | Getsy | B65D 19/38 |

* cited by examiner

*Primary Examiner* — Daniel J Rohrhoff
(74) *Attorney, Agent, or Firm* — The Compton Law Firm, P.C.; Scott D. Compton

(57) ABSTRACT

The present disclosure is directed to moving stackable items off from a portable load bearing member onto one or more other portable load bearing members using an assembly apparatus configured to hold the portable load bearing members. Stackable items to be moved off from a portable load bearing member onto one or more other portable load bearing members may include items such as stackable bundles of roof shingles.

15 Claims, 55 Drawing Sheets

SYSTEM, APPARATUS, ASSEMBLY AND METHOD FOR MOVING STACKABLE ITEMS

CROSS-REFERENCE TO RELATED APPLICATIONS

This application claims benefit of U.S. Provisional Patent Application Ser. No. 63/567,417, filed on Mar. 19, 2024, the content of which is hereby incorporated by reference in its entirety.

BACKGROUND OF THE DISCLOSURE

1. Field of the Disclosure

This disclosure relates generally in the field of moving stackable items off of support surfaces onto other support surfaces.

2. Background Art

In industrial and warehouse type settings, stackable items are typically transported and stored on portable load bearing members, e.g., pallets and/or the like, by stacking the items in rows. In certain situations, it is desired to split a stack of items into two or more separate smaller stacks by moving a desired number of rows of the stack of items onto one or more other portable load bearing members. Efficiency in moving stackable items onto one or more portable load bearing members is desired.

SUMMARY OF THE DISCLOSURE

The present disclosure is directed to systems, apparatuses, assemblies and methods for directing stackable items off from load carrying portable load bearing members onto load receiving portable load bearing members. For example, in an embodiment the present disclosure is directed to an assembly apparatus, comprising (1) a first member having a first support surface; and (2) a second member having a second support surface; wherein the first support surface is configured to hold a load carrying portable load bearing member; wherein the second support surface is configured to hold a first load receiving portable load bearing member; and wherein the second member is configured to hold a second load receiving portable load bearing member below the second support surface.

BRIEF DESCRIPTION OF THE SEVERAL VIEW OF THE DRAWING

Figure 2:
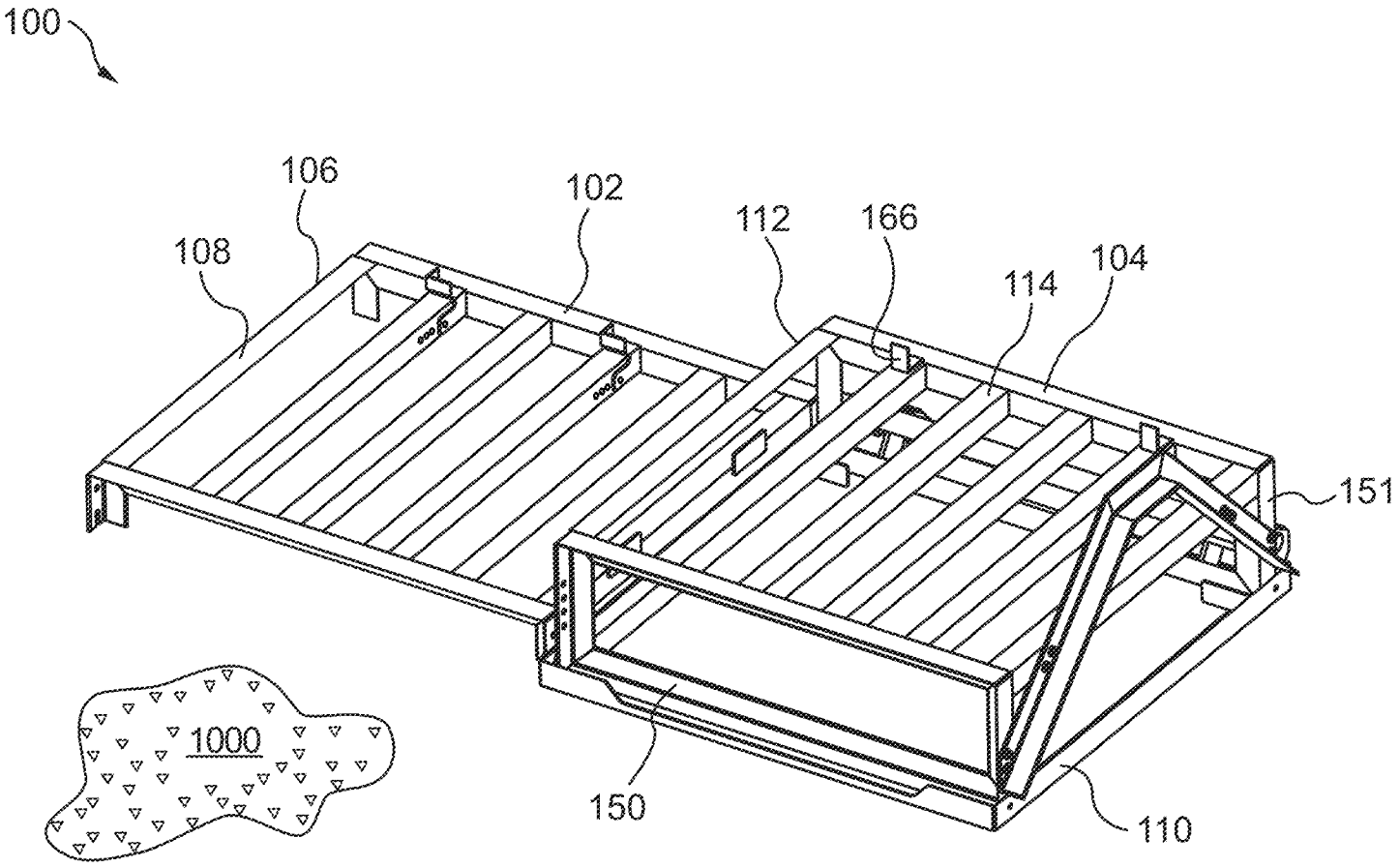
FIG. 2 is a perspective view of an embodiment of an assembly apparatus of this disclosure including a loading platform of the assembly apparatus set to a first loading position.
Figure 3:
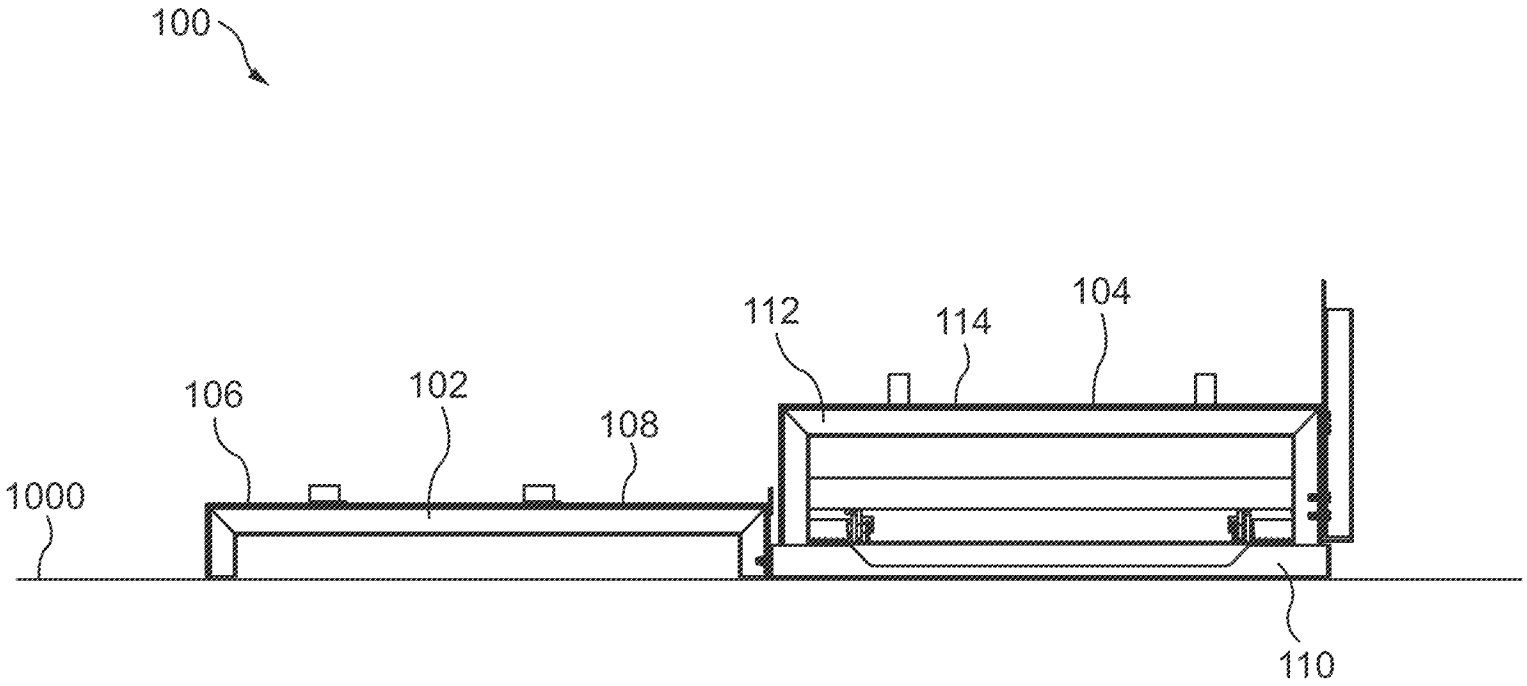
FIG. 3 is a side elevation view of the assembly apparatus of FIG. 2.
Figure 4:
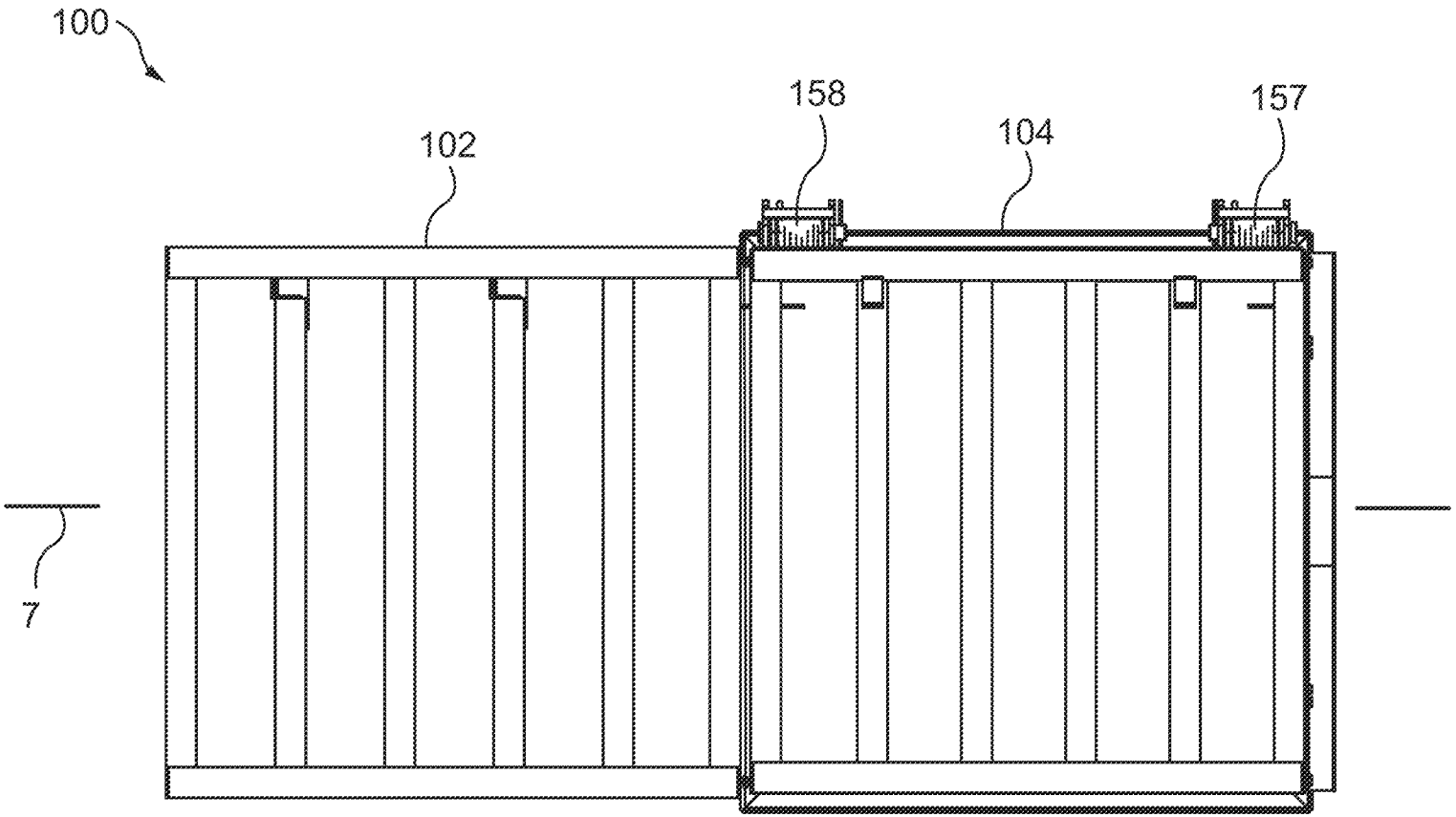
FIG. 4 is a top view of the assembly apparatus of FIG. 2.
Figure 21:
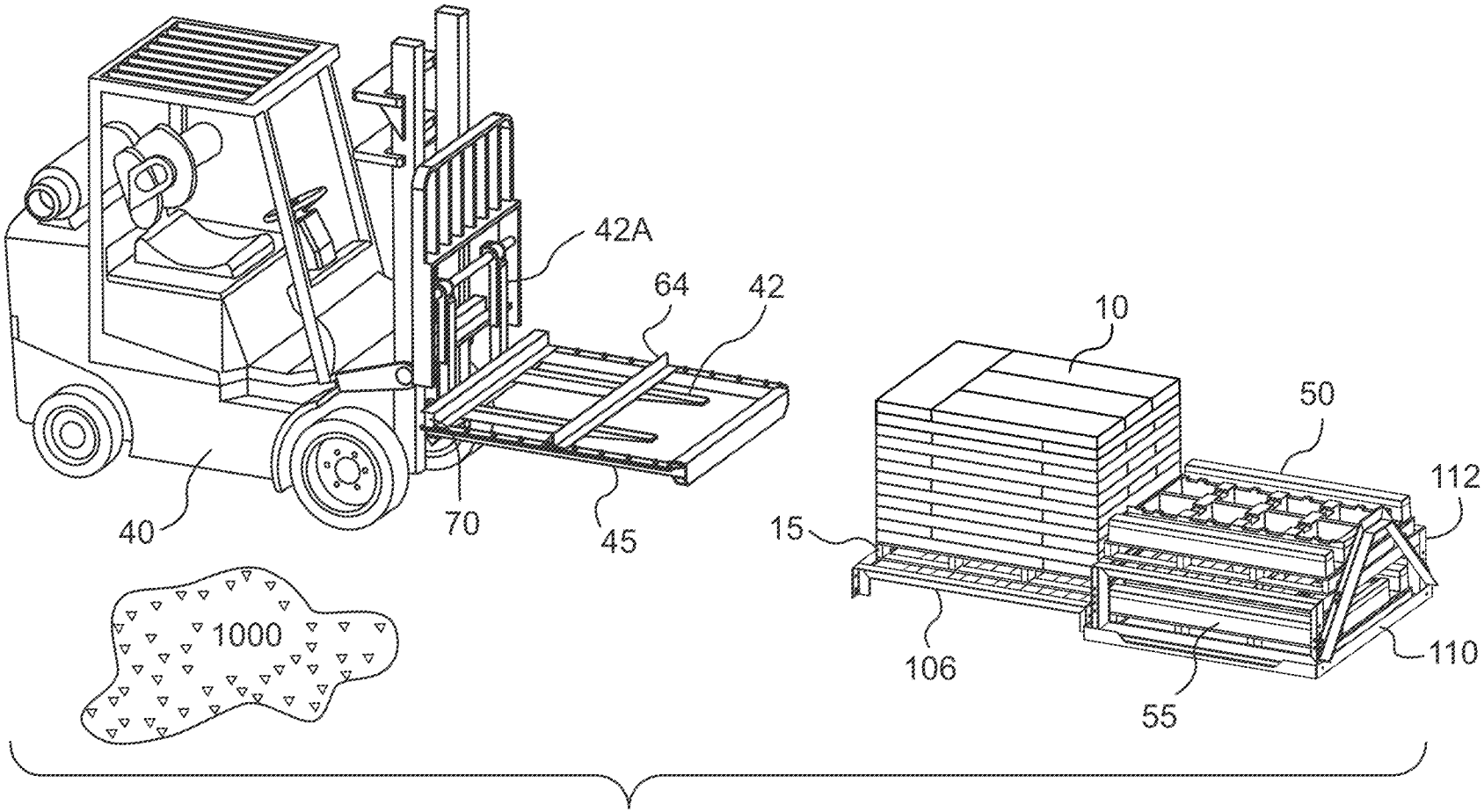

FIG. 21 is a perspective view illustrating alignment of a lifting device with the assembly apparatus of FIG. 2, wherein the assembly apparatus includes bundles of roof shingles stacked on a load carrying portable load bearing member located on an off-loading assembly of the assembly apparatus, and a first load receiving portable load bearing member and a second load receiving portable load bearing member located on a loading assembly of the assembly apparatus.

Figure 22:
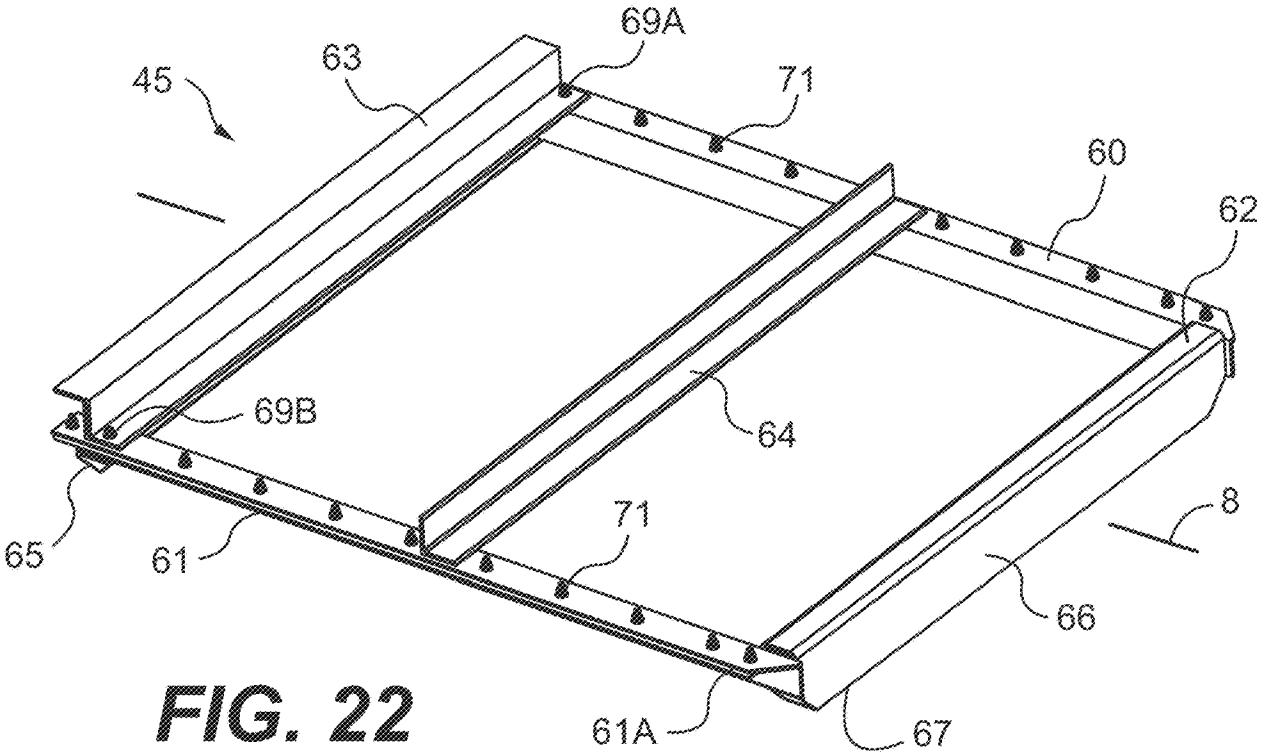

FIG. 22 is a perspective view of an embodiment of a push member of this disclosure.

Figure 23:
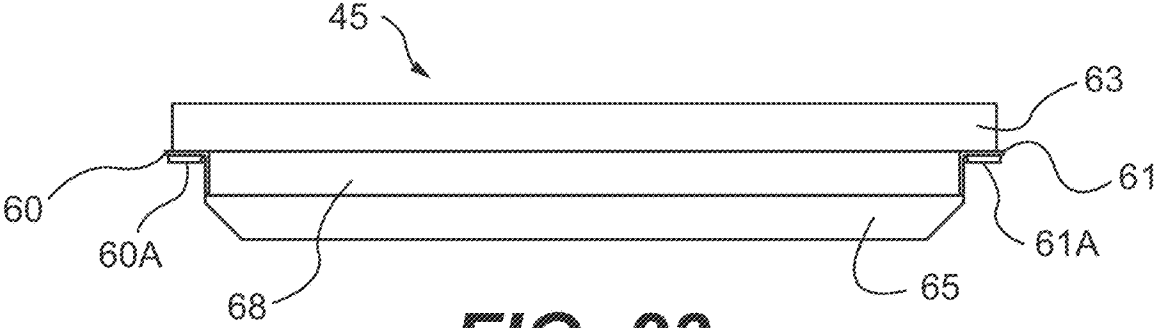

FIG. 23 is a back elevation view of the push member of FIG. 22.

Figure 24:
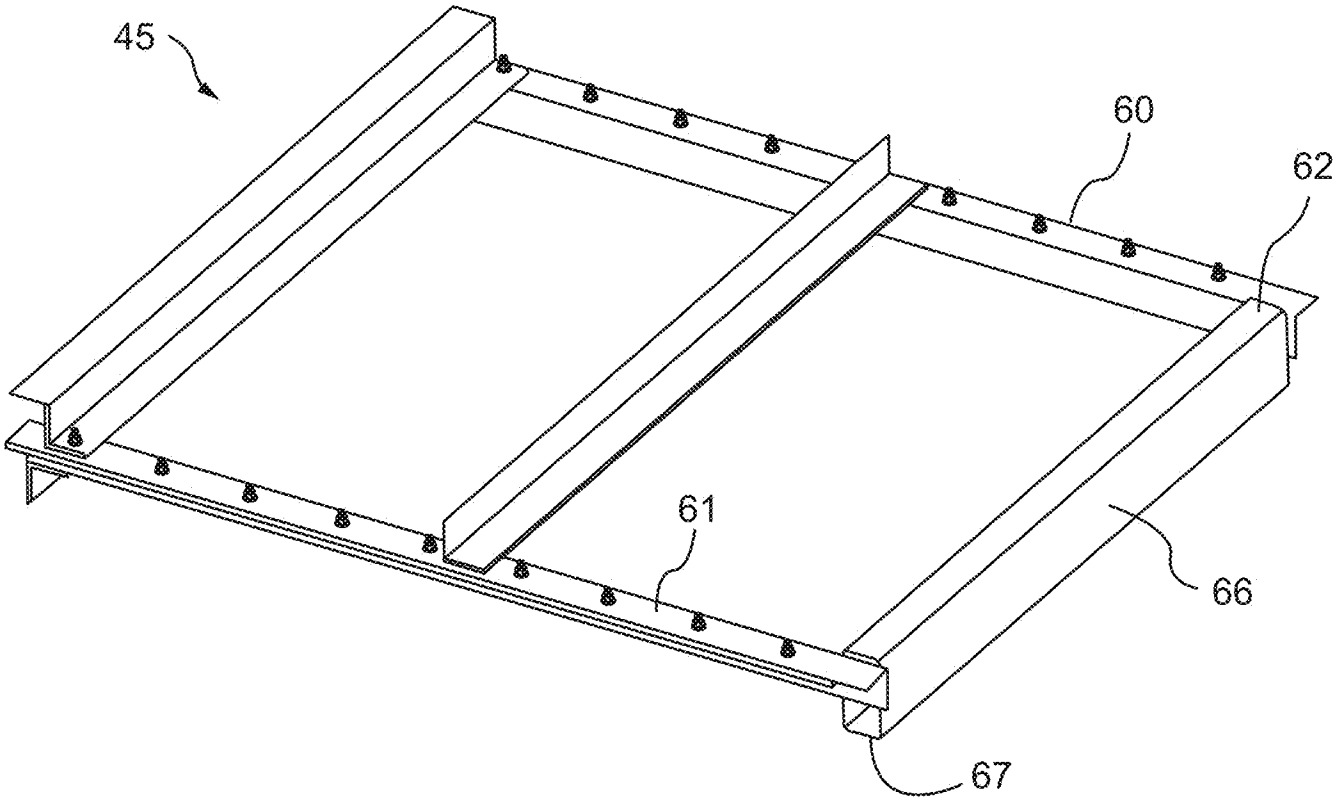

FIG. 24 is a perspective view of an embodiment of a push member of this disclosure.

Figure 25:
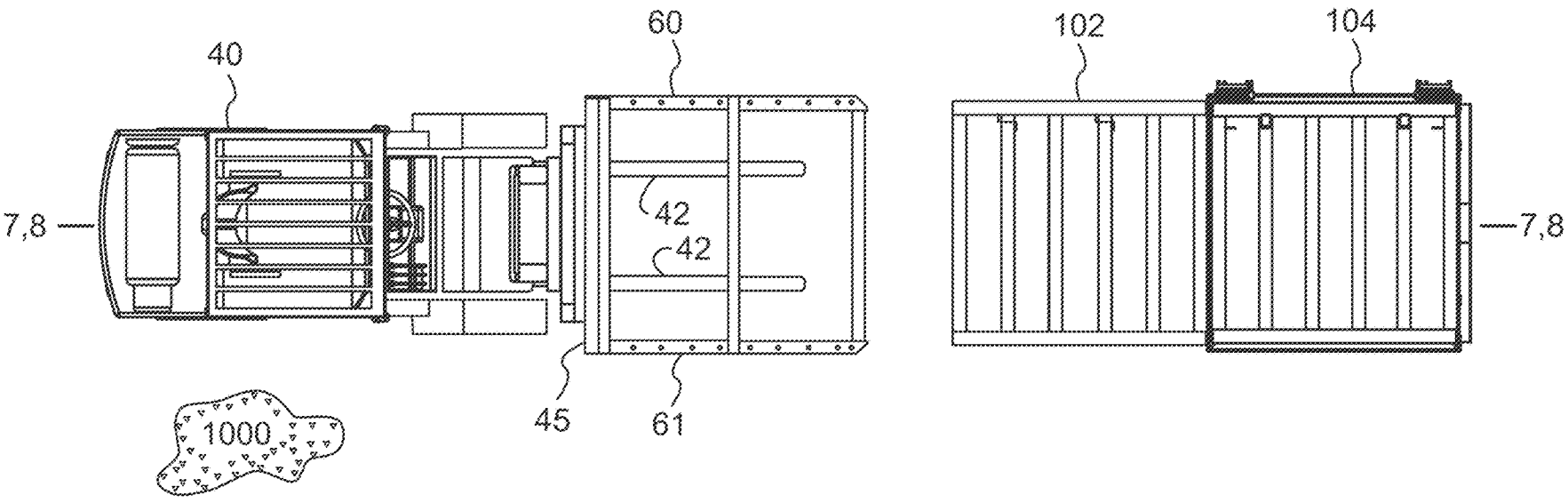

FIG. 25 is a top view illustrating alignment of a lifting device with the assembly apparatus of FIG. 2.

Figure 26:
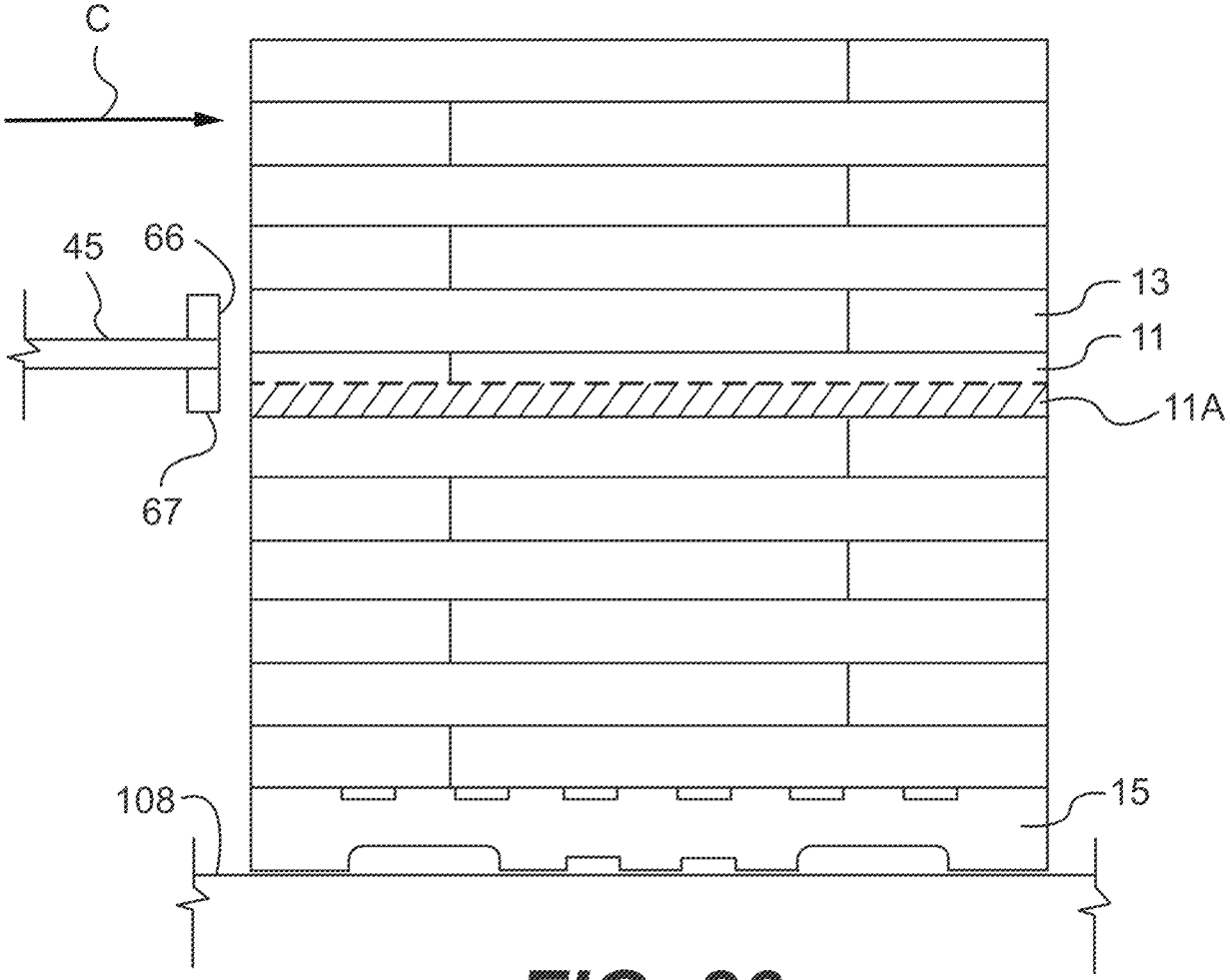

FIG. 26 is a side elevation view of rows of bundles of roof shingles stacked on an embodiment of a load carrying portable load bearing member illustrating alignment of a push member along a target row of the rows of bundles of roof shingles.

Figure 27:
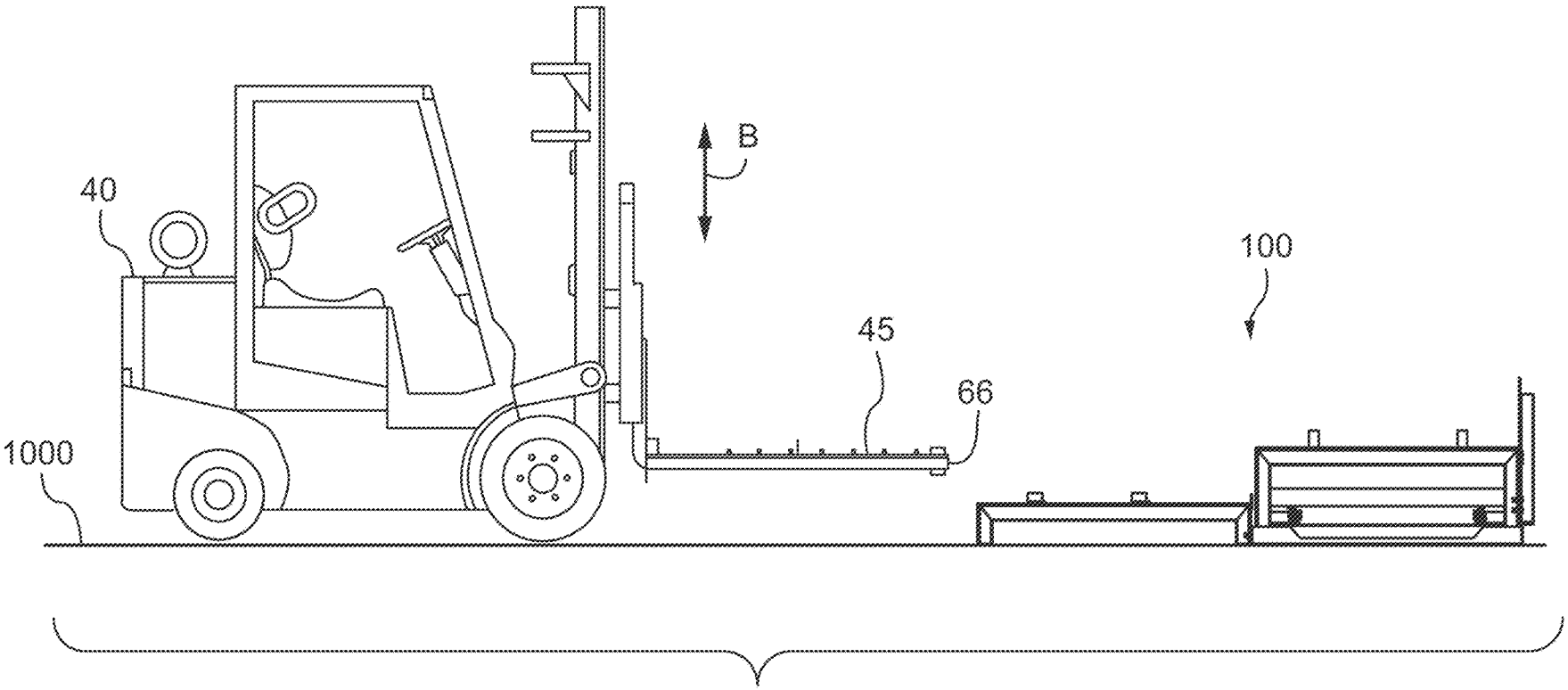

FIG. 27 is a side elevation view of the lifting device and the assembly apparatus of FIG. 25.

Figure 28:
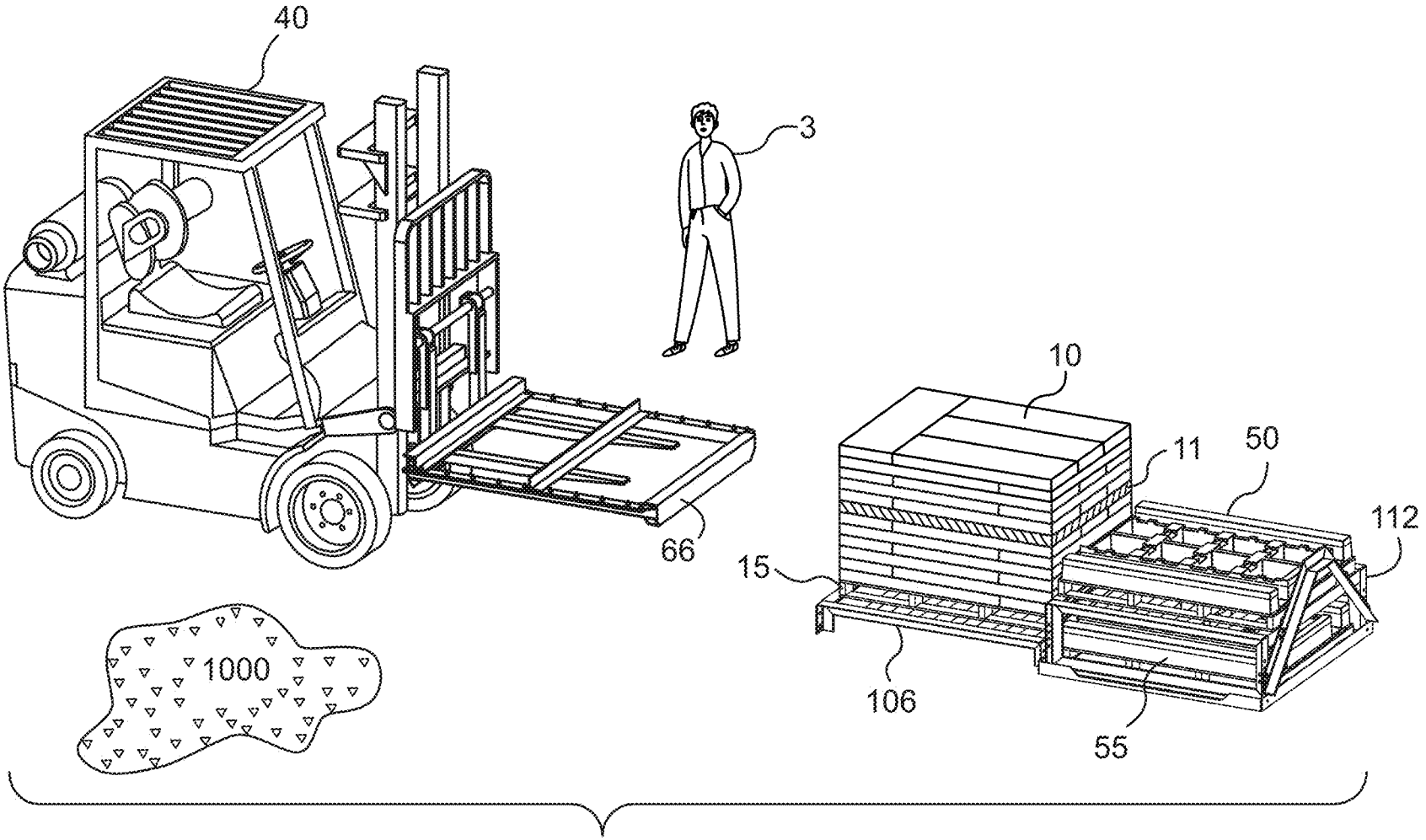

FIG. 28 is another perspective view of the assembly apparatus of FIG. 21 illustrating alignment of a lifting device with the assembly apparatus.

Figure 29:
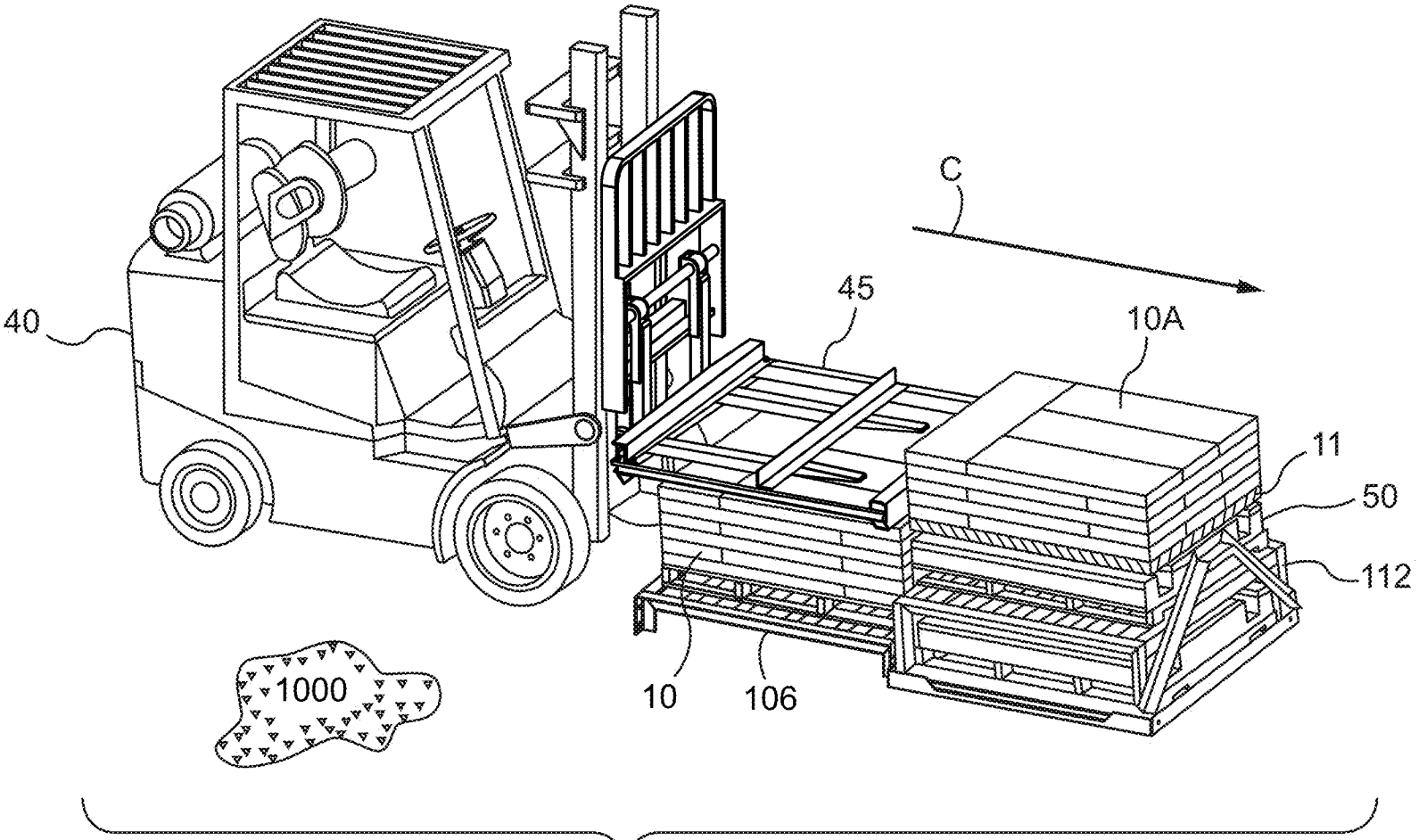

FIG. 29 is a perspective view of the assembly apparatus of FIG. 21 illustrating formation of a first load of stacked bundles of roof shingles on a first load receiving portable load bearing member.

Figure 30:
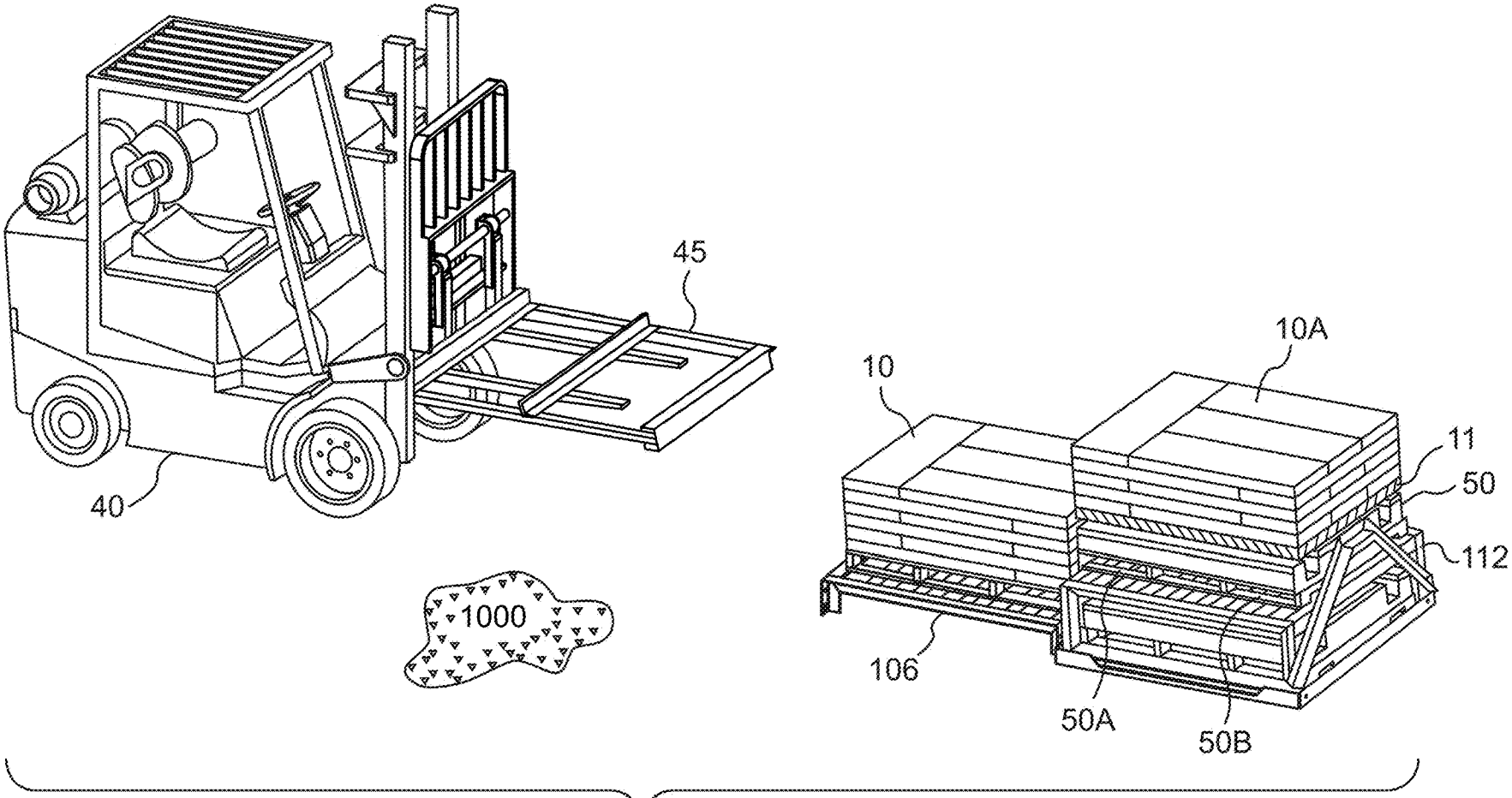

FIG. 30 is a perspective view of the assembly apparatus of FIG. 21 illustrating the first load of stacked bundles of roof shingles located on a first load receiving portable load bearing member.

Figure 31:
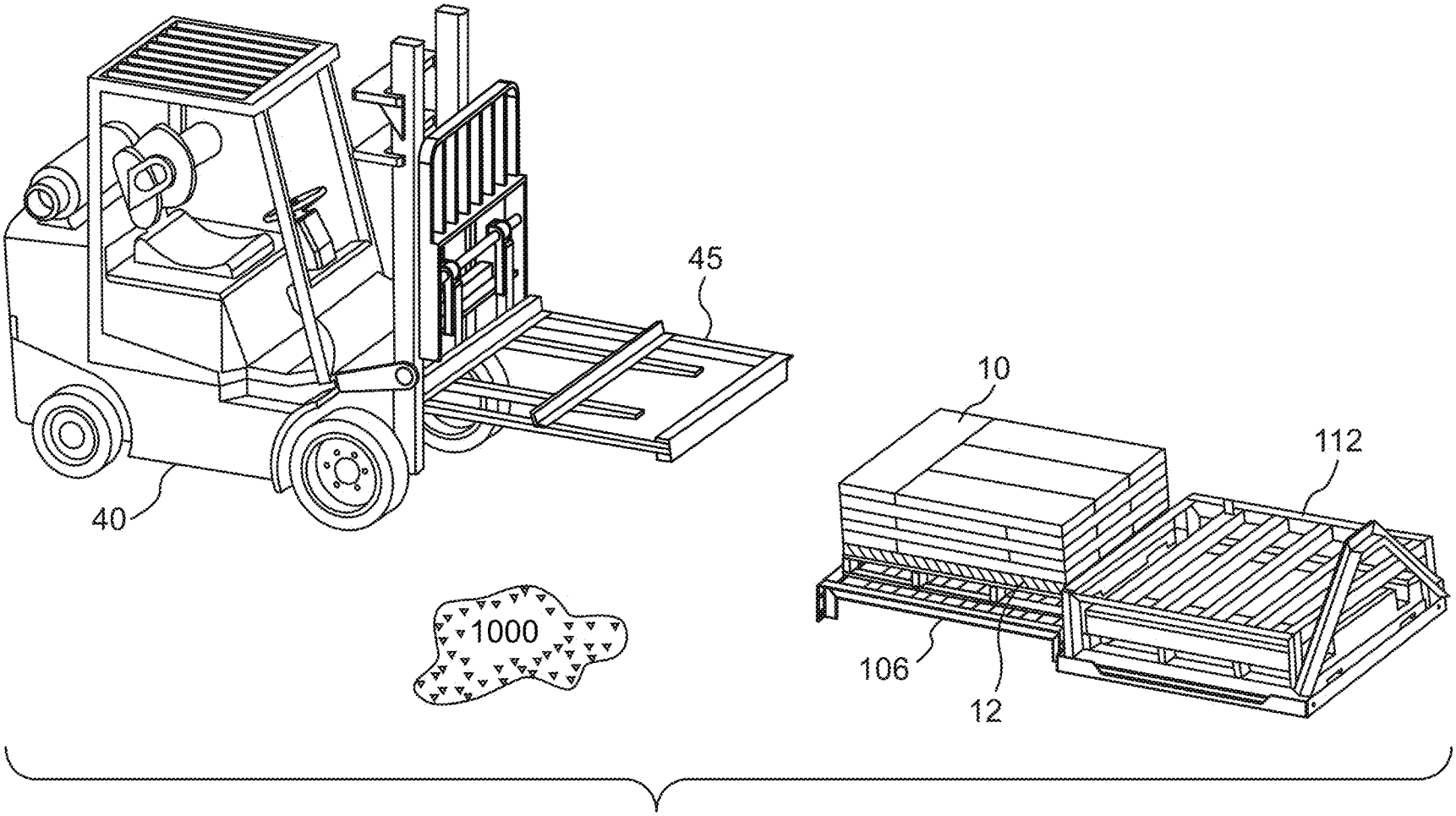

FIG. 31 is a perspective view of the assembly apparatus of FIG. 21 with the first load receiving portable load bearing member and the first load of stacked bundles of roof shingles of FIG. 30 removed from the assembly apparatus.

Figure 32:
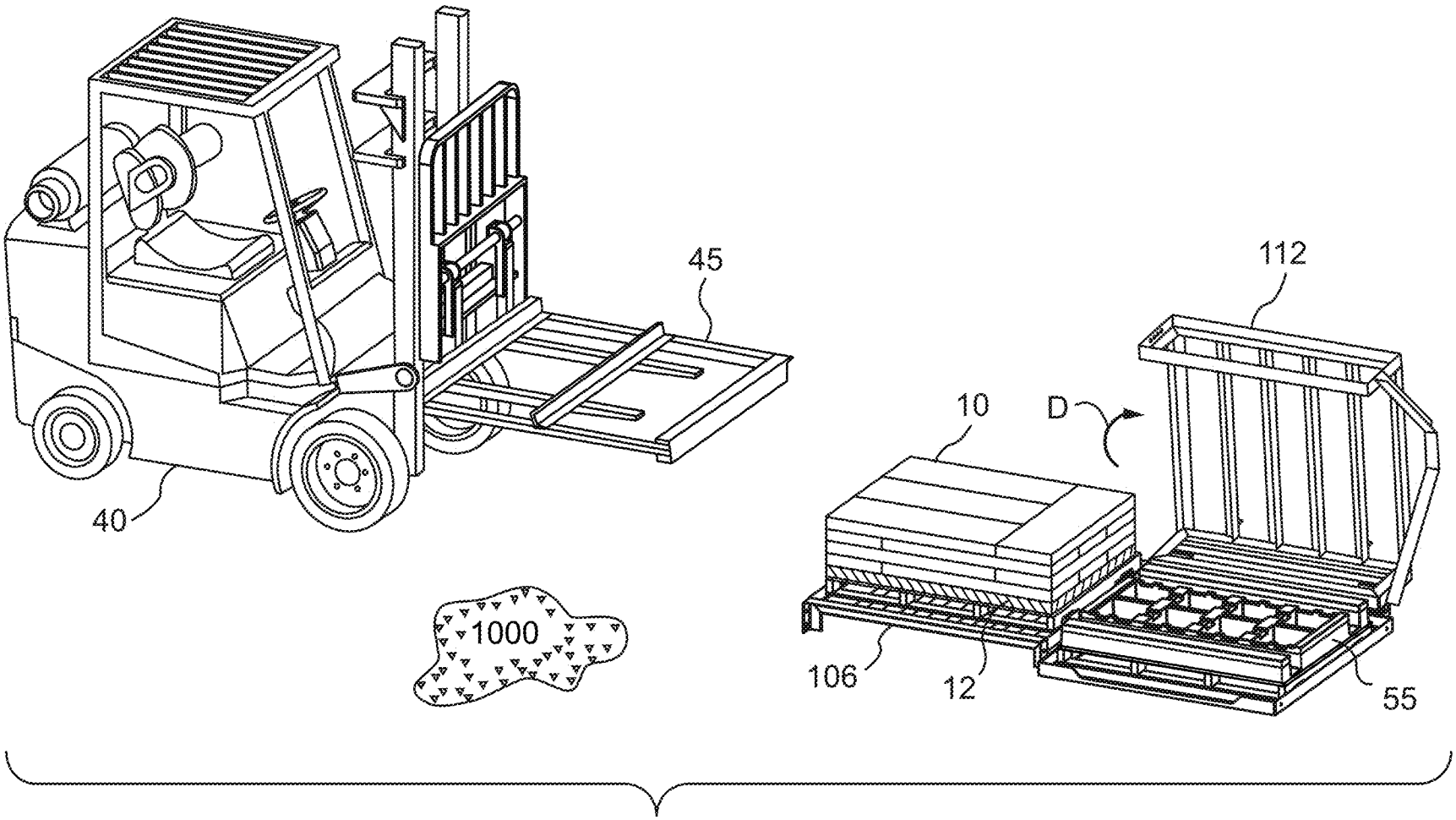

FIG. 32 is a perspective view of the assembly apparatus of FIG. 21 illustrating a loading platform of the assembly apparatus set to a second loading position prior to formation of a second load of stacked bundles of roof shingles on a second load receiving portable load bearing member.

Figure 33:
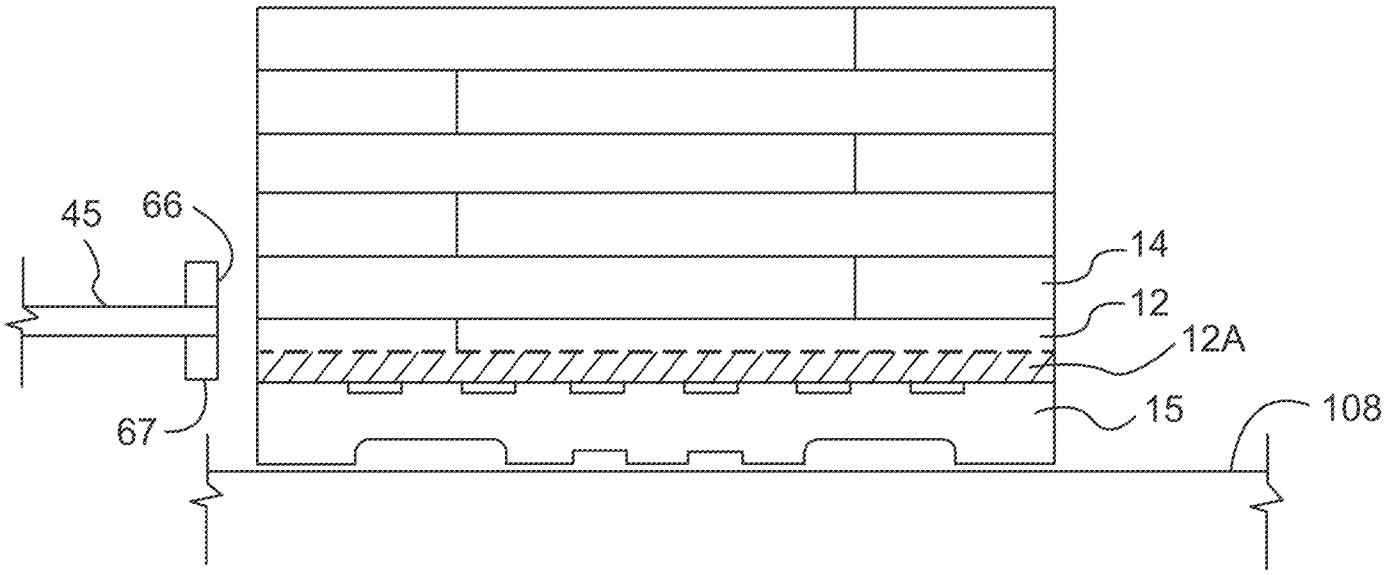

FIG. 33 is a side elevation view of rows of bundles of roof shingles stacked on top of an embodiment of a load carrying portable load bearing member illustrating alignment of a push member along a target row of the rows of bundles of roof shingles.

Figure 34:
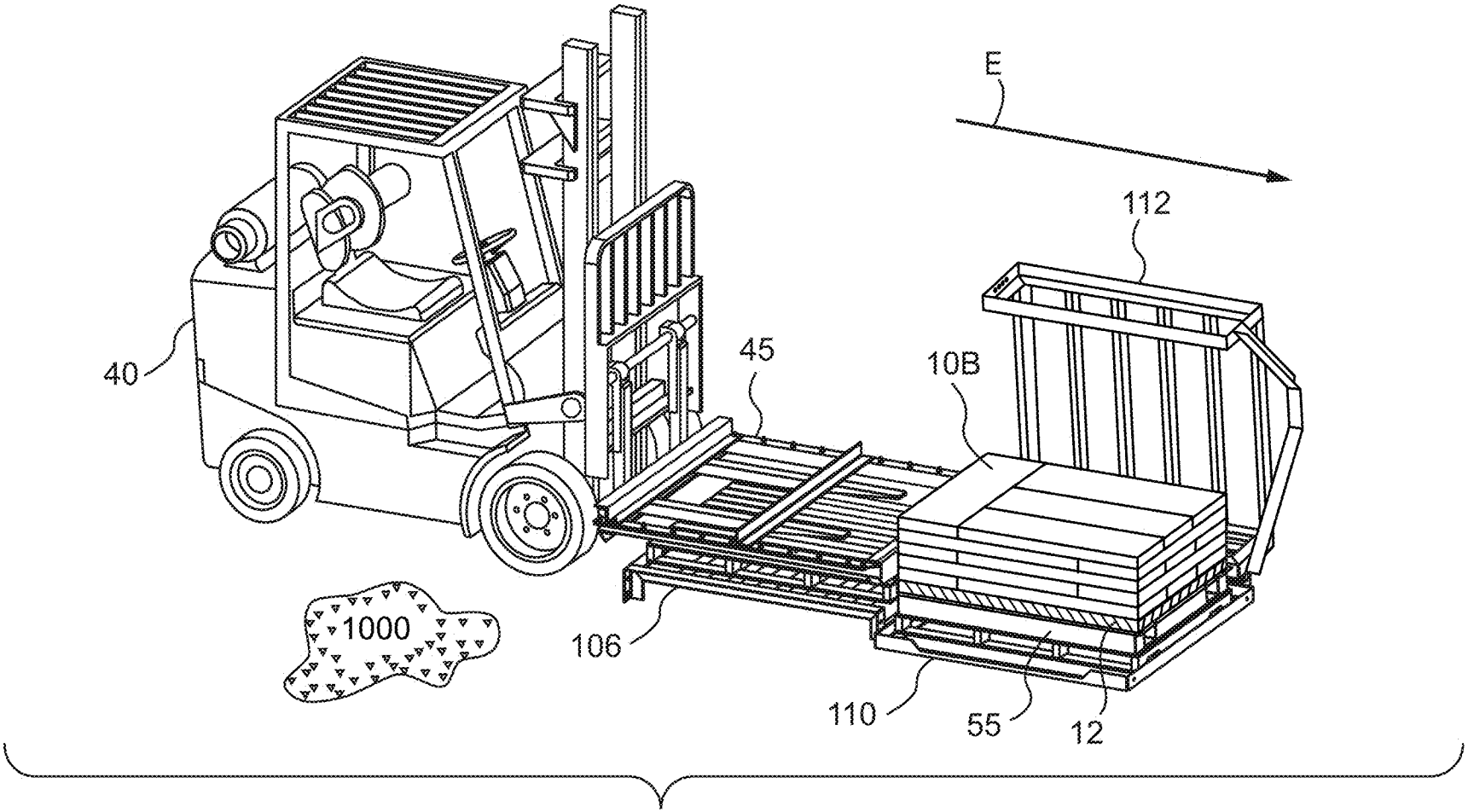

FIG. 34 is a perspective view of the assembly apparatus of FIG. 21 illustrating formation of a second load of stacked bundles of roof shingles on a second load receiving portable load bearing member.

Figure 35:
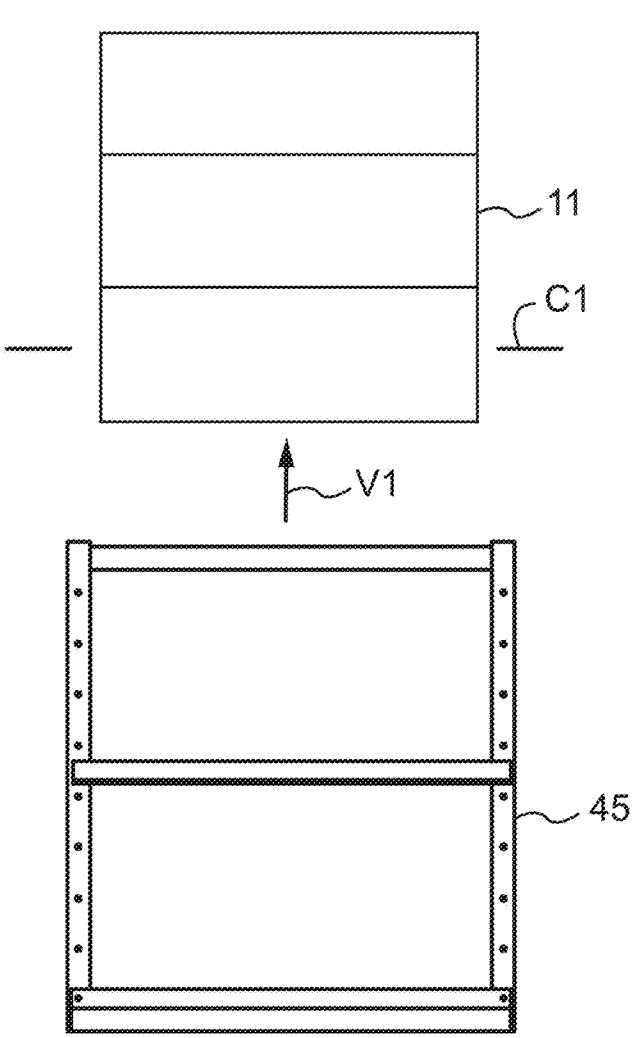

FIG. 35 is a top view of an embodiment of a push member and an exemplary target row of an embodiment of stacked bundles of shingles arranged on a load carrying portable load bearing member to be directed from an off-loading platform onto a loading platform of an assembly apparatus of this disclosure.

Figure 36:
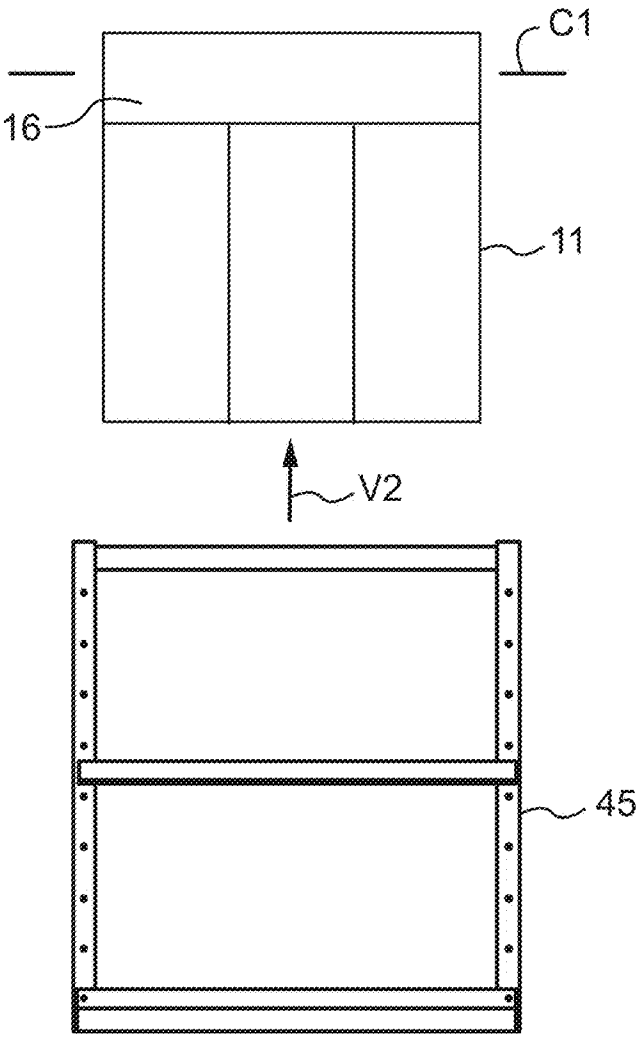

FIG. 36 is a top view of an embodiment of a push member and an exemplary target row of an embodiment of stacked bundles of shingles arranged on a load carrying portable load bearing member to be directed from an off-loading platform onto a loading platform of an assembly apparatus of this disclosure.

Figure 37:
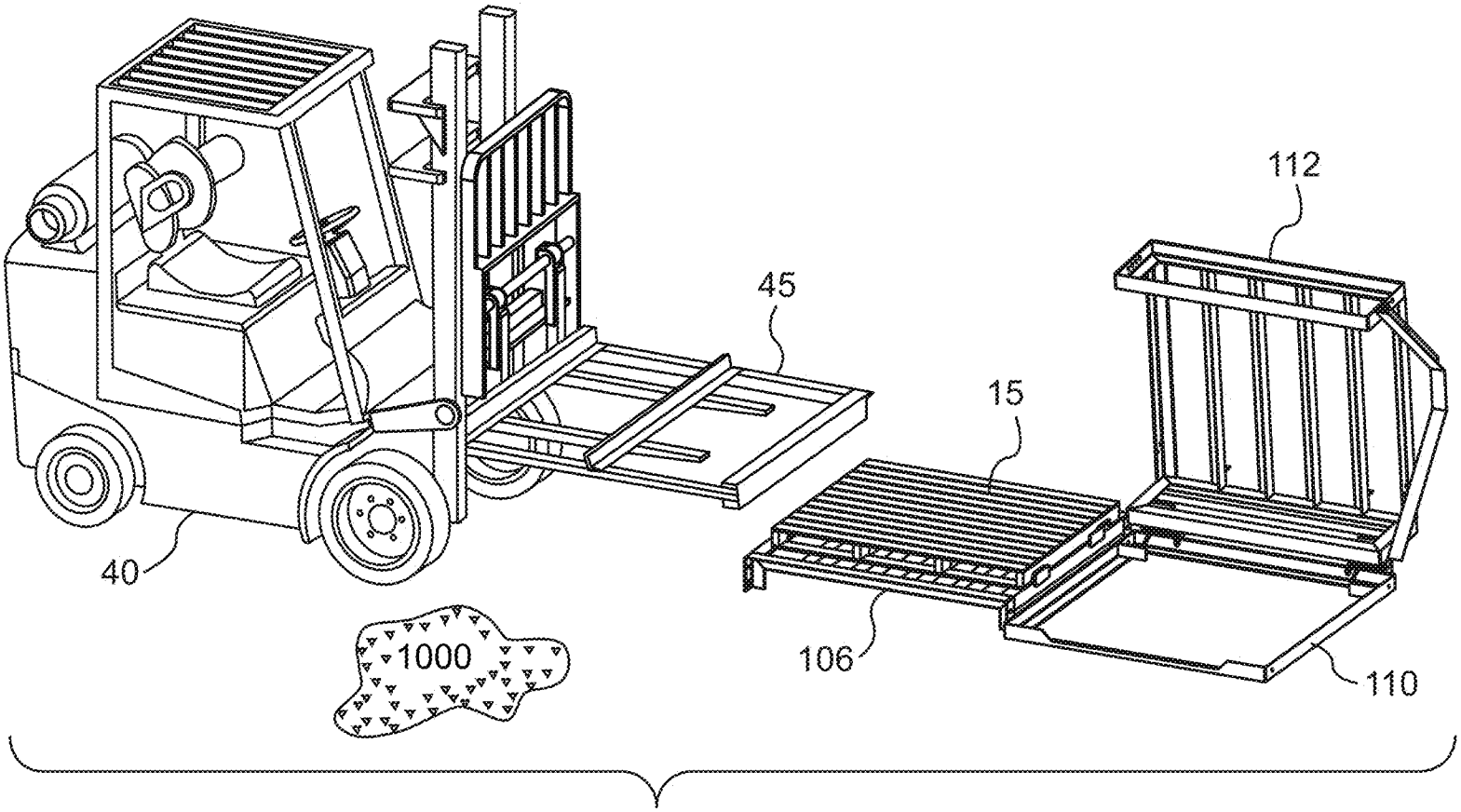

FIG. 37 is a perspective view of the assembly apparatus of FIG. 21 with the second load receiving portable load bearing member and the second load of stacked bundles of roof shingles of FIG. 34 removed from the assembly apparatus.

Figure 38:
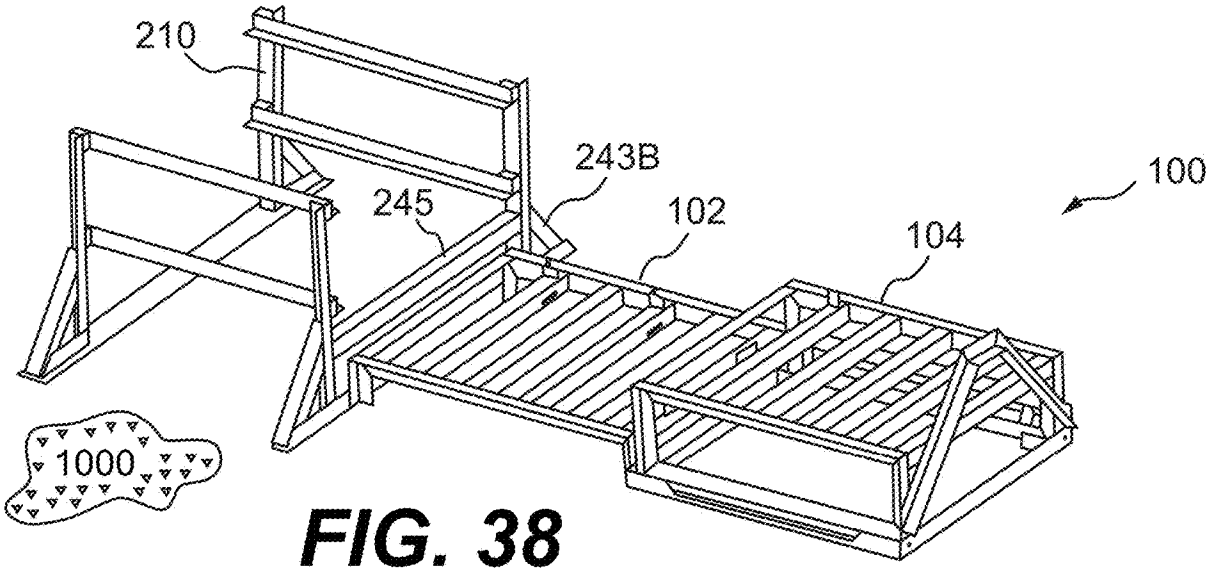

FIG. 38 is a perspective view of an embodiment of an assembly apparatus of this disclosure including a loading platform of the assembly apparatus set to a first loading position.

Figure 39:
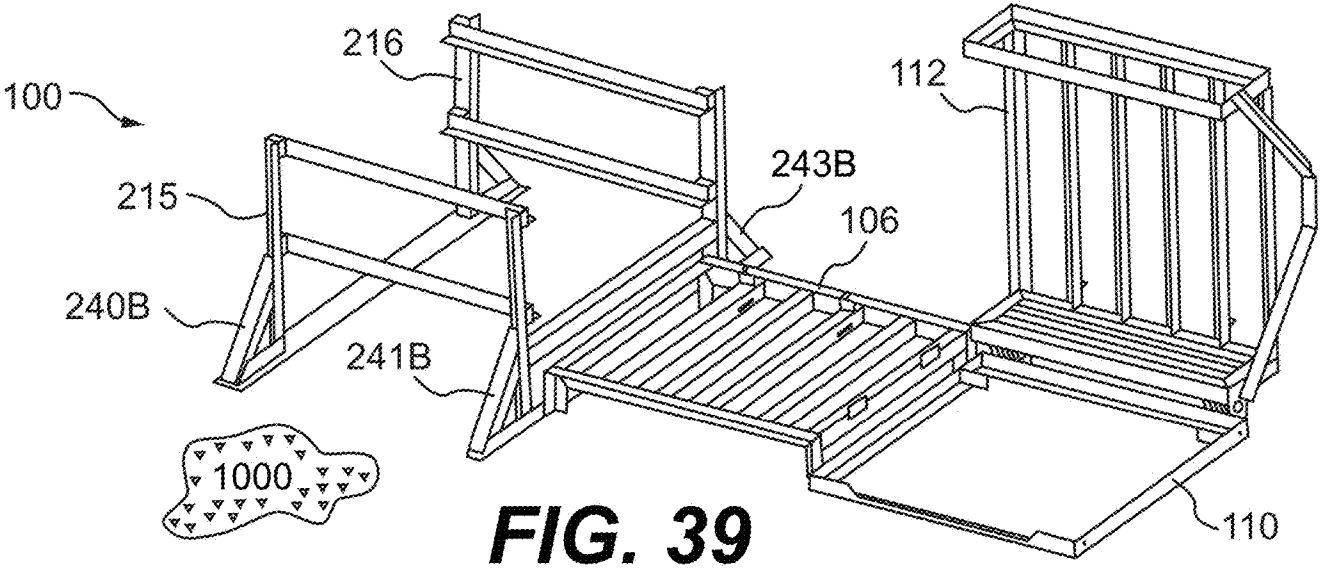

FIG. 39 is a perspective view of the assembly apparatus of FIG. 38 including the loading platform set to a second loading position.

Figure 40:
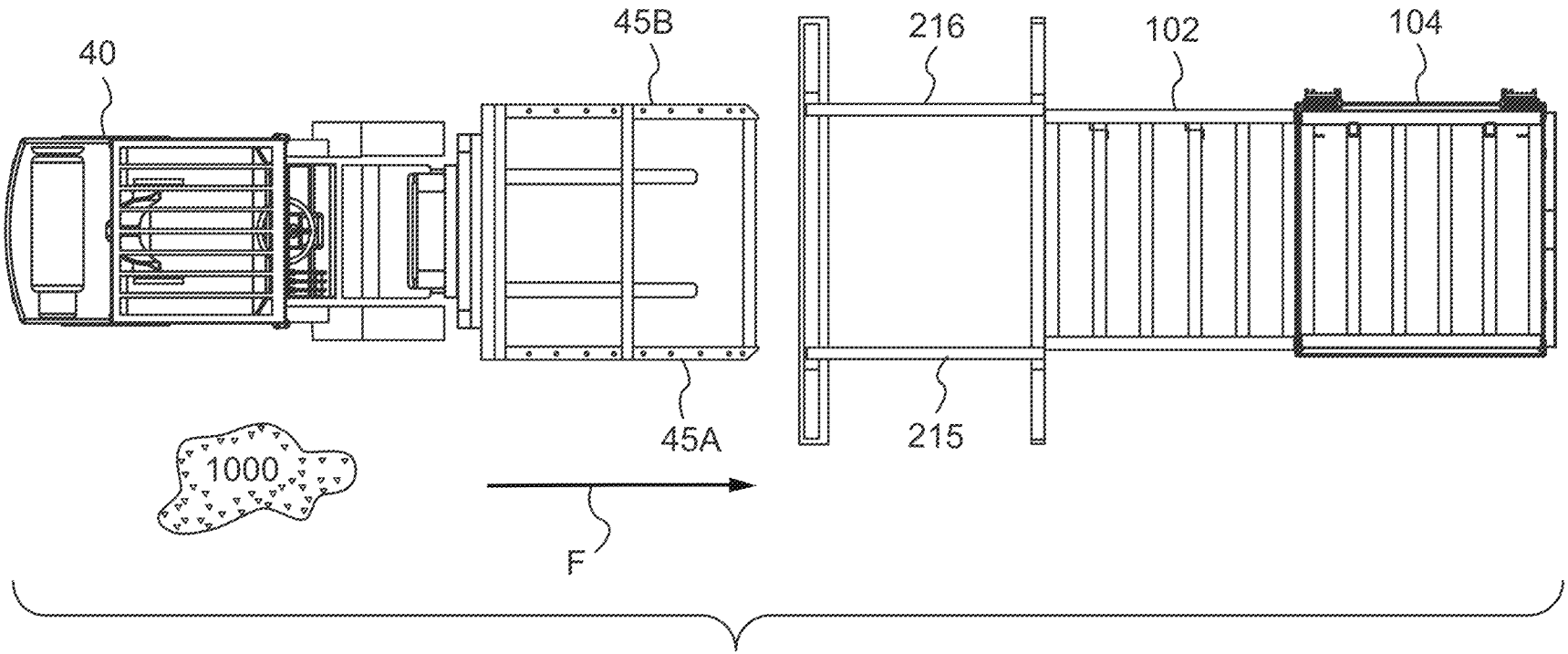

FIG. 40 is a top view illustrating alignment of a lifting device with the assembly apparatus of FIG. 38.

Figure 41:
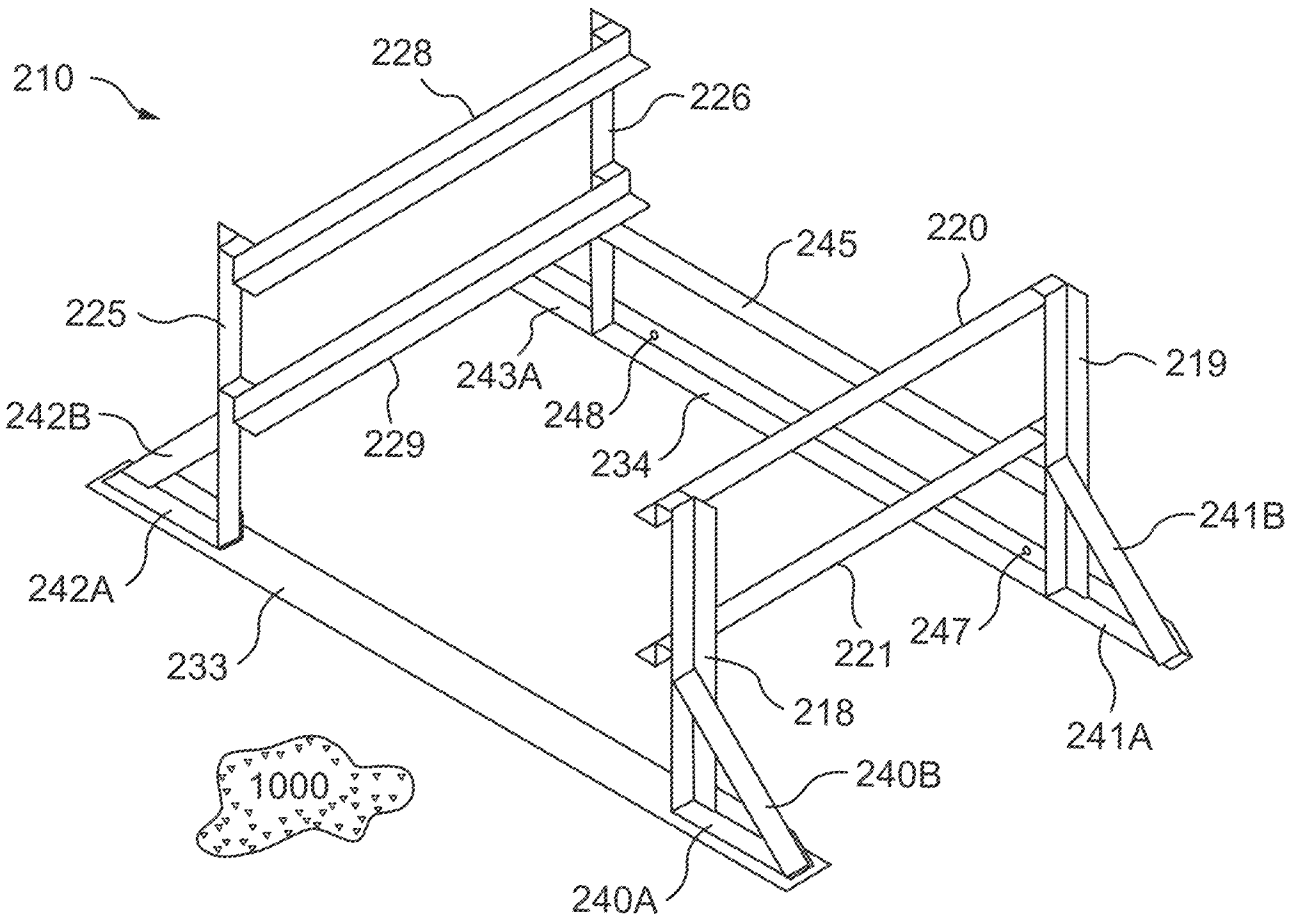

FIG. 41 is a perspective view of an embodiment of a guide stand of the assembly apparatus of FIG. 38.

Figure 42:
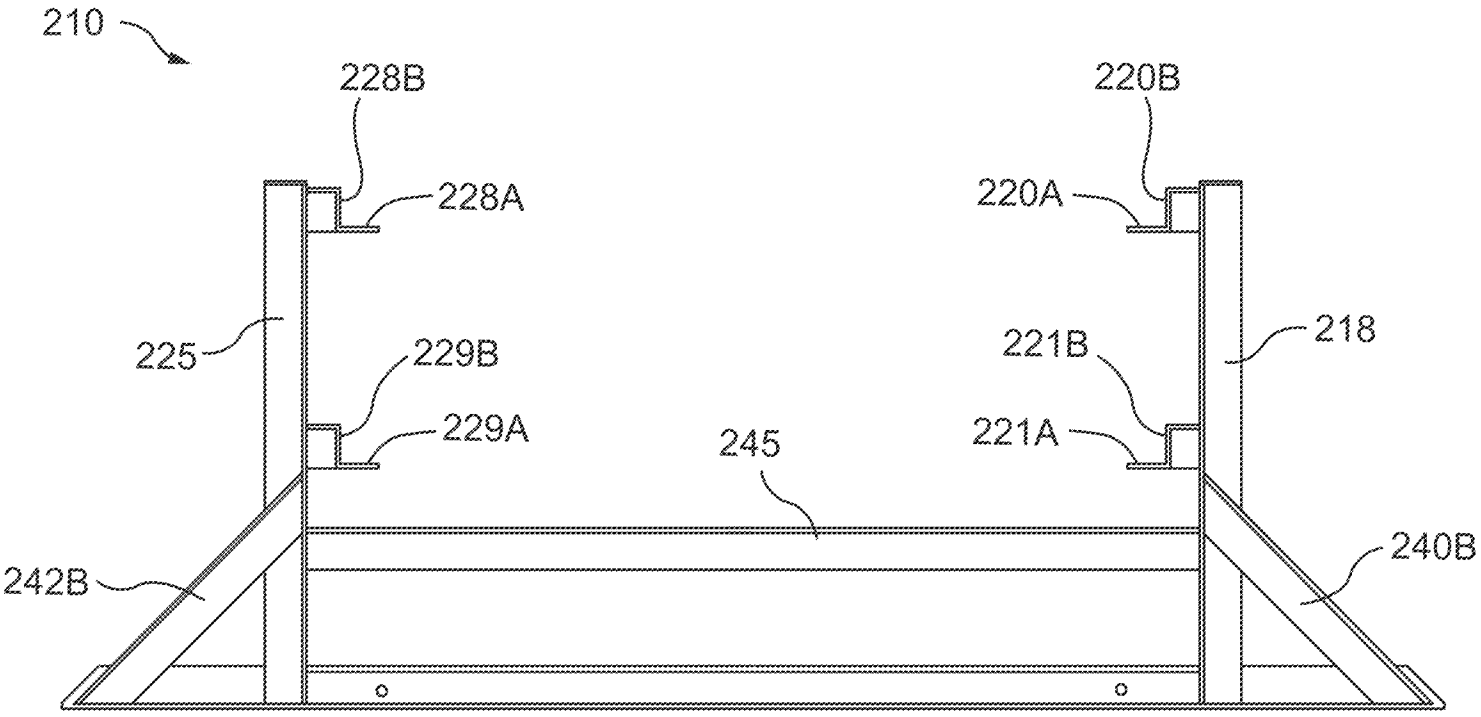

FIG. 42 is a front elevation view of the guide stand of FIG. 41.

Figure 43:
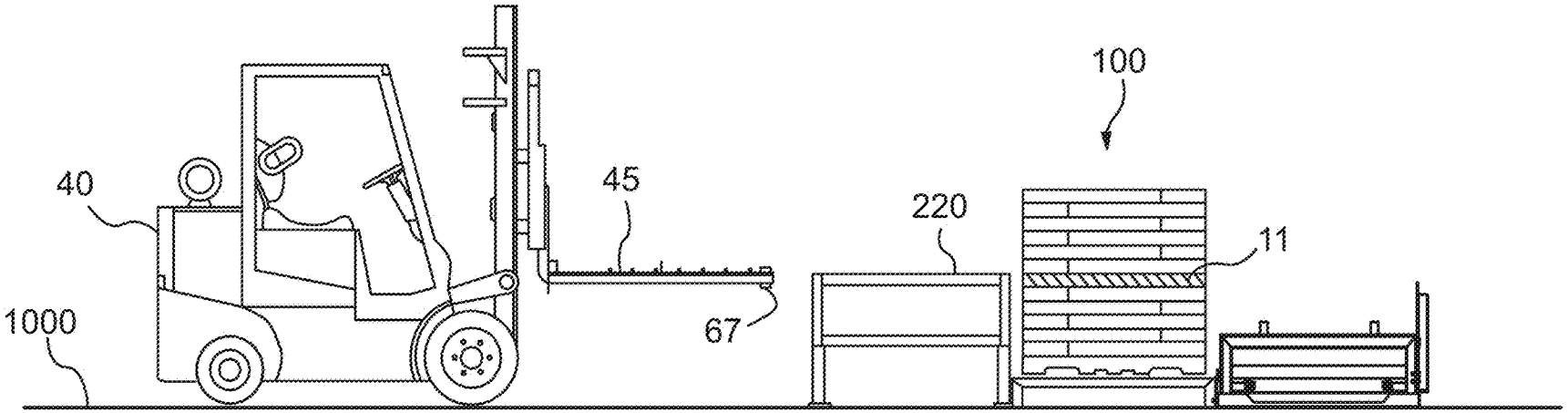

FIG. 43 is a side elevation view illustrating alignment of a push member attached to a lifting device with guide rails of the guide stand of FIG. 41.

Figure 44:
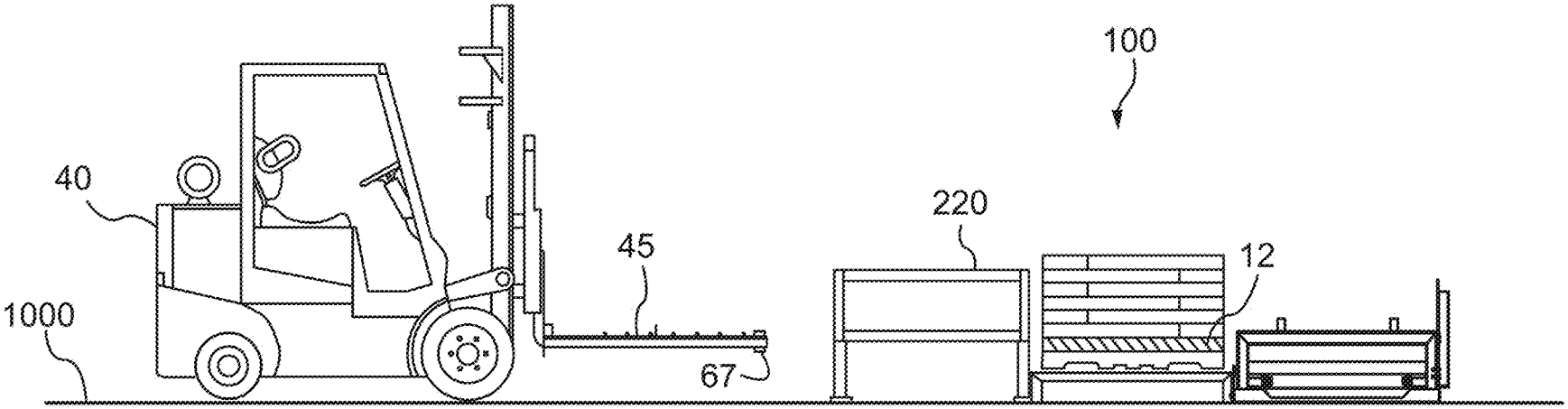

FIG. 44 is a side elevation view illustrating alignment of a push member attached to a lifting device with guide rails of the guide stand of FIG. 41.

Figure 45:
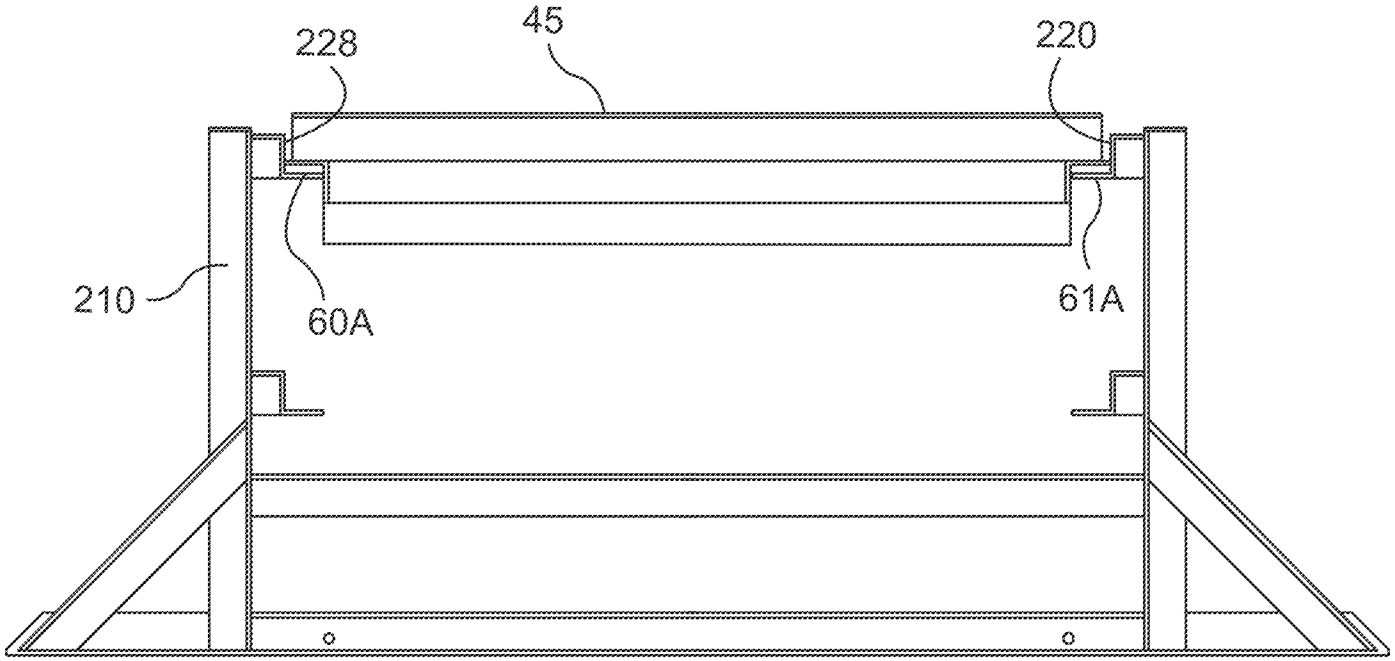

FIG. 45 is a front elevation view of the guide stand of FIG. 41 showing the push member of FIG. 43 in a first mated position with the guide stand.

Figure 46:
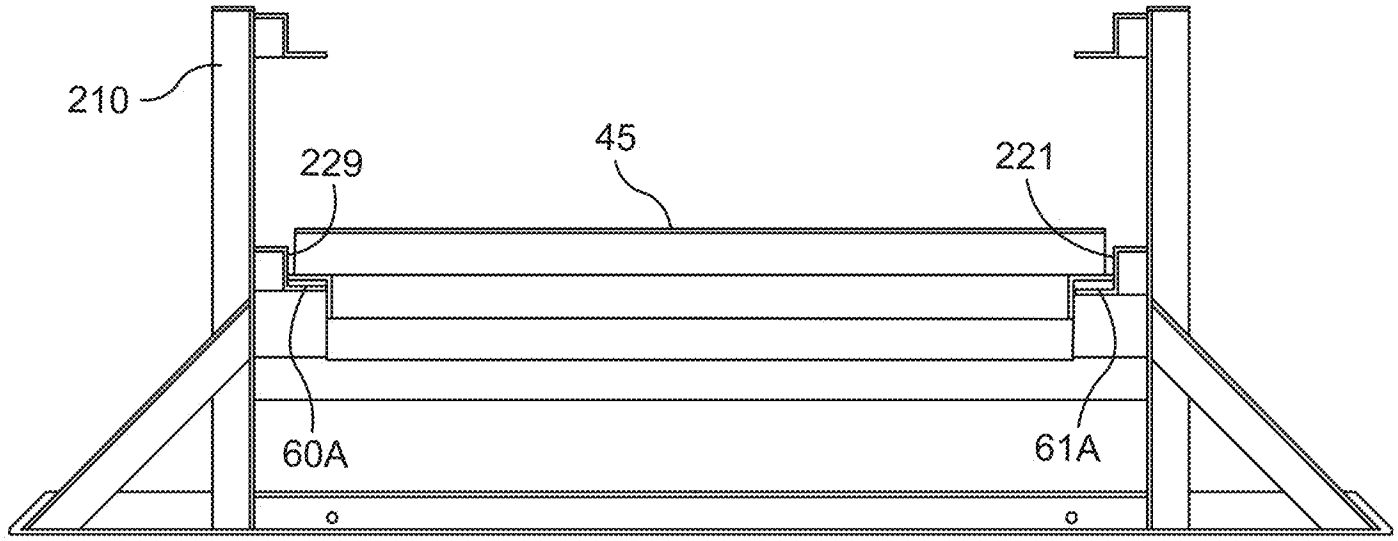

FIG. 46 is a front elevation view of the guide stand of FIG. 41 showing the push member of FIG. 44 in a second mated position with the guide stand.

Figure 47:
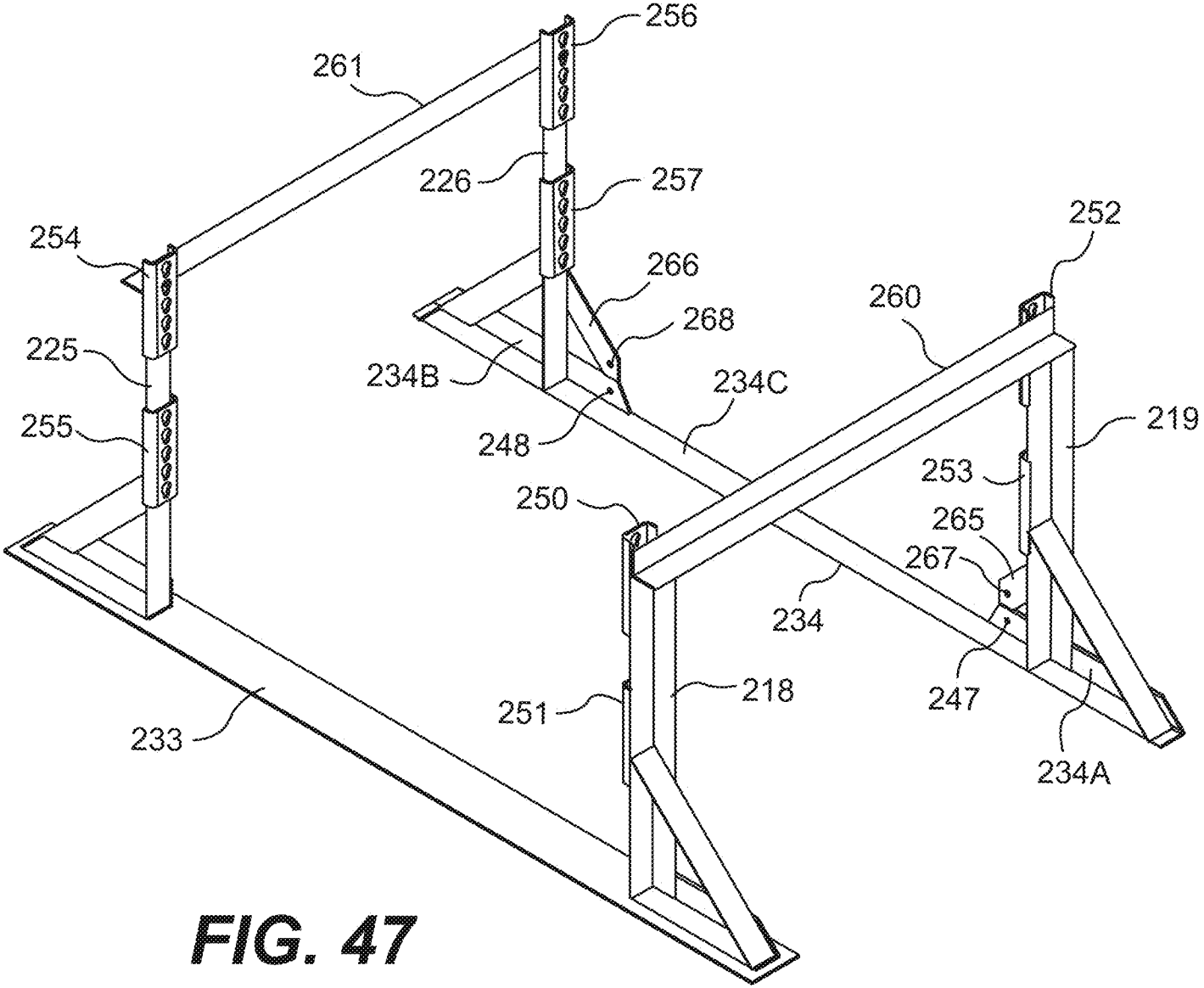

FIG. 47 is a perspective view of an embodiment of part of a guide stand of this disclosure.

Figure 48:
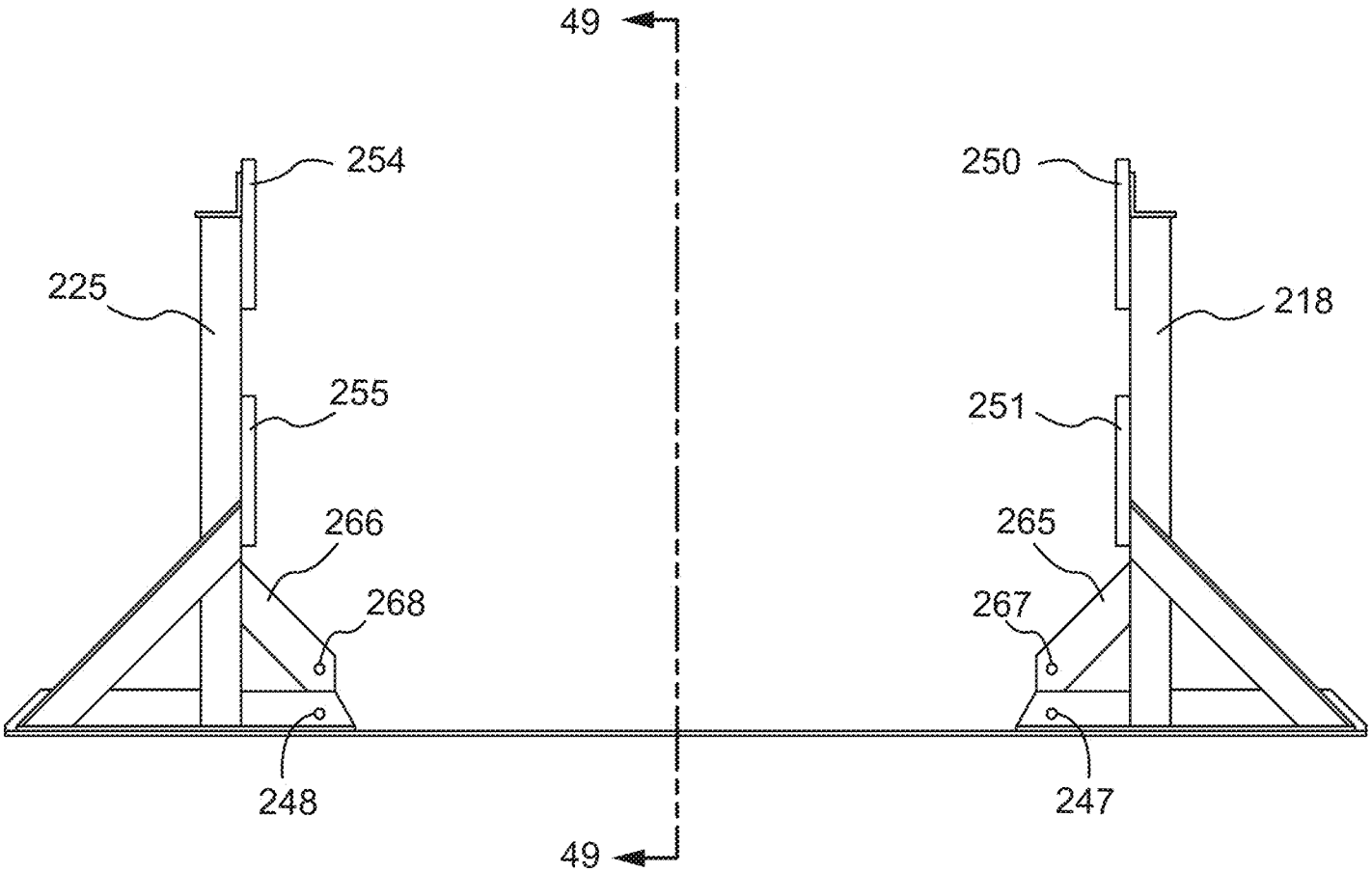

FIG. 48 is a front elevation view of the part of a guide stand of FIG. 47.

Figure 49:
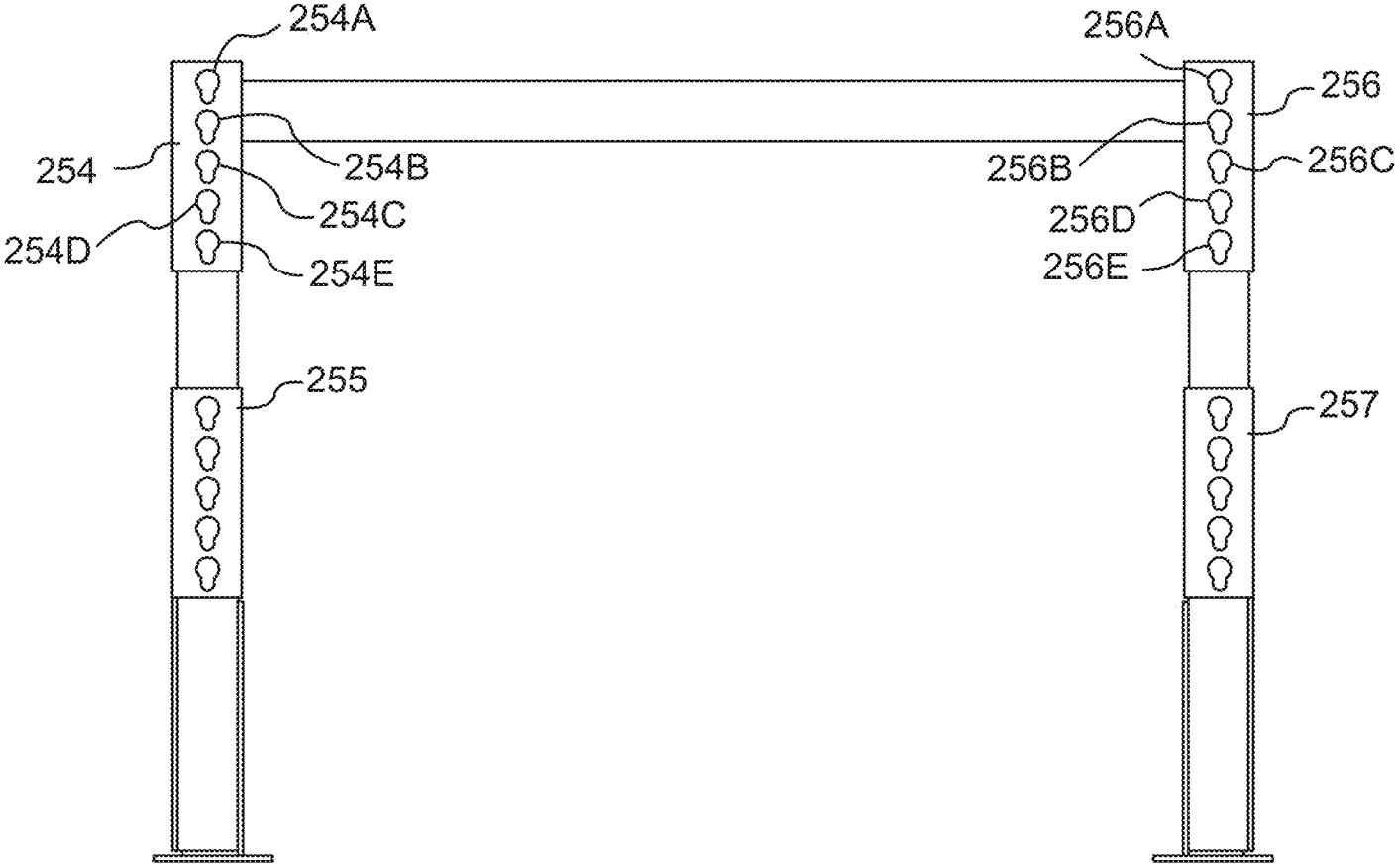

FIG. 49 is a side elevation view of part of a left side guide rack of the part of a guide stand of FIG. 47.

Figure 50:
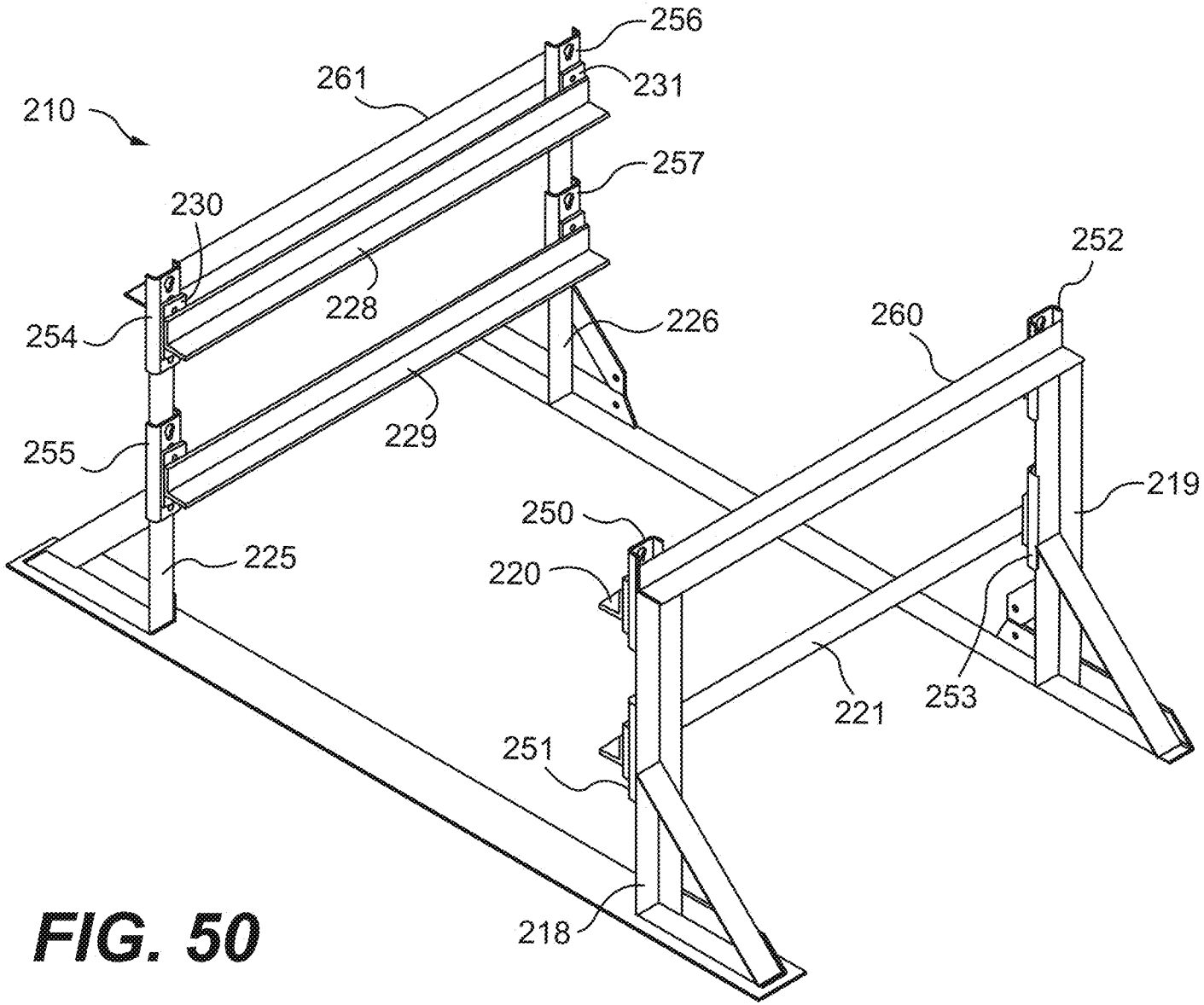

FIG. 50 is a perspective view of an embodiment the part of a guide stand of FIG. 47 including upper and lower right guide rails attached to a right side guide rack of the guide stand and upper and lower left guide rails attached to a left side guide rack of the guide stand.

Figure 51:
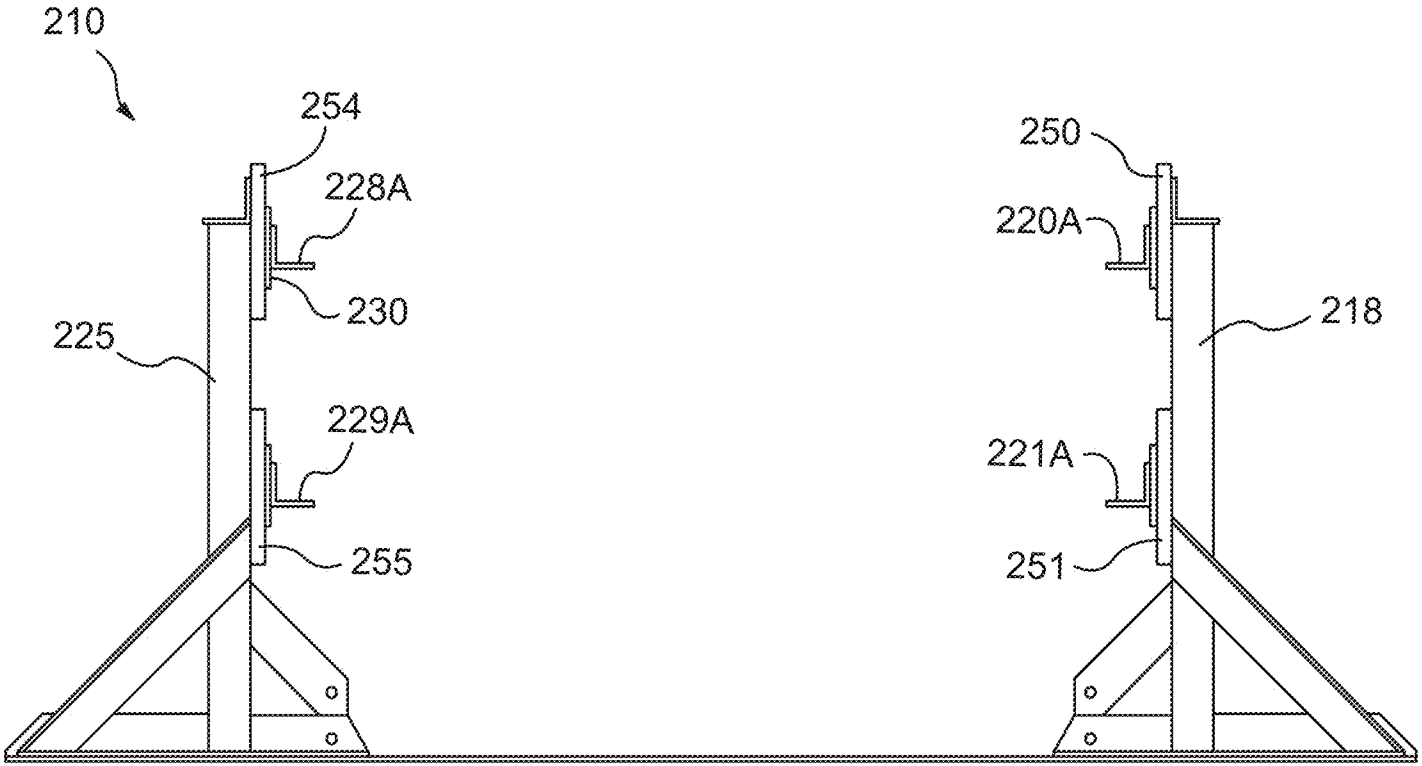

FIG. 51 is a front elevation view of the guide stand of FIG. 50.

Figure 52:
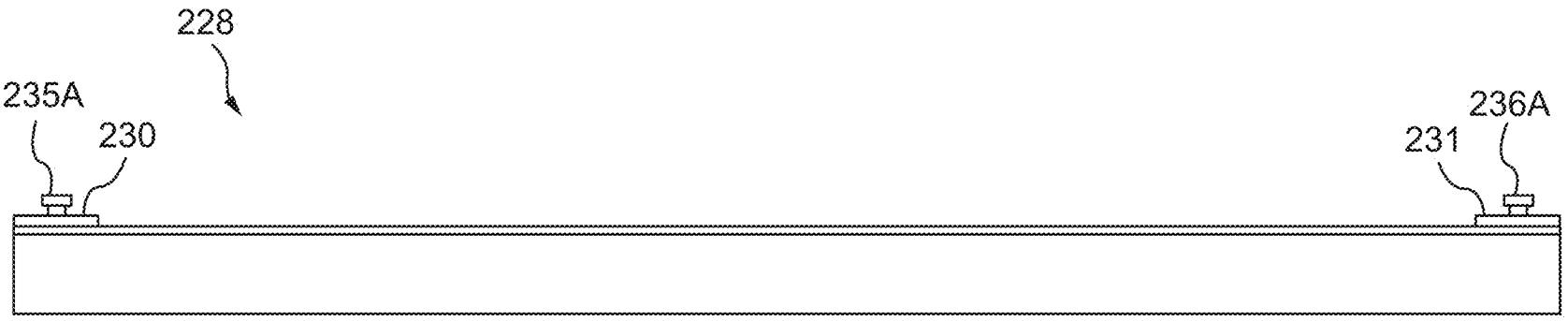

FIG. 52 is a top view of the upper left guide rail of the guide stand of FIG. 50.

Figure 53:
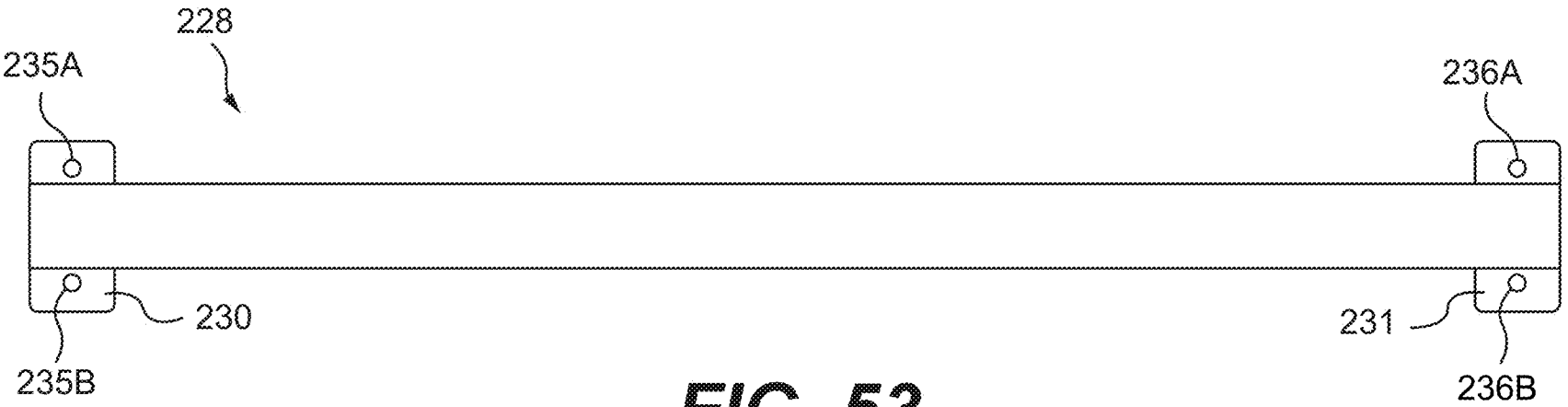

FIG. 53 is a front elevation view of the upper left guide rail of FIG. 52.

Figure 54:
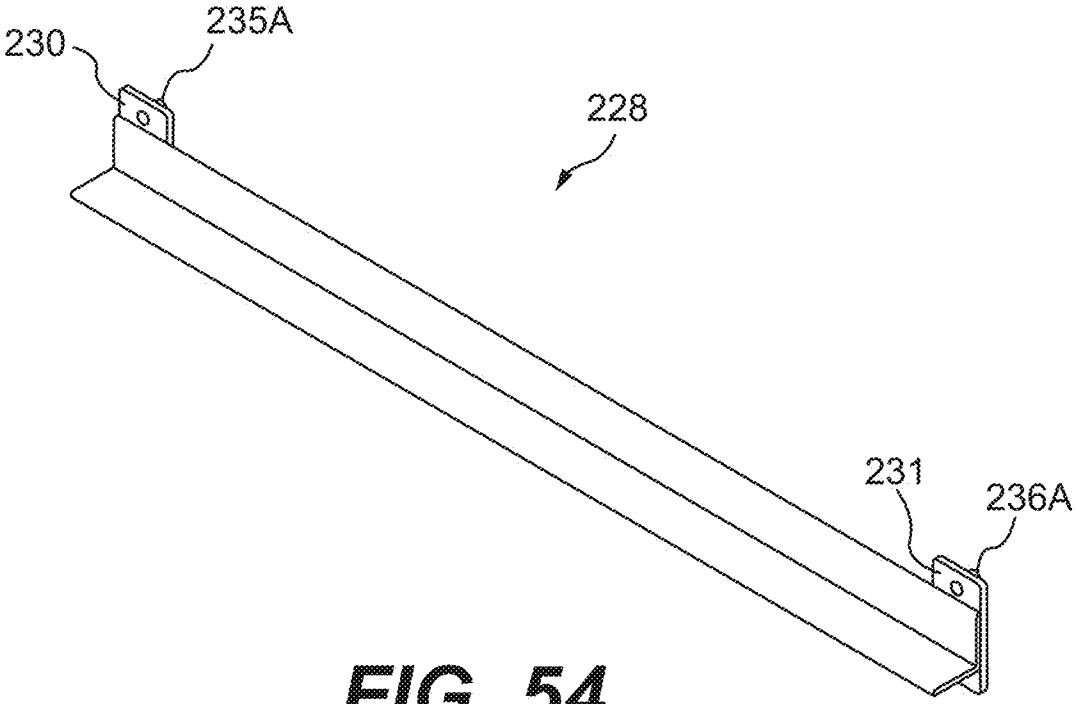

FIG. 54 is a perspective view of the upper left guide rail of FIG. 52.

Figure 55:
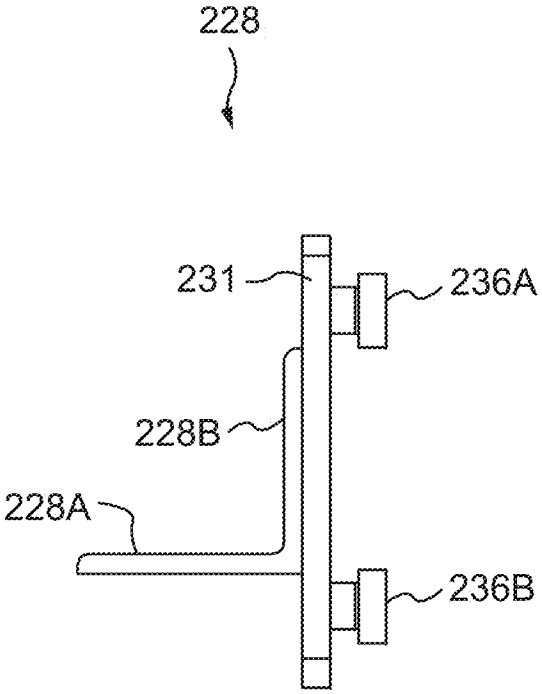

FIG. 55 is a side elevation view of the upper left guide rail of FIG. 52.

Figure 56:
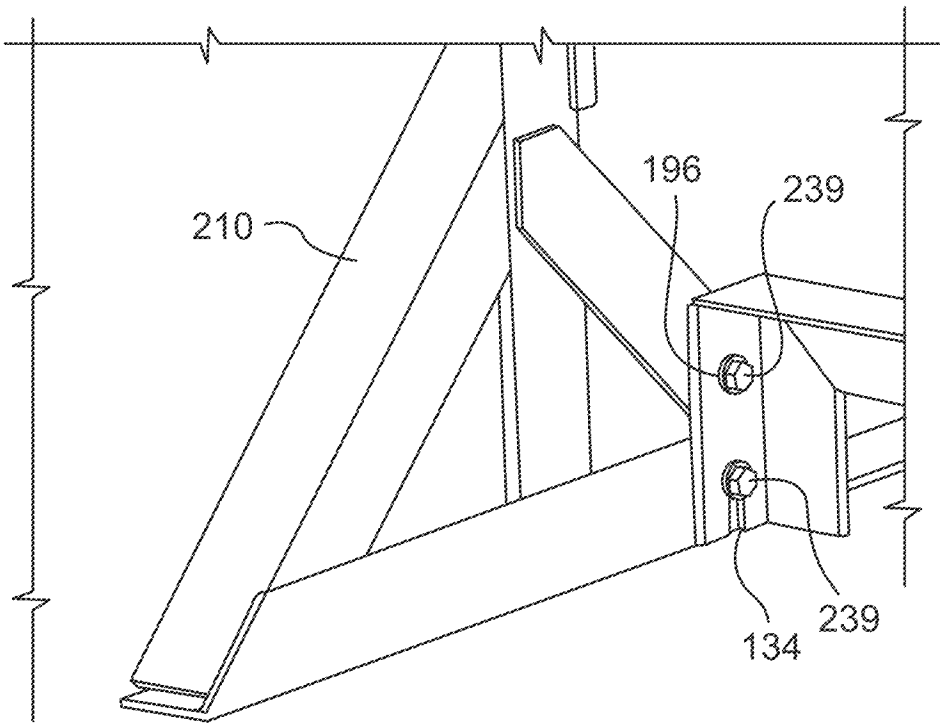

FIG. 56 is a perspective detailed view illustrating the guide stand of FIG. 50 fastened to an off-loading assembly.

Figure 57:
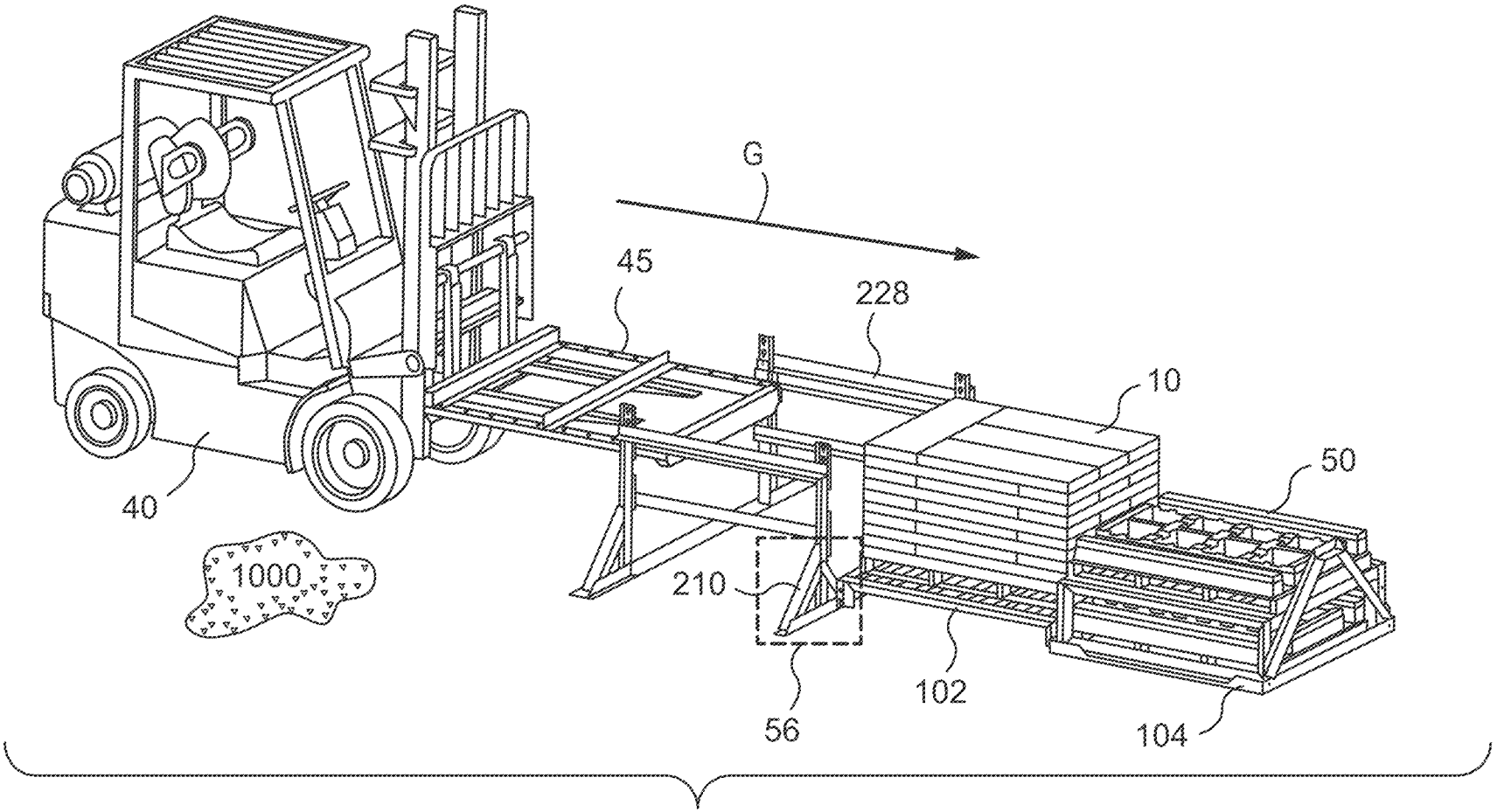

FIG. 57 is a perspective view illustrating alignment of a lifting device with the assembly apparatus including the guide stand of FIG. 50 with stacked bundles of roof shingles on a load carrying portable load bearing member on an off-loading assembly of the assembly apparatus and with a first load receiving portable load bearing member and a second load receiving portable load bearing member located on a loading assembly of the assembly apparatus.

Figure 58:
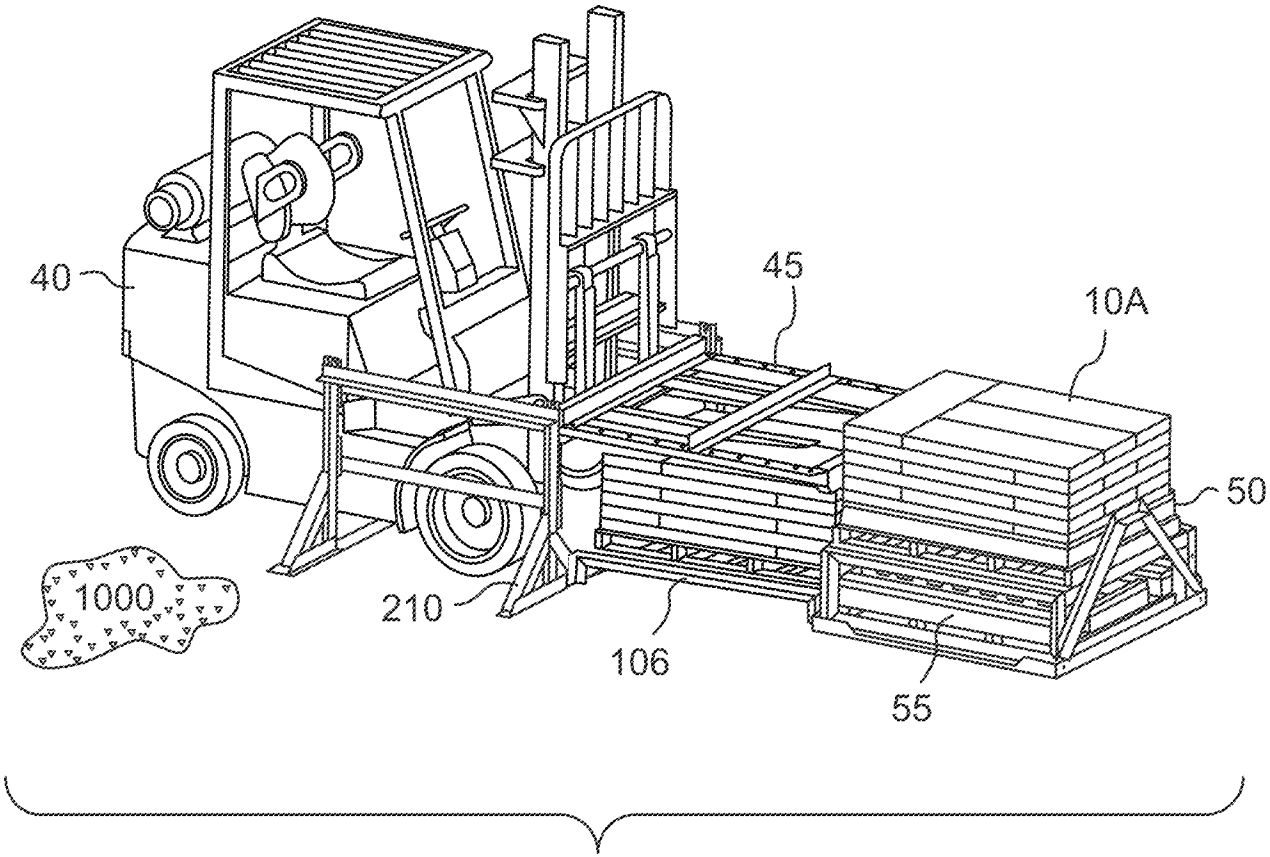

FIG. 58 is a perspective view of the assembly apparatus of FIG. 57 illustrating formation of a first load of stacked bundles of roof shingles on a first load receiving portable load bearing member.

Figure 59:
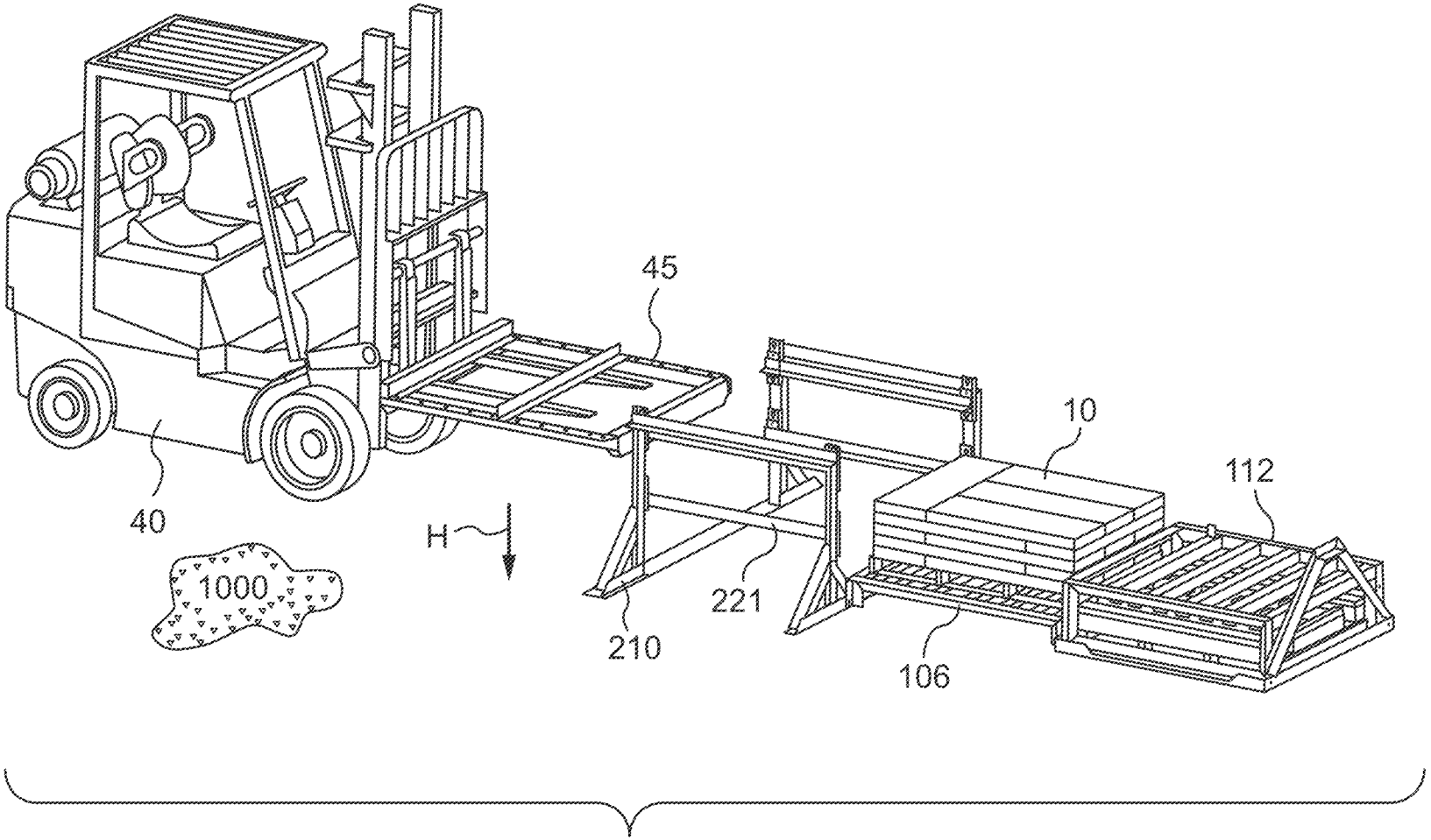

FIG. 59 is a perspective view of the assembly apparatus of FIG. 57 with the first load receiving portable load bearing member and the first load of stacked bundles of roof shingles of FIG. 58 removed from the assembly apparatus.

Figure 60:
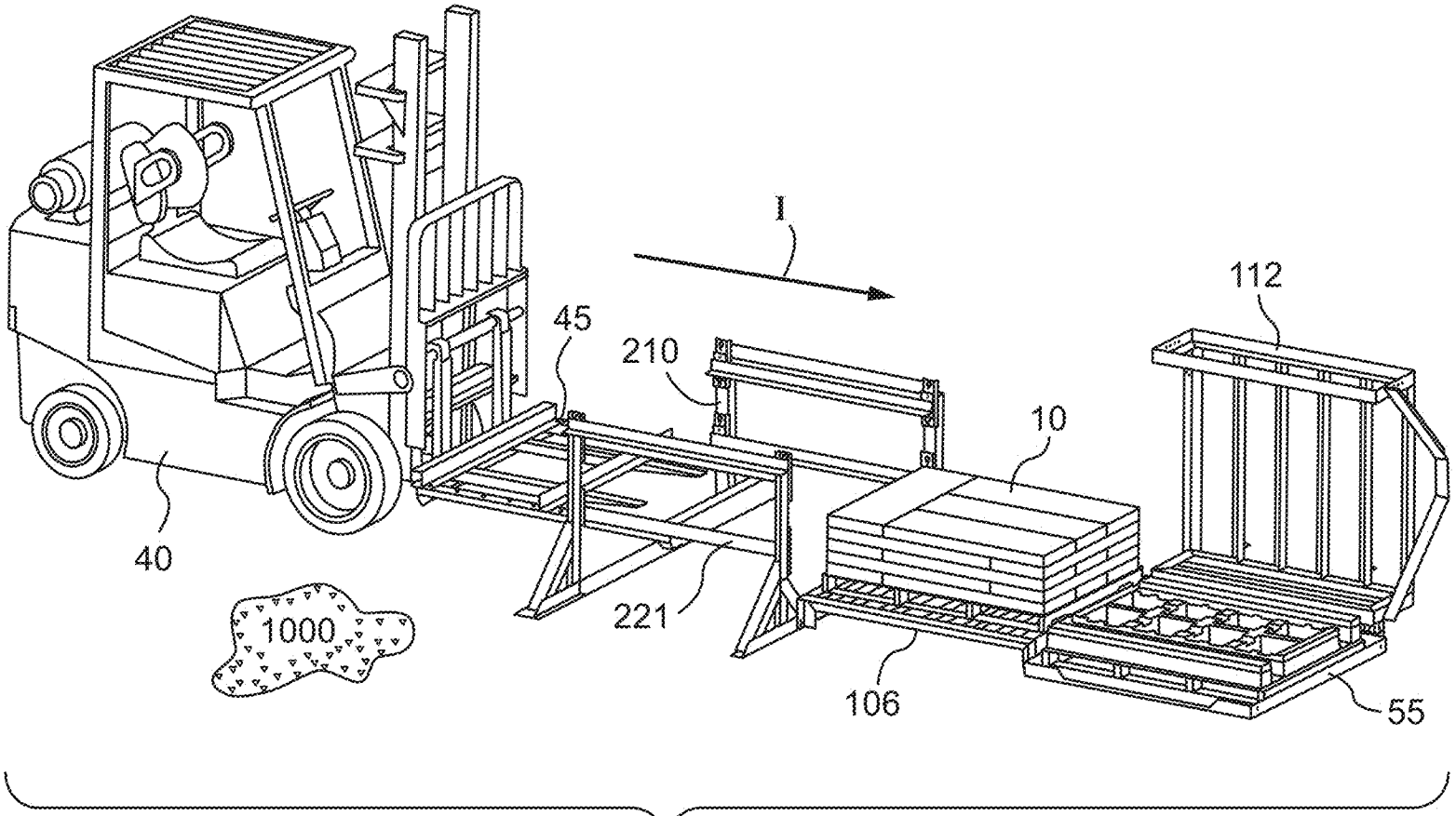

FIG. 60 is a perspective view of the assembly apparatus of FIG. 57 illustrating a loading platform of the assembly apparatus set to a second loading position prior to formation of a second load of stacked bundles of roof shingles on a second load receiving portable load bearing member.

Figure 61:
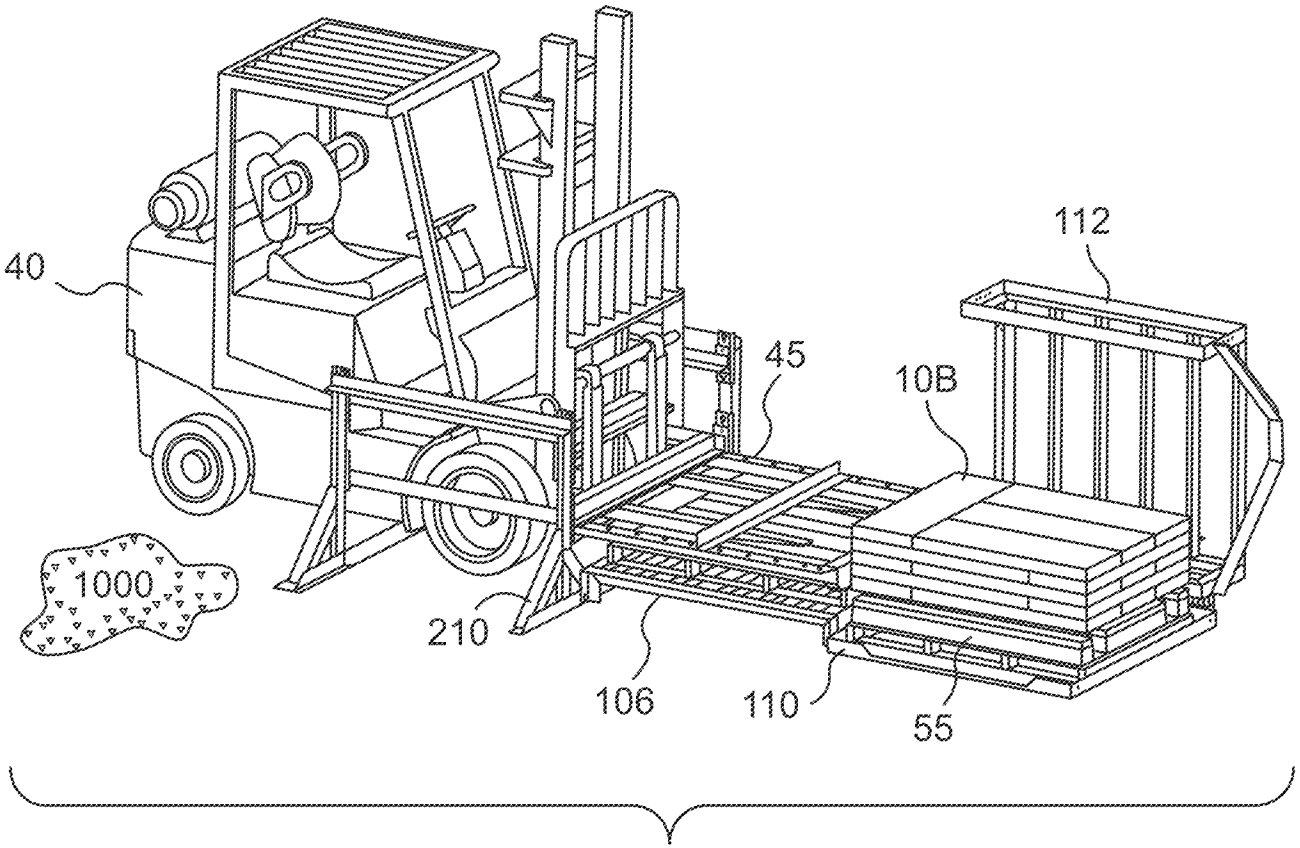

FIG. 61 is a perspective view of the assembly apparatus of FIG. 57 illustrating formation of a second load of stacked bundles of roof shingles on a second load receiving portable load bearing member.

Figure 62:
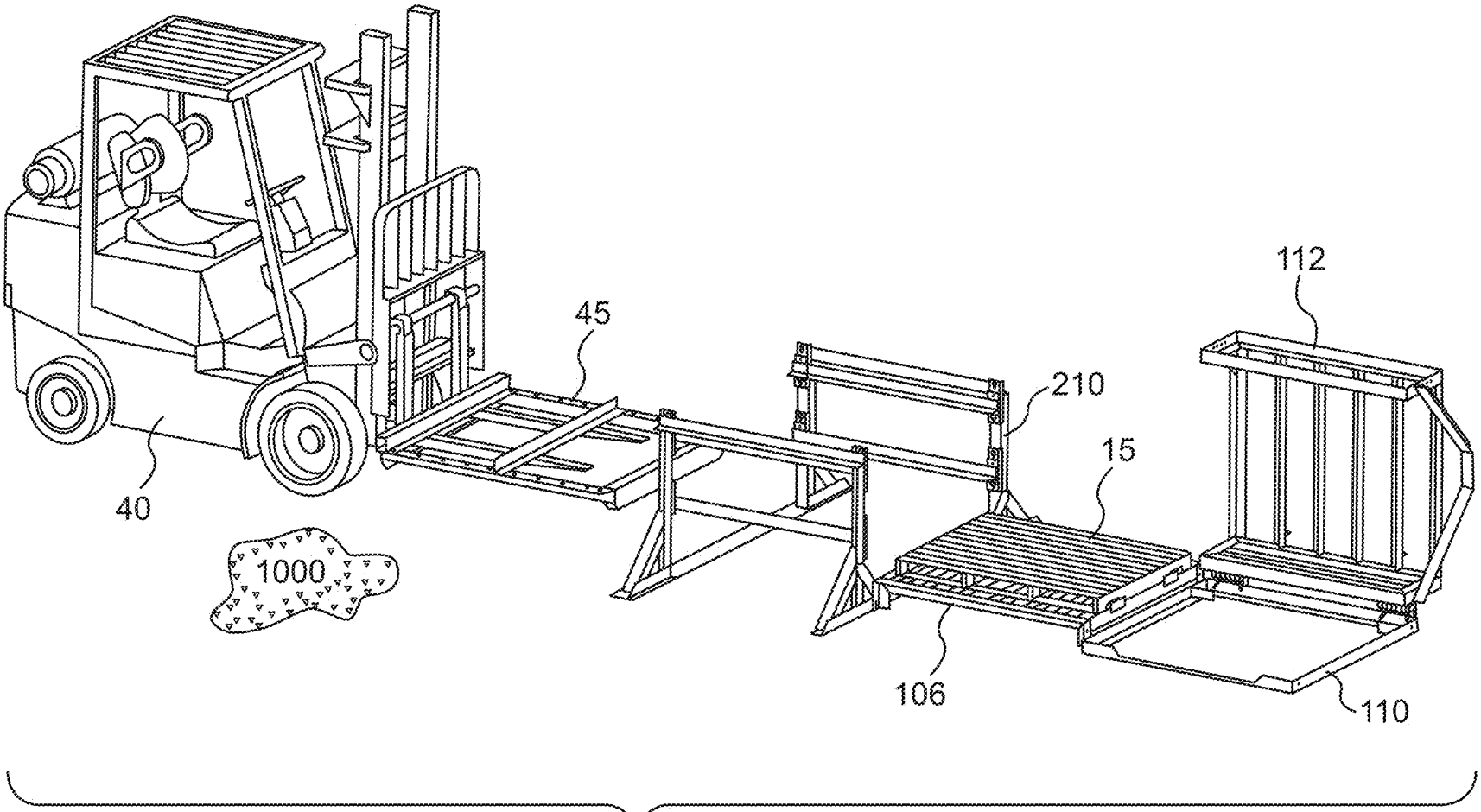

FIG. 62 is a perspective view of the assembly apparatus of FIG. 57 with the second load receiving portable load bearing member and the second load of stacked bundles of roof shingles of FIG. 61 removed from the assembly apparatus.

DEFINITIONS USED IN THE DISCLOSURE

The term "at least one", "one or more", and "one or a plurality" mean one thing or more than one thing with no limit on the exact number; these three terms may be used interchangeably within this disclosure. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

The term "and/or" includes any and all combinations of one or more of the associated listed items.

The terms "first," "second," "third," and/or the like, herein do not denote any order, quantity, or importance, but rather are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. For example, in some circumstances, an event or capacity can be expected, while in other circumstances, the event or capacity cannot occur. This distinction is captured by the terms "may" and "may be."

Terms and phrases used in this disclosure, and variations thereof, unless otherwise expressly stated, should be construed as open-ended as opposed to limiting. As examples of the foregoing: the term "including" should be read as meaning "including, without limitation" and/or the like; the term "example" is used to provide exemplary instances of the item in discussion, not an exhaustive or limiting list thereof; the terms "a" or "an" should be read as meaning "at least one," "one or more," and/or the like. The use of the term "assembly" does not imply that the components or functionality described or claimed as part of an assembly are all necessarily configured in a common package.

Spatially relative terms, such as "inner," "outer," "beneath," "below," "lower," "above," "upper," "top," "bottom," and the like, may be used herein. These spatially relative terms can be used for ease of description to describe one element's or feature's relationship to another element(s) or feature(s) as illustrated in the figures. The spatially relative terms may also be intended to encompass different orientations of an apparatus, assembly or device in use, or operation, in addition to the orientation depicted in the figures. For example, if an apparatus, assembly, or device in the figures is turned over, elements described as "below" or "beneath" other elements or features would then be oriented "above" the other elements or features. Thus, the example term "below" can encompass both an orientation of above and below. The apparatus, assembly, or device may be otherwise oriented (rotated 90.0 degrees or at other orientations) and the spatially relative descriptions used herein interpreted accordingly.

The term "simultaneous" or "simultaneously" means that an action occurs either at the same time or within a small period of time. Thus, a sequence of events is considered to be simultaneous if they occur concurrently or at the same time or occur in rapid succession over a short period of time, where the short period of time ranges from about 1 nanosecond to 5 second. In other embodiments, the period ranges from about 1 nanosecond to 1 second. In other embodiments, the period ranges from about 1 nanosecond to 0.5 seconds. In other embodiments, the period ranges from about 1 nanosecond to 0.1 seconds. In other embodiments, the period ranges from about 1 nanosecond to 1 millisecond. In other embodiments, the period ranges from about 1 nanosecond to 1 microsecond. It should be recognized that any value of time between any stated range is also covered.

DETAILED DESCRIPTION OF THE DISCLOSURE

For the purposes of promoting an understanding of the principles of the disclosure, reference is now made to the embodiments illustrated in the figures and particular language will be used to describe the same.

It is understood that no limitation of the scope of the claimed subject matter is intended by way of the disclosure. It is also understood that the present disclosure is not limited to particular embodiments. It is further understood that the terminology used herein is for the purpose of describing particular embodiments only, and is not intended to be limiting. For purposes of this disclosure, stackable items that may be moved using a system, apparatus, assembly and method of this disclosure may include, but are not limited to cube shaped and/or substantially cube shaped items stackable in rows, cuboid shaped items and/or substantially cuboid shaped items stackable in rows, items having a sheet material type configuration stackable in rows, items having an elongated plank type configuration that are stackable in rows, cylindrical shaped items and/or substantially cylindrical shaped items stackable in rows, and rolled up items that are stackable in rows. Examples of cube shape items may include, but are not limited to cube shape boxes, cube shape containers, and cube shaped solid objects. Examples of cuboid shaped items may include, but are not limited to cuboid shape boxes, cuboid shape containers, and cuboid shape solid objects. Although some variation may exist in dimensions realized, for purposes of this disclosure bundles of roofing shingles may be considered as cuboid in shape. Examples of items having a sheet material type configuration include, but are not limited to drywall, plywood, board material, glass, and plastic sheet type building materials. Examples of items having an elongated plank type configuration may include, but are not limited to dimensional lumber, dimensional foam, dimensional plastic, and dimensional composite materials. Examples of cylindrical shaped items include, but are not limited to pipe and other tubular items, solid cylindrical items such as metal cylinders, plastic cylinders, composite cylinders, wood cylinders, stone cylinders, and foam cylinders. Examples of rolled up items include, but are not limited to carpet, wire mesh, roll roofing, galvanized steel rolls, insulation rolls, and rolled fence material. Herein, the terms "bundles of roof shingles," "bundles of shingles," "bundled shingles," and "shingle bundles" may be used interchangeably.

For purposes of this disclosure, the term "portable load bearing member" may include, but is not necessarily limited to one or more pallets, skids, crates, cartons, baskets, containers, receptacles, cages, racks, trays, boxes, portable platform assemblies, and combinations thereof configured to hold stackable items thereon. As understood by the skilled artisan, a common pallet used in industry is characterized by a top deck portion and a bottom deck portion for structural support and a skid used in industry is characterized by a single-deck without a bottom deck portion. Non-limiting examples of pallets may include two-way pallets and four-way pallets as such terms are known in the art. Exemplary two-way pallet styles may include (1) reversible pallets, (2) closed boarded, no base board pallets, and (3) wing type pallets. Exemplary four-way pallets may include (1) close boarded, three base pallets, (2) perimeter base pallets, (3) wing type pallets, (4) close boarded, perimeter base pallets, and (5) open boarded, three base pallets. Another exemplary pallet may include a EUR pallet as such term is understood by the skilled artisan. Commercially available pallets and skids may be constructed from materials including, but not necessarily limited to one or more woods, one or more pressed woods, one or more plastics, one or more rubbers, one or more metals, one or more cardboard materials, one or more composite materials, and combinations thereof. Non-limiting examples of pallets are described U.S. Pat. No. 5,896,818, titled "Modular Pallet to Absorb Lifting Force," issued on Apr. 27, 1999; U.S. Pat. No. 5,327,839, titled "Corrugated Fiberboard Pallet," issued on Jul. 12, 1994; each of which is herein incorporated by reference in its entirety. Non-limiting examples of portable platform assemblies are described in U.S. Pat. No. 11,802,024, titled "System and Method for the Transport and Holding of Building Materials," issued on Oct. 31, 2023; and U.S. Publication No. 2022/0355973 A1, titled "System and Method for the Transport and Holding of Building Materials," published on Nov. 10, 2022; each of which is herein incorporated by reference in its entirety.

For purposes of this disclosure, one exemplary lifting device for use with a portable load bearing member may include, but is not limited to an industrial vehicle such as a forklift and/or the like. One exemplary lifting device may include a forklift having a lift capacity of at least 1.83 meters (6.0 feet). Non-limiting examples of lifting devices for purposes of this disclosure are described in U.S. Pat. No. 7,051,832 B2, titled "Material Handling Vehicle with Dual Control Handles," issued on May 30, 2006; U.S. Pat. No. 7,366,600, titled "Distributed Control System for Forklift," issued on Apr. 29, 2008; U.S. Pat. No. 8,230,976 B2, titled Pallet Truck with Calculated Fork Carriage Height," issued on Jul. 31, 2012; U.S. Pat. No. 9,475,513 B2, titled "Pallet Truck," issued on Oct. 25, 2016; U.S. Pat. No. 4,919,233, titled "Front Rider Lift Truck," issued on Apr. 24, 1990; and U.S. Pat. No. 6,398,480 B1, titled "Fork Lift Truck," issued on Jun. 4, 2002; U.S. Pat. No. 11,814,274 B2, titled "Forklift," issued on Nov. 14, 2023; each of which is herein incorporated by reference in its entirety.

In an embodiment, the disclosure is related to a system, apparatus, assembly and method for moving stackable items off from one or more portable load bearing members onto one or more other portable load bearing members.

In an embodiment, the disclosure is related to a system, apparatus, assembly and method for moving stackable items off from a first portable load bearing member onto at least a second portable load bearing member.

In an embodiment, the disclosure is related to a system, apparatus, assembly and method for directing stackable items off from a first portable load bearing member onto at least a second portable load bearing member and a third portable load bearing member. In an embodiment, the first, second and third portable load bearing members may be of like kind. In another embodiment, at least one of the first, second and third portable load bearing members may be of a kind different than the other two portable load bearing members. In another embodiment, each of the first, second and third portable load bearing members may be of a kind different than the other two.

In an embodiment, the disclosure is related to off-loading stackable items from a load carrying portable load bearing member onto one or more load receiving portable load bearing members.

In an embodiment, the disclosure is related to off-loading a plurality of stackable items from a plurality of load carrying portable load bearing members onto a plurality of one or more load receiving portable load bearing members.

In an embodiment, the disclosure is related to a system, apparatus, assembly and method for moving stackable items off from at least a first load carrying portable load bearing member onto one or more load receiving portable load receiving load bearing members. In an embodiment, an apparatus or assembly of this disclosure may be provided as a one-piece construction. In an embodiment, an apparatus or assembly of this disclosure may comprise a structural framework of two or more components.

In an embodiment, the disclosure is related to an assembly, apparatus or assembly apparatus comprising a framework; wherein the framework is configured to hold a load carrying portable load bearing member and at least a first load receiving portable load bearing member; and wherein the framework is configured so that the first load receiving portable load bearing member may receive at least part of a load from the load carrying portable load bearing member.

In an embodiment, the disclosure is related to an assembly, apparatus or assembly apparatus comprising a framework; wherein the framework is configured to hold a load carrying portable load bearing member, a first load receiving portable load bearing member and a second load receiving portable load bearing member simultaneously; and wherein the framework is configured so that the first load receiving portable load bearing member may receive a first part of a load from the load carrying portable load bearing member and the second load receiving portable load bearing member may receive a second part of the load from the load carrying portable load bearing member following removal of the first load receiving portable load bearing member from the apparatus and/or assembly.

In an embodiment, the disclosure is related to an assembly, apparatus or assembly apparatus comprising (1) an off-loading assembly; and (2) a loading assembly; wherein the off-loading assembly is configured to hold a load carrying portable load bearing member; wherein the loading assembly is configured to hold a first load receiving portable load bearing member and a second load receiving portable load bearing member; and wherein the loading assembly is configured so that the first load receiving portable load bearing member may receive a first part of a load from the load carrying portable load bearing member and the second load receiving portable load bearing member may receive a second part of the load from the load carrying portable load bearing member.

In an embodiment, the disclosure is related to an assembly, apparatus or assembly apparatus comprising (1) an off-loading assembly; and (2) a loading assembly; wherein the off-loading assembly is configured to hold a load carrying portable load bearing member in a set position; wherein the loading assembly is configured to hold a first load receiving portable load bearing member in a set position and hold a second load receiving portable load bearing member in a set position.

Although various stackable items as described above may be used with a system, apparatus, assembly and method of this disclosure, here forward for purpose of illustration stackable items are discussed in terms of stackable bundles of roof shingles provided in one or more rows of bundles of roof shingles.

Figure 1:
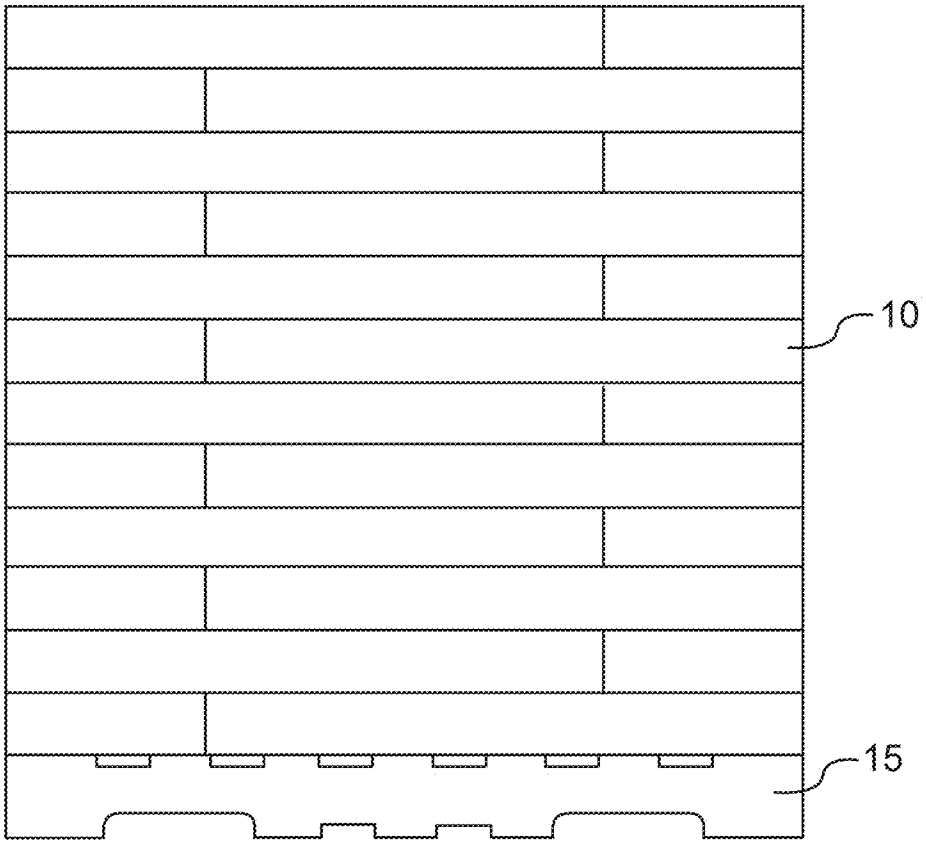
FIG. 1 is a side elevation view depicting rows of bundles of roof shingles stacked in rows on top of an embodiment of a load carrying portable load bearing member.

As shown in FIG. 1, bundles of roof shingles 10 are commonly stacked in rows atop a load carrying portable load bearing member 15 for purposes of storage and/or transport. As understood by the skilled artisan, in commercial settings stacked bundles of roof shingles 10 are commonly carried on wood pallet type load carrying portable load bearing members 15.

Figure 5:
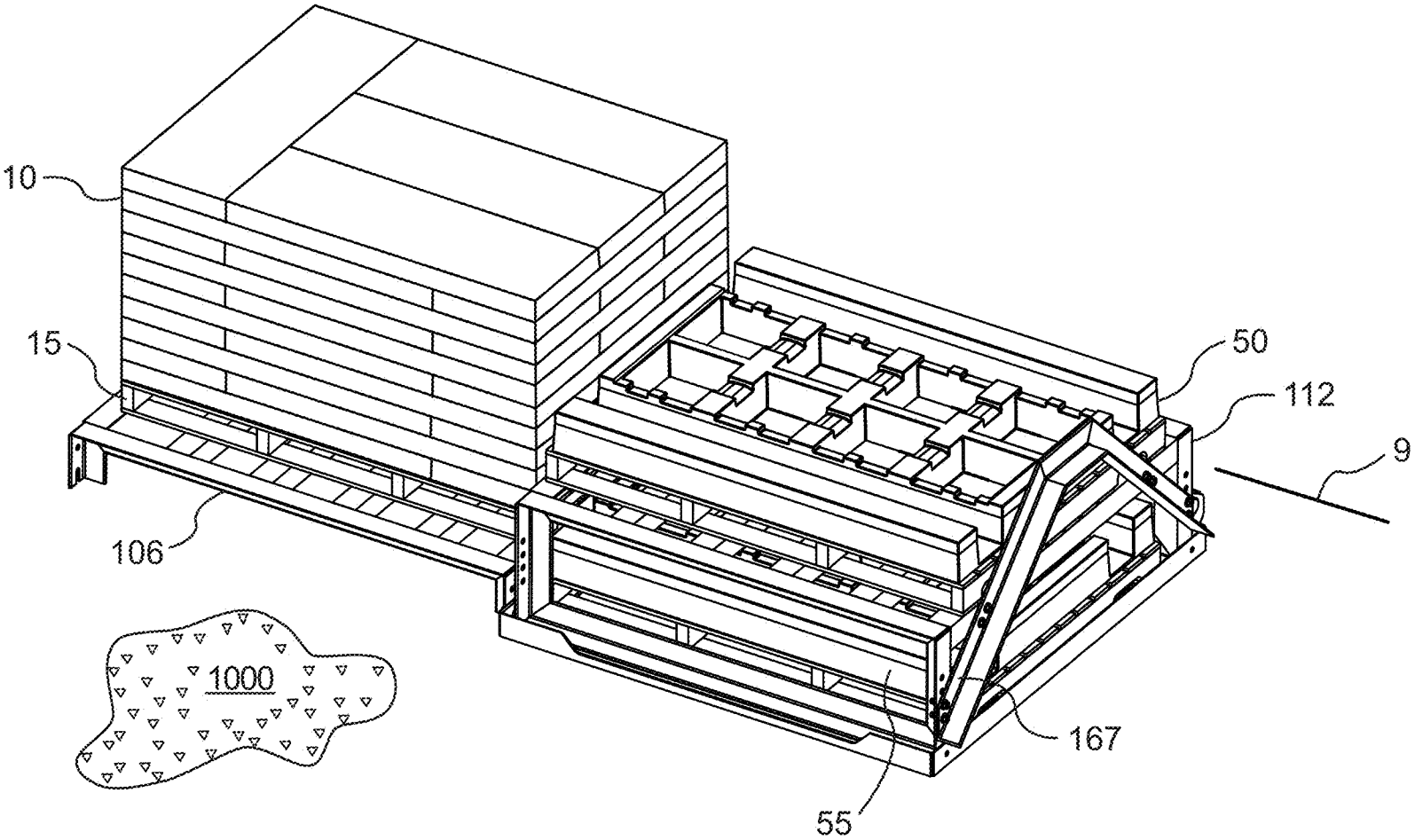
FIG. 5 is a perspective view of the assembly apparatus of FIG. 2 holding a load carrying portable load bearing member with bundles of roof shingles stacked in rows thereon, a first load receiving portable load bearing member and a second load receiving portable load bearing member.

In an embodiment, the disclosure is directed to an apparatus including an off-loading member or off-loading assembly and a loading member or loading assembly configured to optimize the moving or transfer of one or more rows of bundles of roof shingles 10 from a load carrying portable load bearing member 15 onto one or more load receiving portable load bearing members. With reference to FIGS. 2-6, in an embodiment, the assembly apparatus (or "assembly 100") includes an off-loading assembly 102 and a loading assembly 104 adjacent the off-loading assembly 102. The off-loading assembly 102 is configured to hold a load carrying portable load bearing member 15 and the loading assembly 104 is configured to hold two load receiving portable load bearing members 50 and 55 as shown in FIG. 5. As described below, one or more bundles of roof shingles 10 may be directed onto the first load receiving portable load bearing member 50 and thereafter one or more bundles of roof shingles 10 may be directed onto the second load receiving portable load bearing member 55.

Looking at FIG. 2, the off-loading assembly 102 includes a raised platform 106 (or "off-loading platform 106") with an upper planar support surface 108 configured to receive and hold a load carrying portable load bearing member 15 thereon. In an embodiment of operation, the assembly 100 may be located on a planar or substantially planar horizontal surface 1000 whereby the off-loading assembly 102 is configured to hold and maintain the load carrying portable load bearing member 15 in a horizontal level or substantially level orientation. Examples of planar or substantially planar horizontal surface 1000 may include, but are not limited to the ground or earth, a platform surface, an interior floor surface such as an interior warehouse floor and/or the like, an exterior surface such as an exterior warehouse yard surface, a parking lot or other paved surface, and a gravel surface and/or the like.

The loading assembly 104 includes a base 110 and a raised platform 112 (or "loading platform 112") pivotally attached to the base 110. In this embodiment, the base 110 includes a rectangular frame defining an area 111 (see FIG. 6) for receiving and holding a second load receiving portable load bearing member 55 therein on the surface 1000. In another embodiment, the base 110 may include a floor type member 113 configured as a support surface for a second load receiving portable load bearing member 55 (see FIG. 7).

Figure 6:
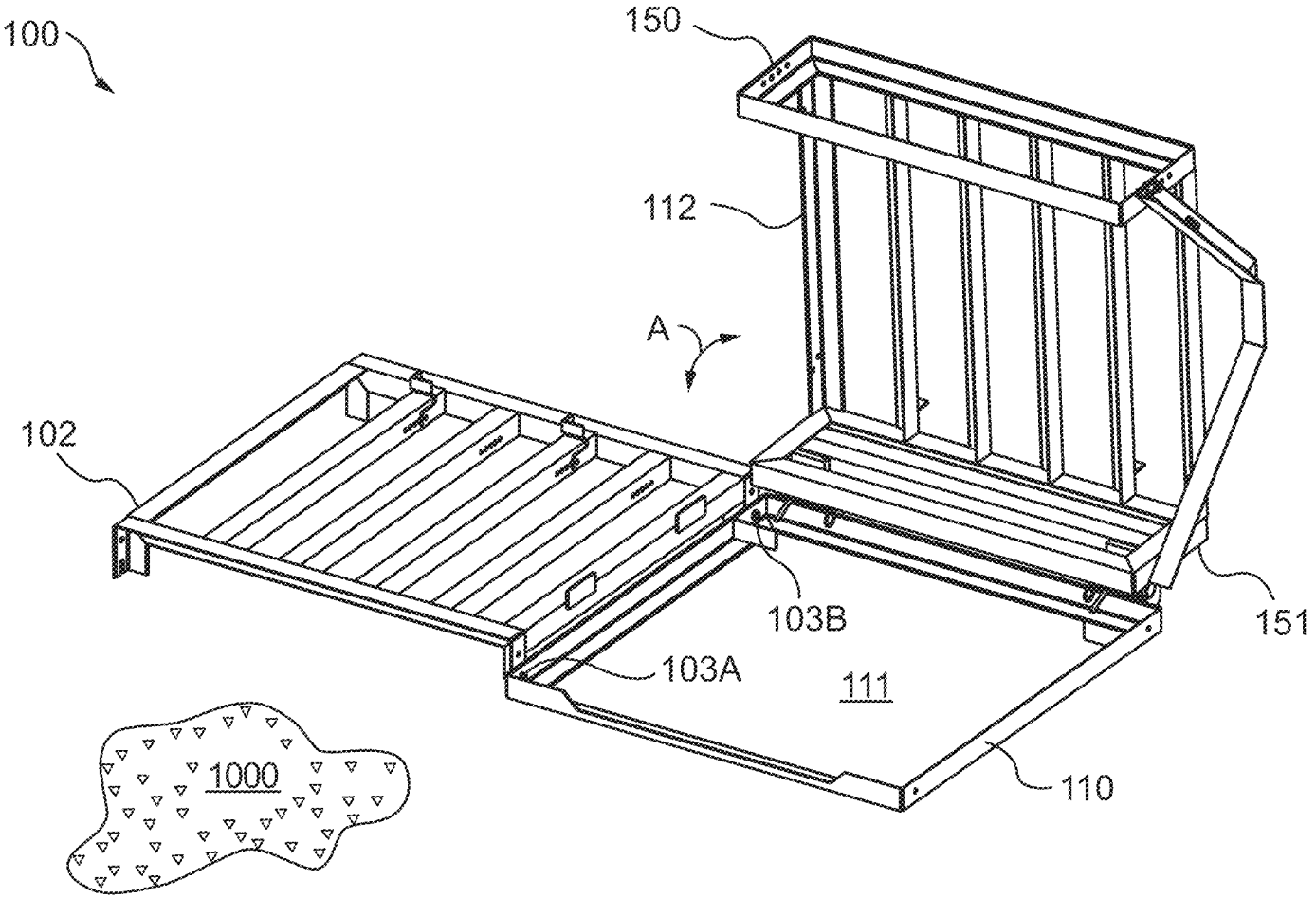
FIG. 6 is a perspective view of the assembly apparatus of FIG. 2 including the loading platform of the assembly apparatus set to a second loading position.
Figure 7:
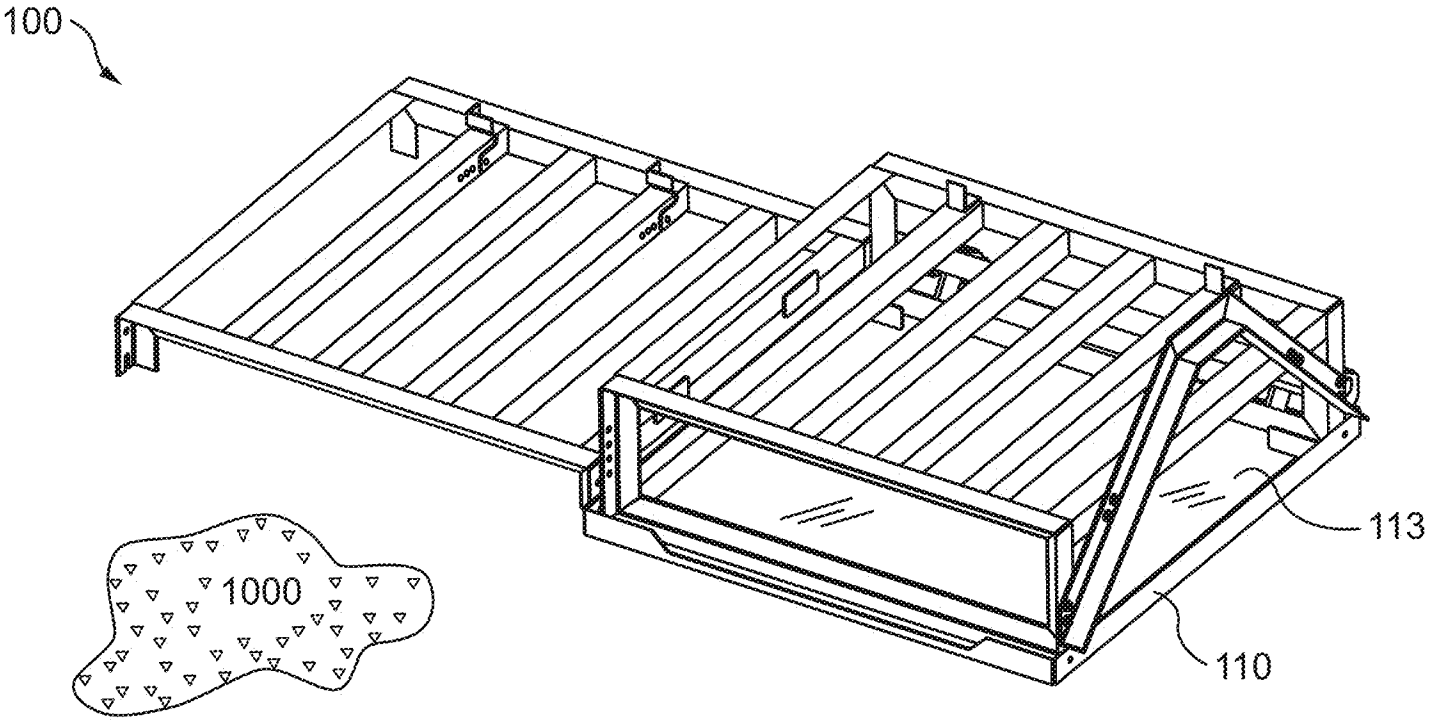
FIG. 7 is a perspective view of another embodiment of an assembly apparatus of this disclosure.

Similar as the off-loading platform 106, in an embodiment the loading platform 112 may include a planar support surface 114 configured to receive and hold a first load receiving portable load bearing member 50 above the second load receiving portable load bearing member 55 when the loading platform 112 is set to a horizontal first position (also referred to herein as a "first loading position" of the loading assembly 104) as shown FIG. 5. As depicted in FIG. 6, in an embodiment the loading platform 112 may be pivotally attached to the base 110 in a manner effective to be directed to a vertical or substantially vertical second position and vice versa (see Directional Arrow A). Herein, a vertical or substantially vertical position of a loading platform 112 may also be referred to as a "second loading position" of the loading assembly 104. As described in detail below, when the loading platform 112 is set to a second loading position, the second load receiving portable load bearing member 55 is exposed in a manner effective to receive bundles of roof shingles 10 directed off from the off-loading assembly 102.

Figure 8:
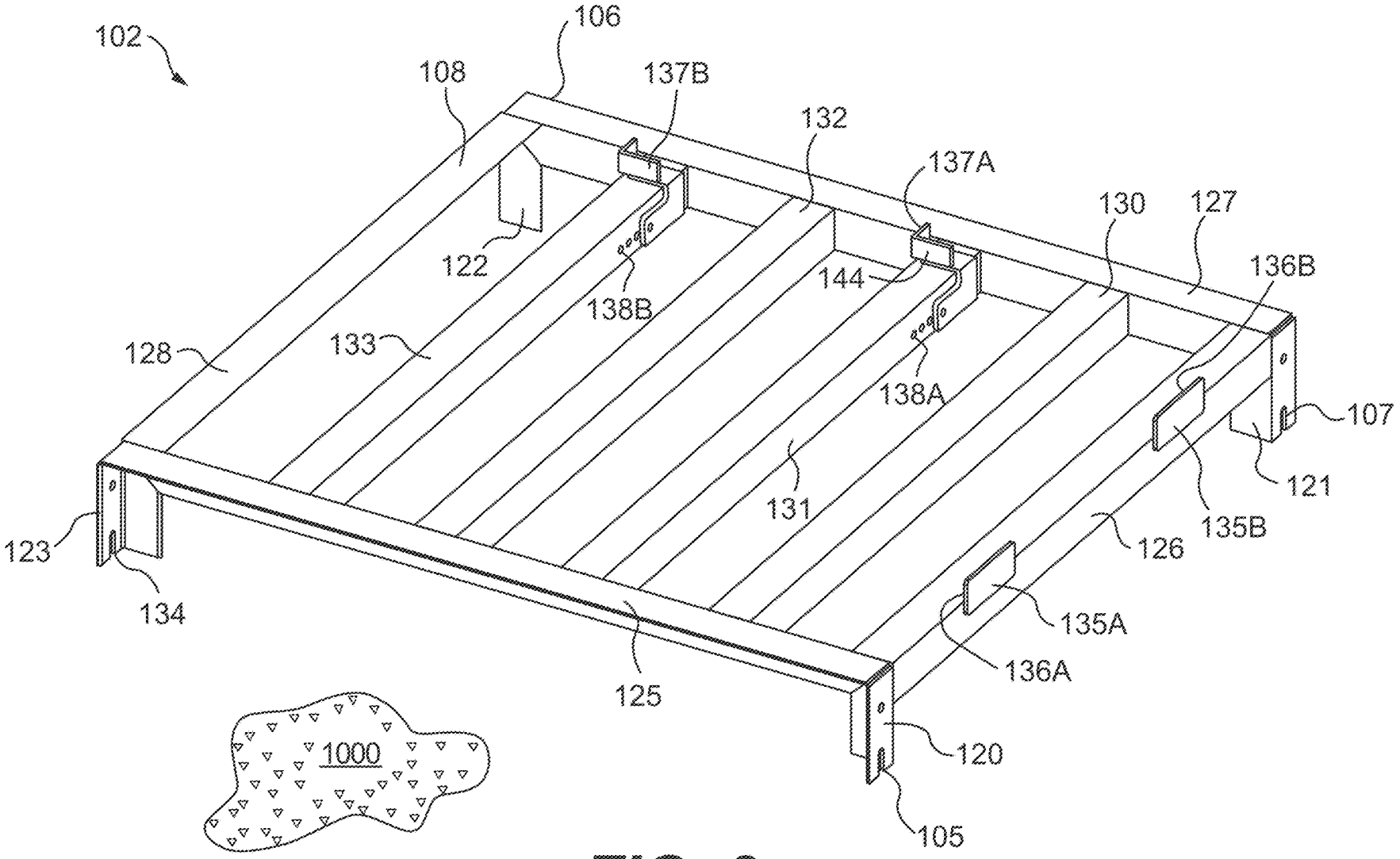
FIG. 8 is a perspective view of an embodiment of an off-loading assembly of the assembly apparatus of FIG. 2.

With reference to FIG. 8, in an embodiment an off-loading platform 106 of an off-loading assembly 102 may be spaced apart from a surface 1000 via vertical supports 120, 121, 122, 123 located at or near each of the four the corners the off-loading platform 106. In an embodiment, an off-loading platform 106 may be provided as an assembled framework having elongated frame members defining the four sides of the off-loading platform 106 (see frame members 125, 126, 127, 128). In an embodiment, an off-loading platform 106 may further comprise one or more elongated parallel rail members 130, 131, 132, 133 disposed between opposing frame members 125 and 127. As shown, the upper surfaces of the frame members 125, 126, 127, 128 and the rail members 130, 131, 132, 133 comprise the upper planar support surface 108 of the off-loading platform 106. In an embodiment, the frame members 126, 128 and the rail members 130, 131, 132, 133 may be set in an equidistant, spaced-apart relation as shown in FIG. 8. In another embodiment, the frame members 126, 128 and the rail members 130, 131, 132, 133 may be set in a non-equidistant arrangement.

Figure 9:
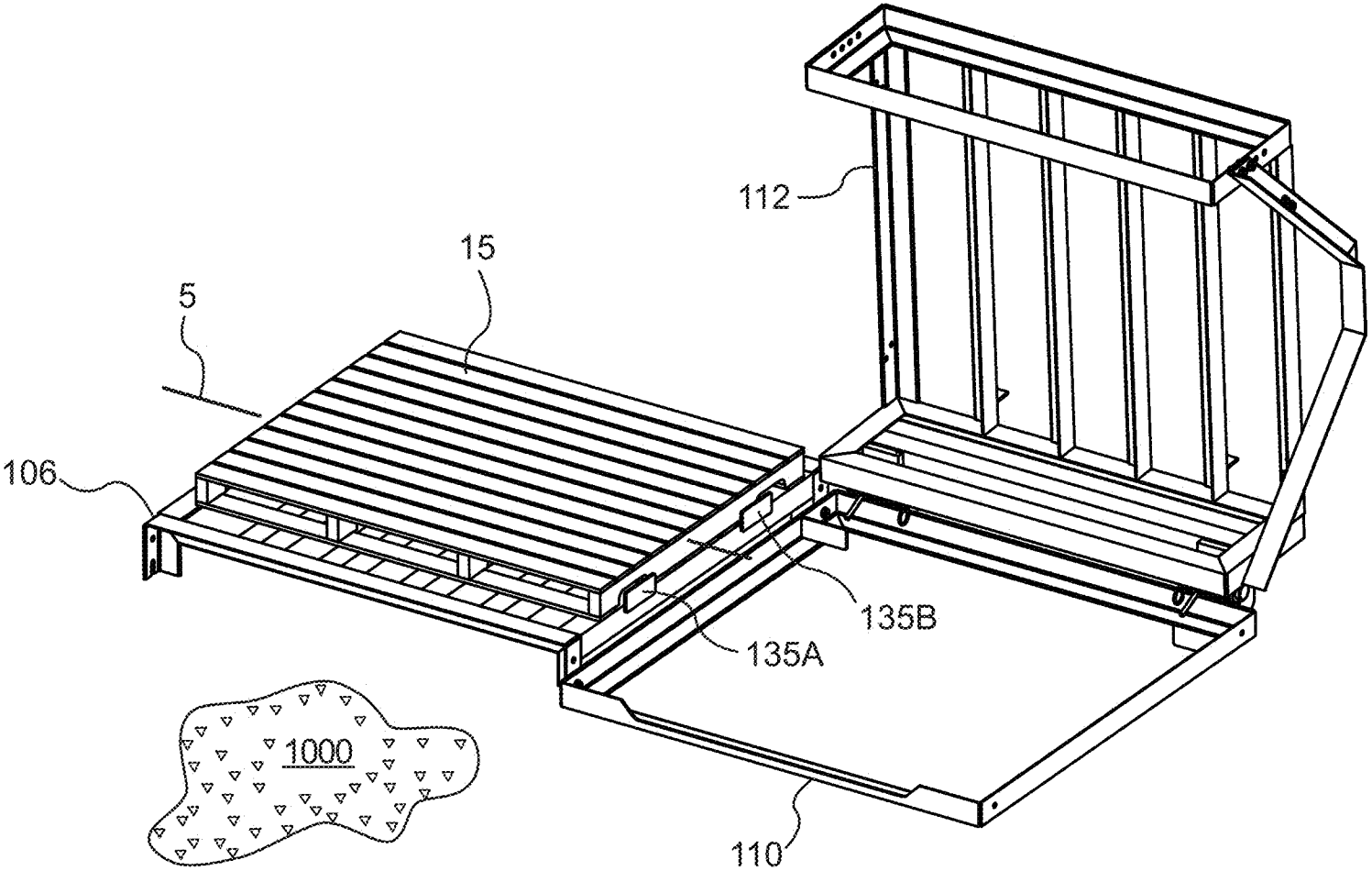
FIG. 9 is a perspective view of the assembly apparatus of FIG. 2 including a loading platform of the assembly apparatus set to a second loading position and a load carrying portable load bearing member located on top of the off-loading assembly of the assembly apparatus.

Referring to FIGS. 8 and 9, an off-loading assembly 102 may also include one or more first stop members 135A and 135B extending up from the upper planar support surface 108 along the right side of the off-loading assembly 102 configured as one or more abutment surfaces for a load carrying portable load bearing member 15 to prevent a load carrying portable load bearing member 15 from contacting the loading assembly 104 when the load carrying portable load bearing member 15 is being placed onto the off-loading assembly 102. In the embodiment as shown, the one or more first stop members 135A, 135B are provided as rectangular type planar members having planar abutment surfaces 136A and 136B extending vertically up from the frame member 126. In another embodiment, the one or more first stop members 135A, 135B may be provided in a different multi-side shape. In another embodiment, the one or more first stop members 135A, 135B may be provided as cylindrical members or another configuration effective to stop a load carrying portable load bearing member 15 from contacting the loading assembly 104.

With further reference to FIG. 8, the off-loading assembly 102 may also comprise one or more adjustable second stop members 137A and 137B configured to be located at one or more set positions to align or substantially align a load carrying portable load bearing member 15 that is set atop the off-loading platform 106 with the loading assembly 104 to ensure that rows of bundles of roof shingles 10 are centered when transferred onto the first and second load receiving portable load bearing members 50 and 55 or otherwise balanced thereon for purposes of storage and/or transport. Because load carrying portable load bearing members 15 of varying dimensions are commonly used in commerce, i.e., varying in widths and lengths, in an embodiment the one or more adjustable second stop members 137A and 137B may be adjusted in a manner effective to ensure that a center line of the load carrying portable load bearing member 15 (see center line 5 in FIG. 9) is aligned or substantially aligned with a center line of the assembly 100, i.e., a center line of the off-loading assembly 102 and the loading assembly 104 (see center line 7 in FIG. 4) during operation.

Figure 10:
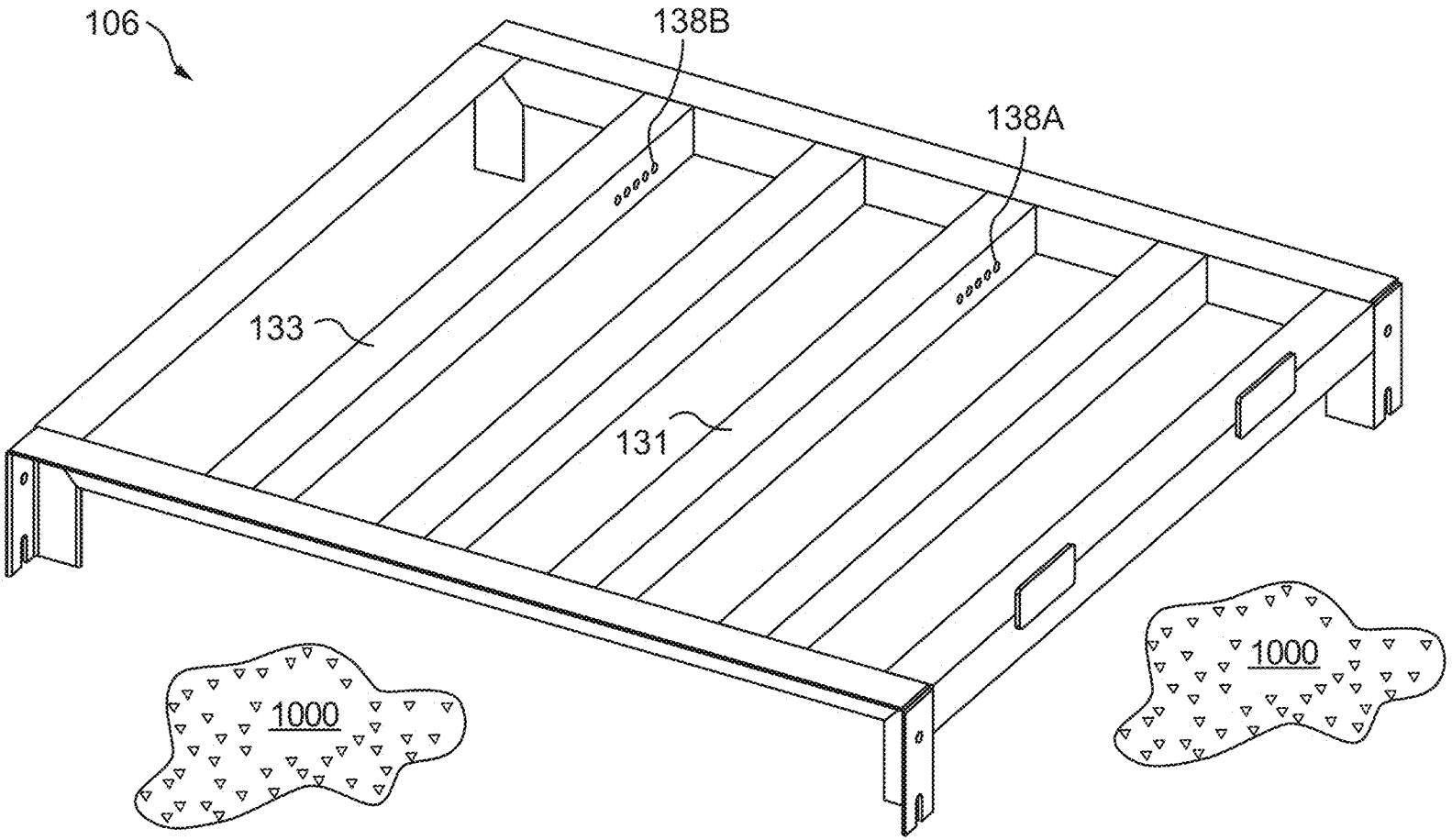
FIG. 10 is a perspective view of an off-loading platform of the assembly apparatus of FIG. 2.

Looking at FIG. 8, the second stop member 137A is releasably attached to rail member 131 and the second stop member 137B is releasably attached to rail member 133. In this embodiment, each of the rail members 131 and 133 includes a set of two or more linearly aligned pin holes 138A, 138B (see also FIG. 10) formed along a side of each of the rail members 131 and 133 and configured as female mating surfaces for the second stop members 137A and 137B. Spacing between individual pin holes of each set of pin holes 138A, 138B may vary according to dimensional variance in the types of load carrying portable load bearing members 15 to be placed on the off-loading platform 106. In an embodiment, spacing between adjacent pin holes of each set of pin holes 138A, 138B may vary from or about 0.635 cm (0.25 inches) to or about 5.08 cm (2.0 inches). In an embodiment, adjacent pin holes of each set of pin holes 138A, 138B may be spaced apart a distance of or about 2.54 cm (1.0 inch).

Figure 11:
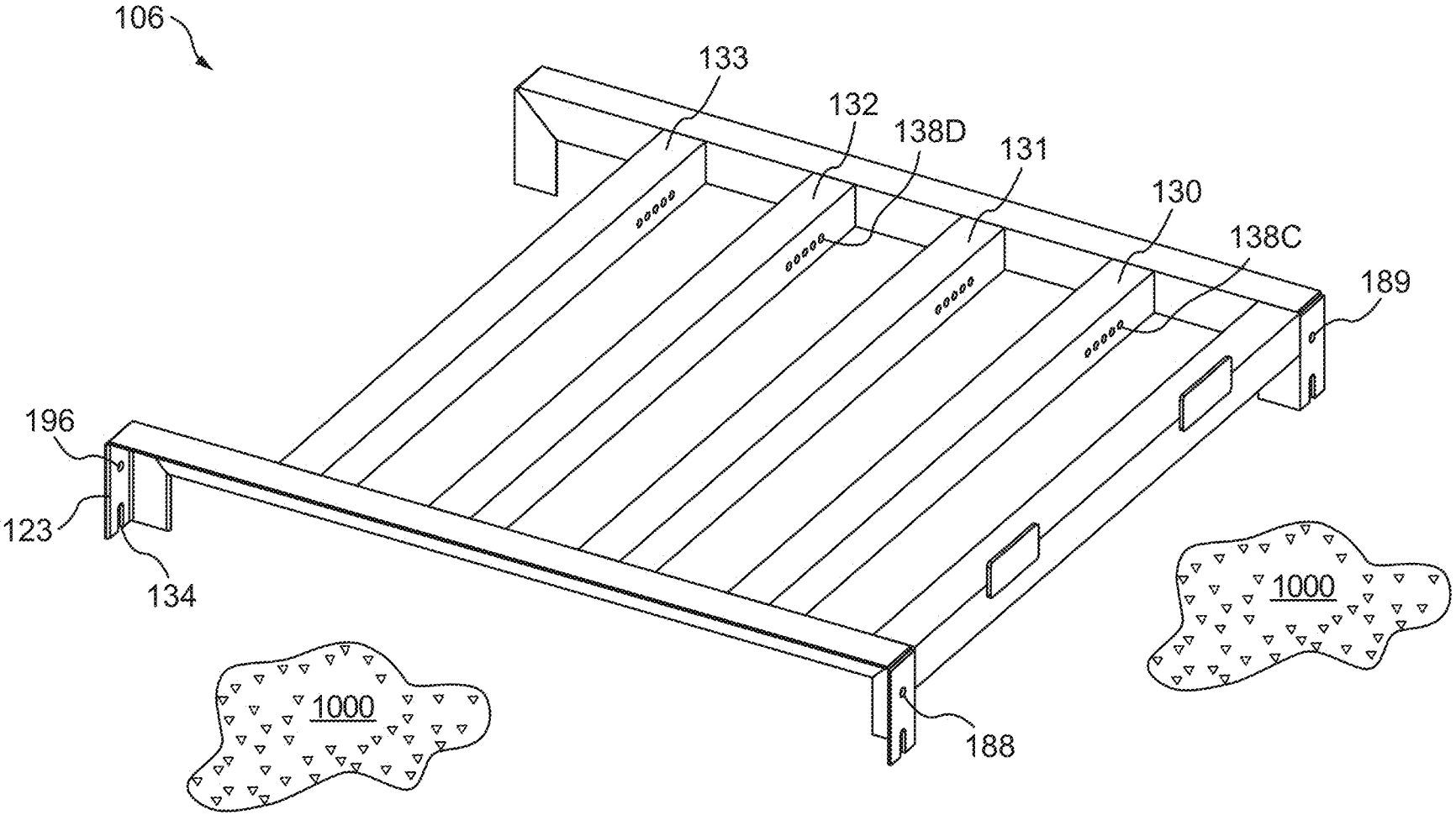
FIG. 11 is a perspective view of an embodiment of an off-loading platform of this disclosure.

As shown in FIG. 11, in an embodiment each of the rail members 130, 131, 132, 133 of an off-loading platform 106 may comprise pin holes (see the set of pin holes 138C of rail member 130 and the set of pin holes 138D of rail member 132) whereby the second stop members 137A and 137B may be used with any of the rail members 130, 131, 132, 133 as desired or as otherwise may be required for one or more particular operations. In another embodiment, one or more additional second stop members may be employed whereby individual second stop members are releasably attached to three or more of the one or more of the rail members 130, 131, 132, 133 during operation. As further shown in FIG. 11, in an embodiment an off-loading platform 106 of an assembly 100 of this disclosure may be provided without a left side frame member 128 allowing for a lifting device 40 to be directed nearer a loading assembly 104 during operation of an assembly 100 of this disclosure as described below. Herein, an off-loading platform 106 provided without a left side frame member 128 may be referred to as an "open frame off-loading platform 106."

Figure 12:
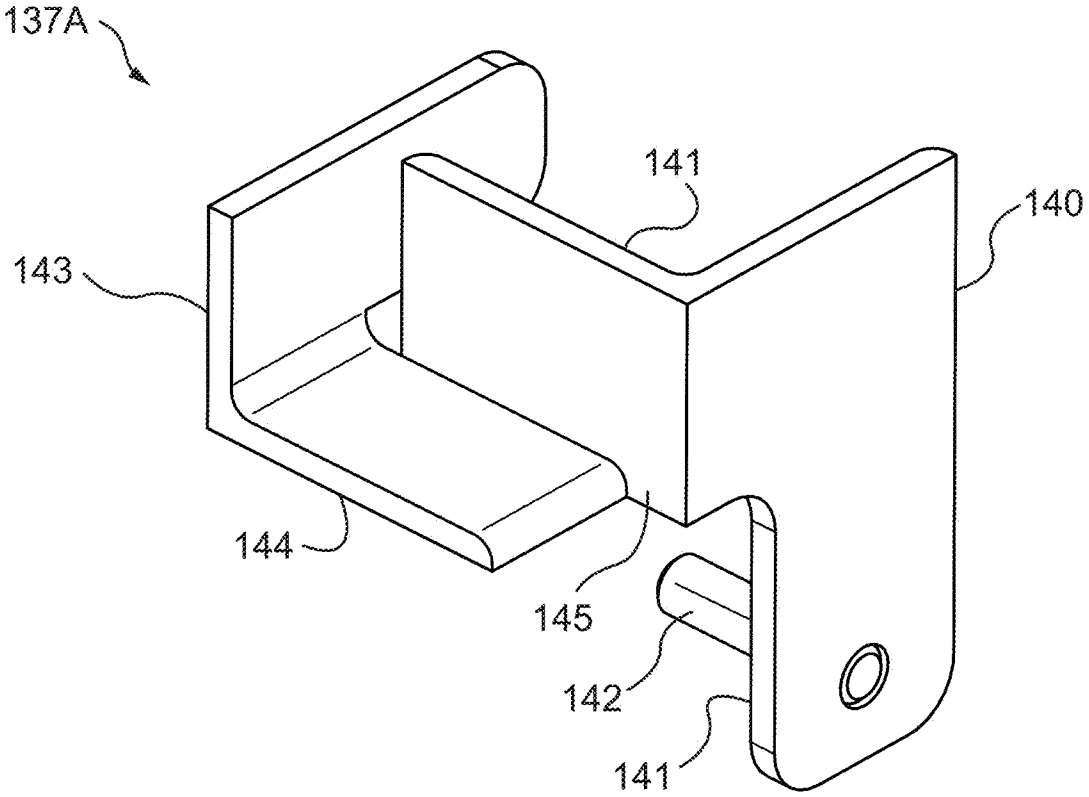
FIG. 12 is a perspective view of an adjustable second stop member of FIG. 8.

Although not limited to a particular configuration, the one or more adjustable second stop members 137A and 137B are suitably configured to remain in a fixed position or in a substantially fixed position when mated to their corresponding rail members. As shown in FIG. 12, in an embodiment each of the second stop members 137A and 137B may include an L-shape bottom portion 140 with an abutment surface 141 configured to engage the upper side and pin hole side of the corresponding rail members. In addition, each bottom portion 140 includes a pin member 142 extending out from the abutment surface 141 that is configured to mate with pin holes 138A, 138B when the bottom portion 140 is set to an abutment position with a corresponding rail member as depicted in FIG. 8.

As shown, in an embodiment each of the second stop members 137A and 137B may further include an upper portion 143 configured to extend up from an upper surface 145 of the bottom portion 140 and the upper planar support surface 108 when the second stop members 137A and 137B are secured to the rail members 131 and 133 as shown in FIG. 8. Suitably, the upper portion 143 of the second stop members 137A and 137B are configured as abutment surfaces to align or substantially align a load carrying portable load bearing member 15 on the upper planar support surface 108 as stated above, i.e., align or substantially align center line 5 with center line 7. In this embodiment, the upper portion 143 includes an L-shape member with a planar abutment surface 144 vertically oriented during operation as shown in FIG. 8. In another embodiment, the abutment surface 144 may be provided as a non-planar surface. In another embodiment, the upper portion 143 may include one or more cylindrical members, a rectangular frame, or other configuration effective to stop and align a load carrying portable load bearing member 15 on the upper planar support surface 108. In another embodiment, one or more of the second stop members 137A and 137B may include an L-shape bottom portion 140 with an aperture in place of a pin member 142 that corresponds to pin holes 138A, 138B, 138C, 138D for receiving a locking pin and/or the like there through.

Figure 13:
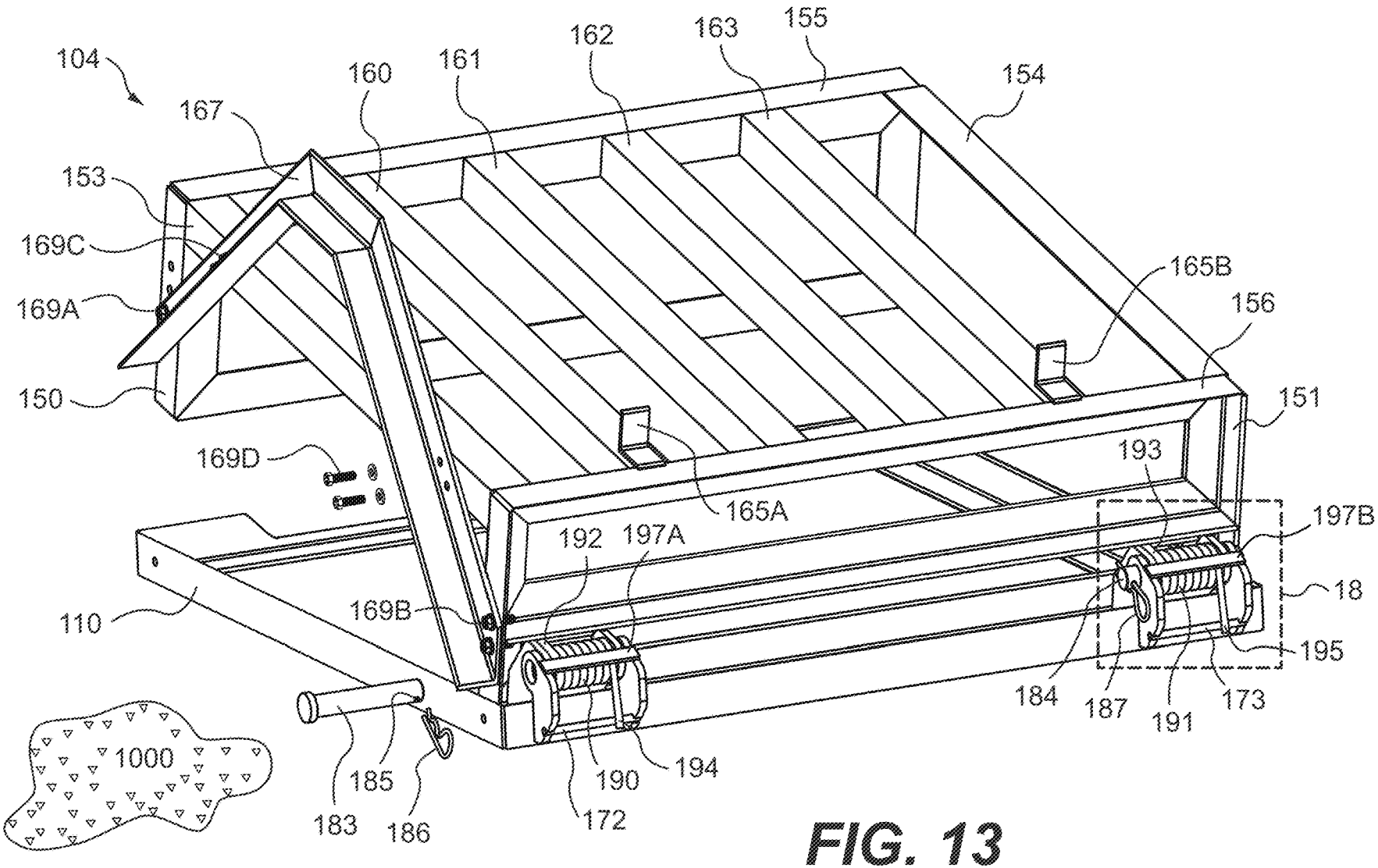
FIG. 13 is a perspective view of a loading assembly of the assembly apparatus of FIG. 2.

With particular reference to FIGS. 2, 6 and 13, the loading assembly 104 is provided as an assembled framework having elongated frame members including a rectangular front frame assembly 150 defining a front side of the loading platform 112, a rectangular back frame assembly 151 defining a back side of the loading platform 112, and frame members 153 and 154 disposed between the front and back frame assemblies 150 and 151 defining the right side and the left side of the loading platform 112 as shown. In an embodiment, when the loading platform 112 is set at a first loading position, then the front frame assembly 150 and the back frame assembly 151 are suitably configured to space the loading platform 112 apart from the base 110 at a height greater than the height of the off-loading platform 106. In other words, the height of the loading platform 112 is greater than the height of the off-loading platform 106 whereby the upper planar support surface 108 is disposed along an altitude less than an altitude of the planar support surface 114 (see FIG. 3).

Referring to FIG. 13, in an embodiment an upper surface 155 of the front frame assembly 150 comprises a forward most part of the support surface 114 and an upper surface 156 of the back frame assembly 151 comprises a rearward most part of the support surface 114. In an embodiment as shown, the support surface 114 may also comprise one or more elongated parallel rail members 160, 161, 162, 163 disposed between the front and back frame assemblies 150 and 151.

With further reference to FIG. 13, a loading assembly 104 may include one or more third stop members 165A and 165B extending up from the support surface 114 configured as one or more abutment surfaces to align or substantially align a first load receiving portable load bearing member 50 set atop the support surface 114 with the off-loading platform 106 and a load carrying portable load bearing member 15 thereon to ensure that one or more rows of bundles of roof shingles 10 are transferred centered or substantially centered from the load carrying portable load bearing member 15 onto the first load receiving portable load bearing member 50. Suitably, the one or more third stop members 165A and 165B are located at or near a back side of the support surface 114 according to the dimensions of one or more first load receiving portable load bearing members 50 to be used with the assembly 100. In the embodiment of FIG. 13, the third stop member 165A includes an L-shape member secured to both the rail member 160 and the upper surface 156 of the back frame assembly 151 and the third stop member 165B includes a like L-shape member secured to both the rail member 163 and the upper surface 156 of the back frame assembly 151. In this embodiment, in order to align or substantially align a center line 9 of the first load receiving portable load bearing member 50 with center line 5 of the load carrying portable load bearing member 15 and center line 7 of the assembly 100 as shown in FIG. 5, the planar abutment surfaces of the third stop members 165A and 165B are suitably set in planar alignment (see planar abutment surface 166 of third stop member 165B in FIG. 2). In another embodiment, the one or more third stop members 165A and 165B may be provided as cylindrical members or other configuration effective to align a first load receiving portable load bearing member 50 atop the loading platform 112.

In an embodiment a loading assembly 104 may also include one or more fourth stop members 167 disposed along the right side of the loading assembly 104. Suitably, the one or more fourth stop members 167 are configured as one or more abutment surfaces to prevent (1) a first load receiving portable load bearing member 50 and (2) one or more rows of bundles of roof shingles 10 from being directed off from the first load receiving portable load bearing member 50 when one or more rows of bundles of roof shingles 10 are being directed off from a load carrying portable load bearing member 15 onto the first load receiving portable load bearing member 50 during operation of the assembly 100. Suitably, the one or more fourth stop members 167 are disposed along the right side of the loading assembly 104 in a manner effective to prevent a first load receiving portable load bearing member 50 from being rotated atop the support surface 114 when one or more rows of bundles of roof shingles 10 are being directed off from a load carrying portable load bearing member 15 onto the first load receiving portable load bearing member 50. Accordingly, at least part of the one or more fourth stop members 167 are located to the left and right of the center line 7 of the assembly 100 a distance effective to prevent rotation of the first load receiving portable load bearing member 50 during operation.

Figure 14:
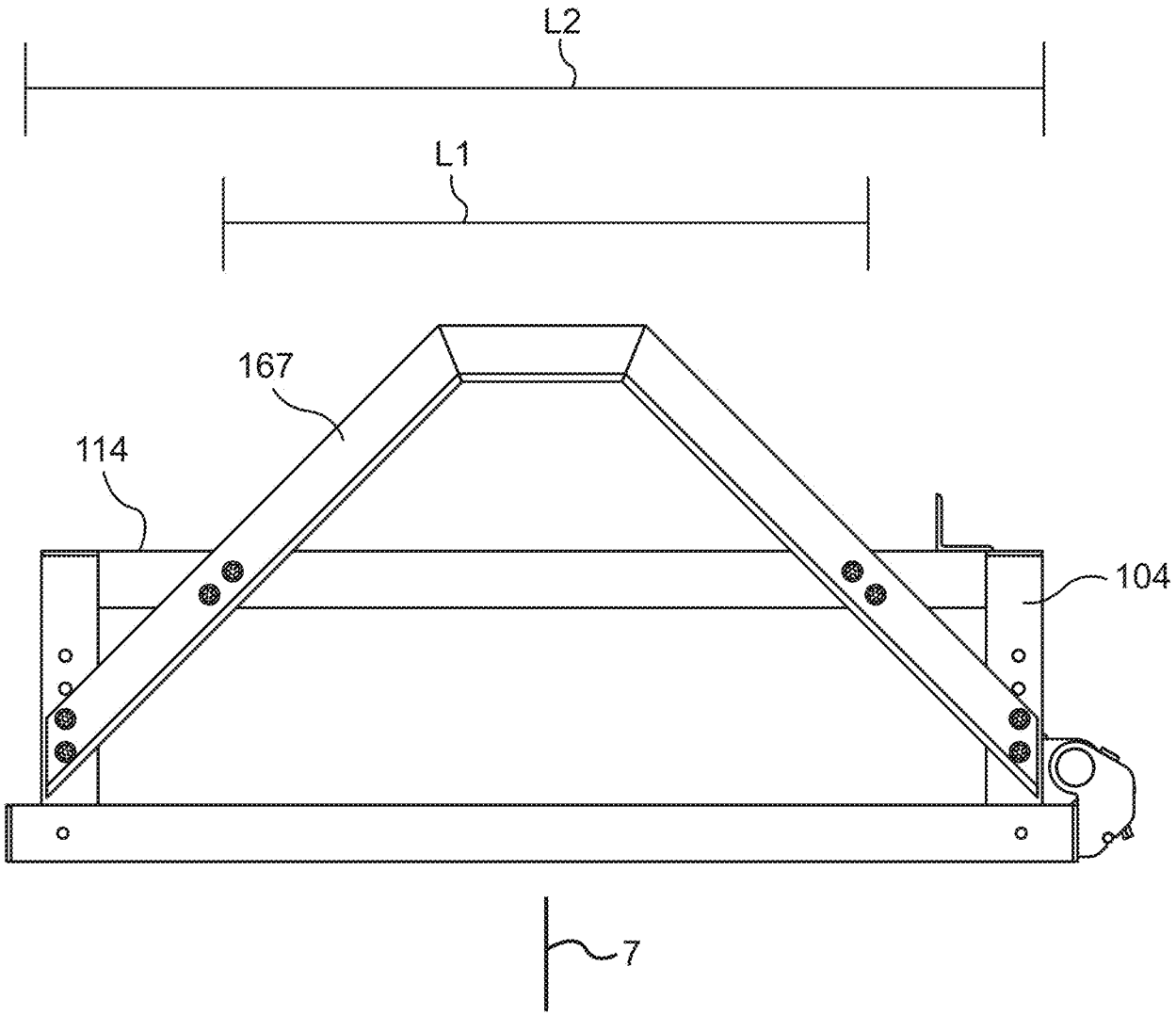
FIG. 14 is a side elevation view of the loading assembly of FIG. 13.

As shown in FIG. 13, in an embodiment the one or more fourth stop members 167 may include a one-piece stop member 167 disposed along the right side of the loading assembly 104 that may be releasably attached to front and back frame assemblies 150 and 151 (see fasteners 169A and 169B) and the frame member 153 (see fasteners 169C and 169D) in a manner effective to secure the one-piece stop member 167 in a vertical or substantially vertical position. Fasteners 169A, 169B, 169C and 169D may include, but are not limited to threaded fasteners including screws, bolts, nails, and/or the like, and combinations thereof. Looking at FIG. 14, at a side elevation view a one-piece stop member 167 may include a truncated triangle type configuration centered along the center line 7 of the assembly 100 and extending up providing an abutment surface above the support surface 114 of a length L1 covering a distance along the support surface 114 of or about seventy (70.0) percent of the total length L2 of the right side of the support surface 114.

Figure 15:
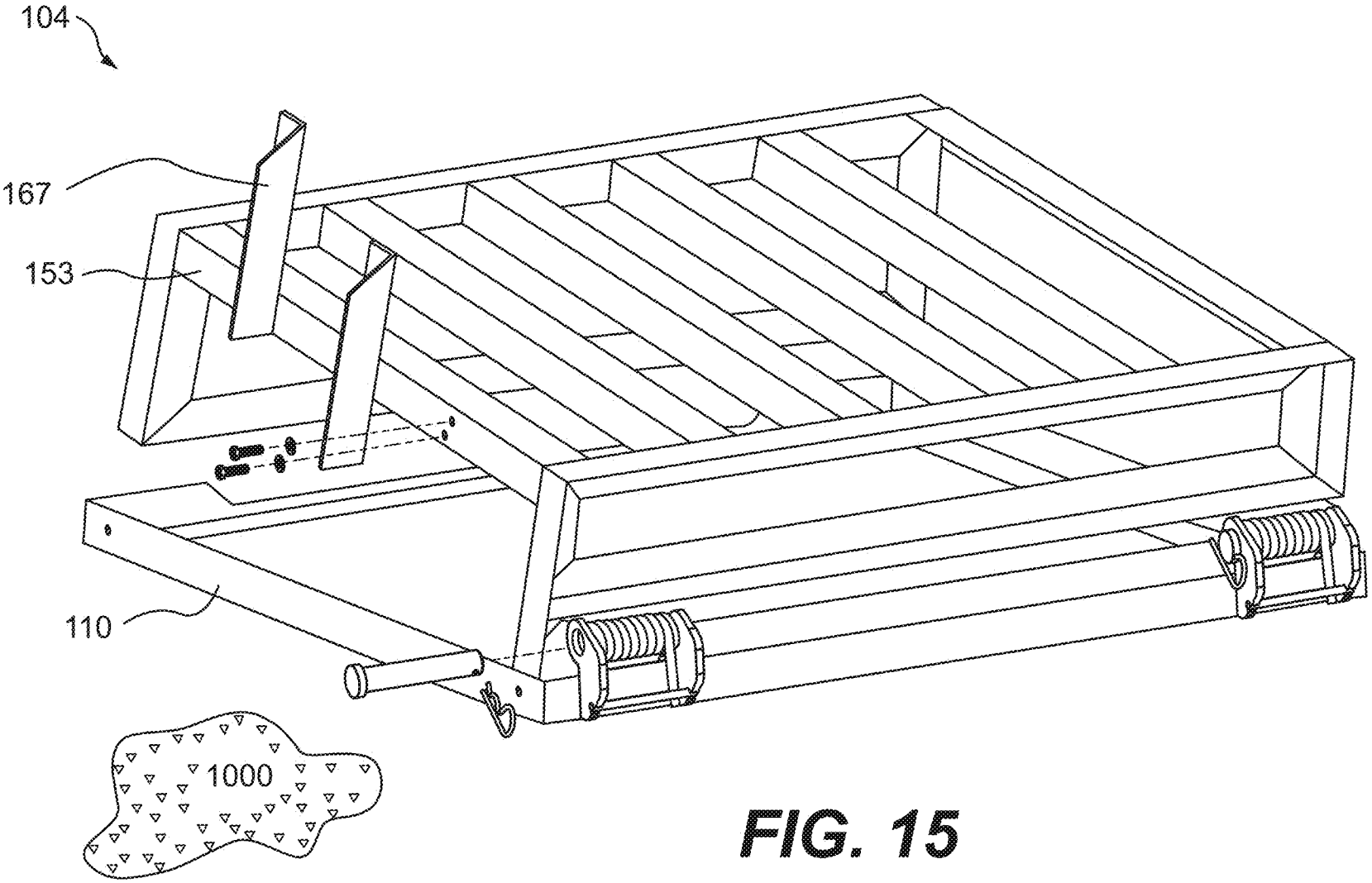
FIG. 15 is a perspective view of another embodiment of a loading assembly of this disclosure.

In another embodiment, the one or more fourth stop members 167 may be provided in one or more other shapes configured to extend up above the support surface 114 as abutment surfaces. In a non-limiting example, the one or more fourth stop members 167 may comprise one or more vertical post type members releasably attachable to frame member 153 as shown in FIG. 15. Although the one or more fourth stop members 167 are shown herein as releasably attachable members, in another embodiment the one or more fourth stop members 167 may be provided as a permanent members of the loading assembly 104.

Figure 16:
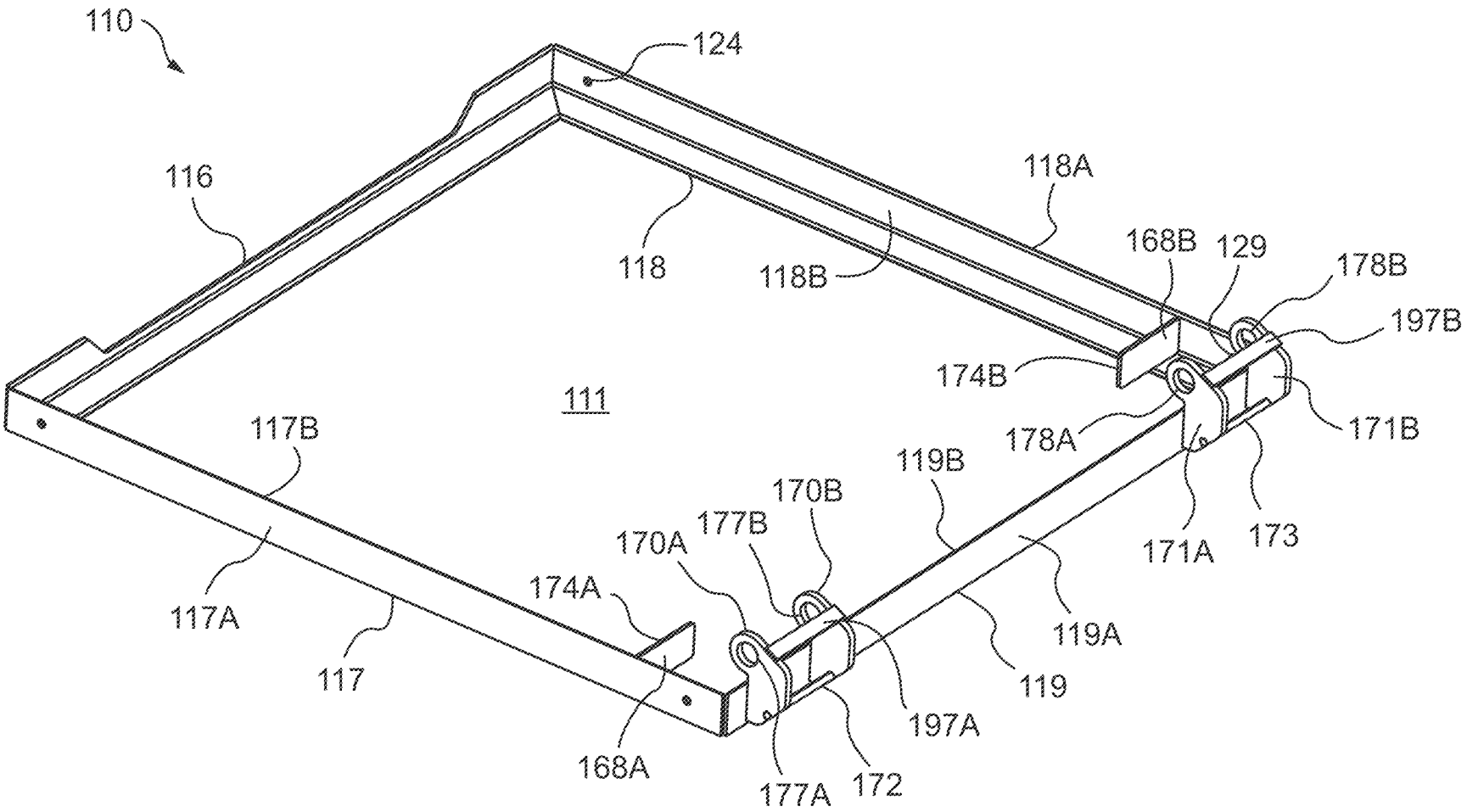
FIG. 16 is a perspective view of a base of a loading assembly of the assembly apparatus of FIG. 2.

With reference to FIG. 16, in an embodiment the base 110 of a loading assembly 104 may include a rectangular frame configuration including a front side frame member 116, a right side frame member 117, a left side frame member 118 and a back side frame member 119. In an embodiment as shown, at least the right and left side frame members 117 and 118 and the back side frame member 119 may have raised outer sidewalls (see outer sidewalls 117A, 118A, and 119A) providing operable surface structure as described below. As stated above, the base 110 defines an area 111 for receiving and holding a second load receiving portable load bearing member 55 therein. Accordingly, in an embodiment the base 110 may include one or more fifth stop members 168A and 168B configured as one or more abutment surfaces to position a second load receiving portable load bearing member 55 within the area 111 to align the second load receiving portable load bearing member 55 with a load carrying portable load bearing member 15 on the loading assembly 104 to ensure that rows of bundles of roof shingles 10 are transferred centered from the load carrying portable load bearing member 15 onto the second load receiving portable load bearing member 55. In this embodiment, the one or more fifth stop members 168A and 168B are provided as rectangular planar members having planar abutment surfaces 174A and 174B extending out horizontally from opposing raised inner sidewalls 117B and 118B of the right and left side frame members 117 and 118. In another embodiment, the one or more fifth stop members 168A and 168B may be provided as cylindrical members or other configuration effective to position a second load receiving portable load bearing member 55 within the area 111 as desired.

As depicted in FIG. 16, the one or more fifth stop members 168A and 168B are spaced apart from an inner sidewall 119B of the back side frame member 119 a distance effective to provide clearance for the loading platform 112 as the loading platform 112 is pivoted between a first loading position and a second loading position as mentioned above. To promote desired pivot action, in an embodiment the loading platform 112 may be pivotally attached to the base 110 via one or more hinges or one or more hinge assemblies. In an embodiment, the loading platform 112 may be pivotally attached to the base 110 via one or more biased hinge assemblies 157 and 158 (see FIG. 4). For example, in an embodiment the base 110 may include a first pair of base lugs 170A and 170B with lug holes 177A and 177B forming part of a first hinge assembly 157 and a second pair of base lugs 171A and 171B with lug holes 178A and 178B spaced apart along the outer sidewall 119A of the back side frame member 119 forming part of a second hinge assembly 158 as shown in FIG. 16. When employed as biased hinge assemblies, the first pair of base lugs 170A and 170B and a second pair of base lugs 171A and 171B may also include a crossbar configured as a point of attachment for one or more biasing members as described below (see crossbar 172 disposed between base lugs 170A and 170B and crossbar 173 disposed between base lugs 171A and 171B).

Figure 17:
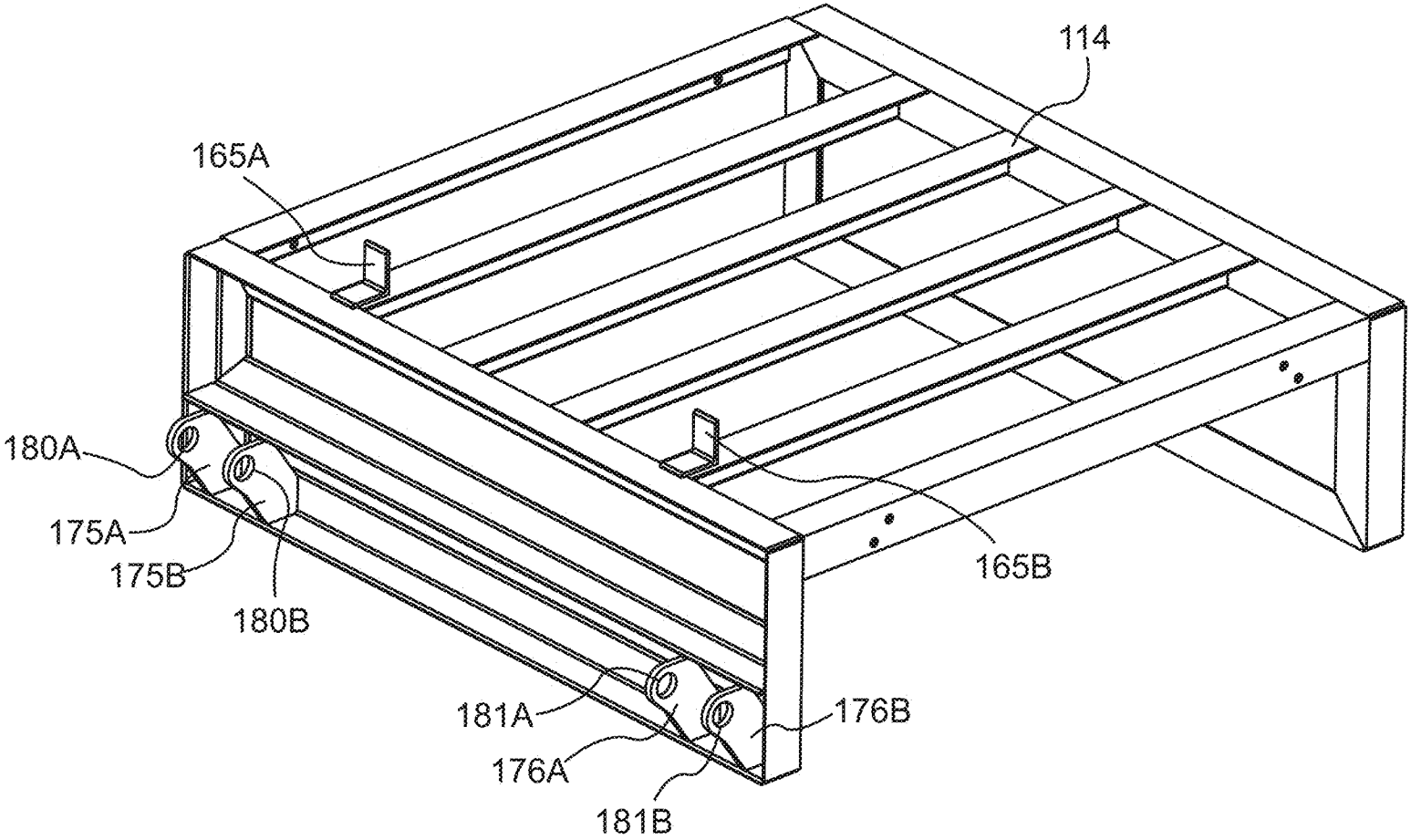
FIG. 17 is a perspective view of part of the loading platform of the assembly apparatus of FIG. 2.

With particular reference to FIG. 17, a loading platform 112 for use with the base 110 of FIG. 16 may comprise a first pair of pivot lugs 175A and 175B with lug holes 180A and 180B and a second pair of pivot lugs 176A and 176B with lug holes 181A and 181B spaced apart along the back frame assembly 151 as shown. In this embodiment, the first pair of pivot lugs 175A and 175B correspond to the first pair of base lugs 170A and 170B and the second pair of pivot lugs 176A and 176B correspond to the second pair of base lugs 171A and 171B as shown in FIG. 13. Looking at FIG. 13, when assembled lug holes 180A and 180B are concentrically aligned with lug holes 177A and 177B for receiving a pivot pin 183 there through and lug holes 181A and 181B are concentrically aligned with lug holes lug holes 178A and 178B for receiving a pivot pin 184 there through. As shown in FIG. 13, each of the pivot pins 183 and 184 has a through hole (see through hole 185) for receiving a removable fasteners 186, 187 there through for maintaining the fasteners 183 and 184 in mated operable positions (see the mated operable position of fastener 184 as secured by locking pin 187). Suitable fasteners 186, 187 for use herein may include locking pins such as dowel pins, cotter pins, and combinations thereof. A suitable cotter pin may include, but is not limited to a R-type cotter pin as shown in FIG. 13.

With further reference to FIG. 13, each of the hinge assemblies 157 and 158 also includes a coiled torsion spring 190 and 191 (hereafter "spring 190" and "spring 191") configured to bias the loading platform 112 toward a second loading position. As shown, each of the springs 190 and 191 defines a through hole for receiving a corresponding pivot pin 183 or 184 there through when each of the springs 190 is 191 is disposed between its corresponding base lugs and pivot lugs, e.g., when spring 190 is concentrically aligned with lug holes 177A and 177B and lug holes 180A and 180B and when spring 191 is concentrically aligned with lug holes 178A and 178B and lug holes 181A and 181B. In this embodiment, each of the springs 190 and 191 includes a first free end 192 and 193 releasably attachable to the back frame assembly 151. For example, each of the first free ends 192 and 193 may include a non-linear configuration, e.g., an L-shape or hook shape, for mating with an aperture (not shown) to securely fasten each of the springs 190 and 191 to the back frame assembly 151. Each of the springs 190 is 191 may also have a free second end 194 and 195 releasably attachable to a corresponding crossbar 172 and 173. Similar as the first free ends 192 and 193, each of the second free ends 194 and 195 may include a non-linear configuration such as a hook shape bearing upward against its corresponding crossbar 172 or 173 during operation of the assembly 100 as shown in FIG. 13. Herein, the coil tension of springs 190 and 191 may vary depending on a particular application of the assembly 100 and/or according to the weight of the loading platform 112.

Figure 18:
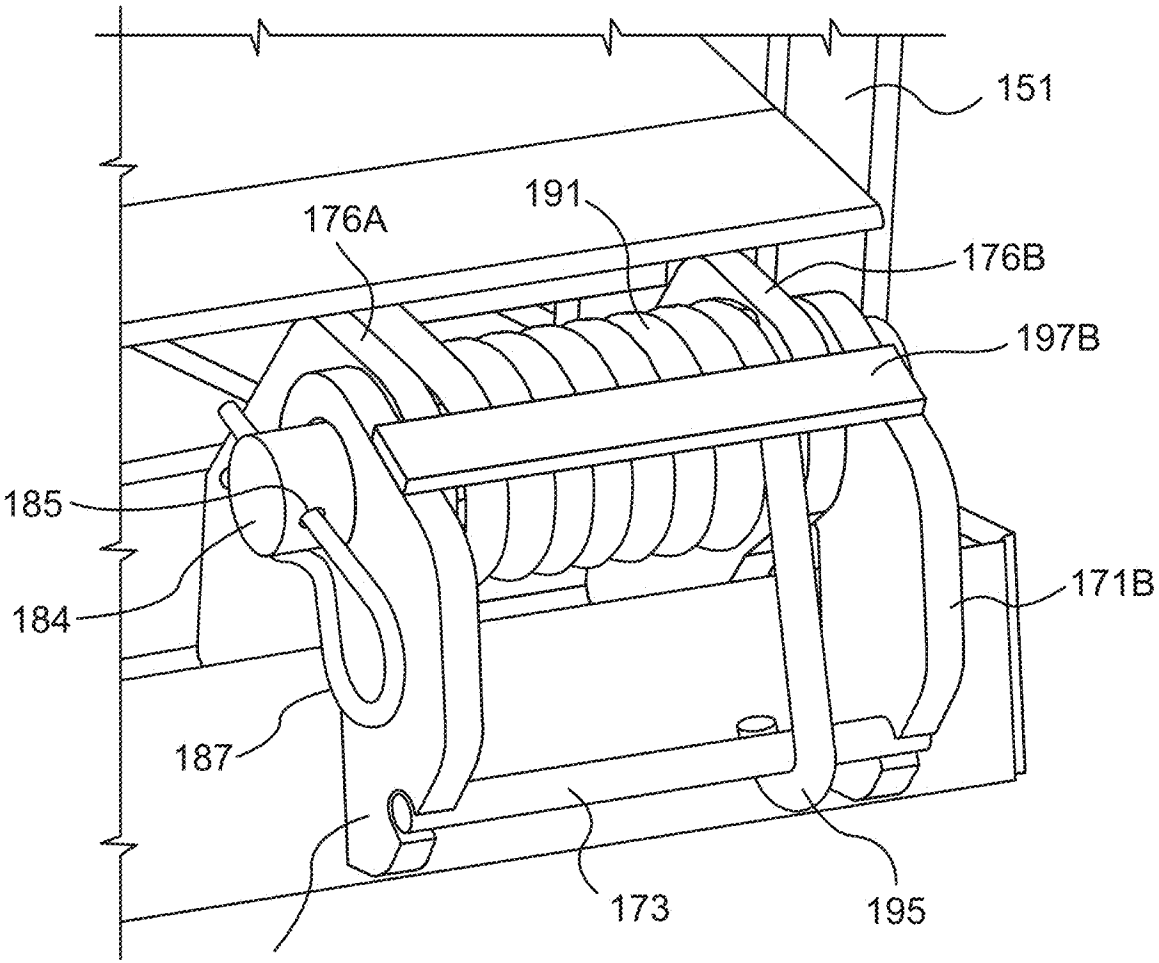
FIG. 18 is a detailed view of a second hinge assembly of a loading assembly of FIG. 13.

To limit the angular travel of the loading platform 112 and hold the loading platform 112 in a second loading position as shown in FIG. 6, first and second hinge assemblies 157 and 158 as shown in FIG. 13 may further include one or more sixth stop members configured as abutment surfaces for the first pair of pivot lugs 175A and 175B and the second pair of pivot lugs 176A and 176B. As shown in FIGS. 13 and 16 a first hinge assembly may include one or more crossbars 197A disposed between the first pair of base lugs 170A and 170B and a second hinge assembly may include one or more crossbars 197B disposed between the second pair of base lugs 171A and 171B (see also FIG. 18).

Figure 19:
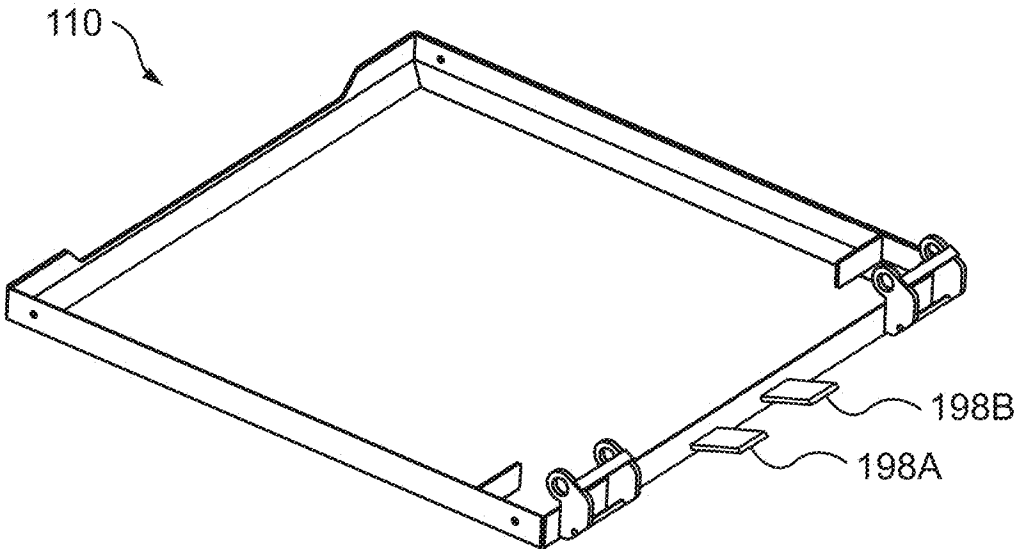
FIG. 19 is a perspective view of an embodiment of a base of a loading assembly of this disclosure.
Figure 20:
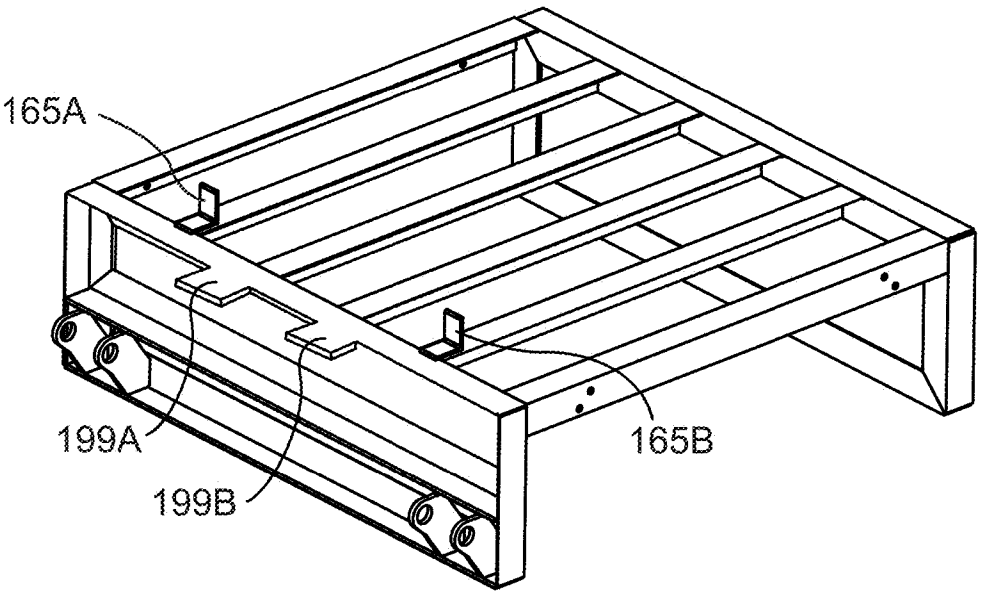
FIG. 20 is a perspective view of an embodiment of part of a loading platform of this disclosure.

In another embodiment, a base 110 may include one or more seventh stop members in addition to or in place of crossbars 197A and 197B for stopping and holding a loading platform 112 in a second loading position (see stop members 198A and 198B extending out from the base 110 in FIG. 19). In another embodiment, a loading platform 112 may include one or more eighth stop members in addition to or in place of crossbars 197A and 197B and/or stop members 198A and 198B configured to contact the surface 1000 to hold a loading platform 112 in a second loading position (see stop members 199A and 199B extending out from the loading platform 112 in FIG. 20). In another embodiment of an assembly 100, a loading platform 112 may be slid or rolled along a guide track and/or the like of the assembly 100 between a first loading position and a second loading position of the loading platform 112. In another embodiment of an assembly 100, a loading platform 112 may be removable from the assembly 100 defining a second loading position of the loading platform 112.

Looking again at FIGS. 2-6, the off-loading assembly 102 may be releasably fastened to the loading assembly 104 during operation. In an embodiment, the off-loading assembly 102 may be releasably fastened to the loading assembly 104 via one or more fasteners 103A and 103B. In such embodiment, the off-loading assembly 102 and the loading assembly 104 suitably include corresponding apertures for receiving fasteners 103A and 103B there through to maintain desired alignment of the assembly 100 during operation. As shown in FIG. 8, the vertical supports 120 and 121 may include one or more apertures or openings 105 and 107 for receiving fasteners 103A and 103B there through (also see apertures 188 and 189 in FIG. 11). Likewise, the base 110 may include one or more apertures (see apertures 124 and 129) disposed along the left side frame member 118 corresponding to apertures or openings 105 and 107 and/or apertures 188 and 189 for receiving fasteners 103A and 103B there through (see FIG. 16). Fasteners 103A and 103B may include, but are not limited to threaded fasteners including screws, bolts, nails, and/or the like, and combinations thereof. In another embodiment, the off-loading assembly 102 may be releasably fastened to the loading assembly 104 via rope, cord, wire, self-locking cable ties, bungee connectors, clamps, and combinations thereof. For purposes of this disclosure, when the off-loading assembly 102 is assembled with the loading assembly 104 as shown in FIGS. 2-6, the right side (see frame member 153) of the loading assembly 104 may also be referred to as the back side of the assembly 100.

In another embodiment, the off-loading assembly 102 may be permanently fastened to the loading assembly 104 via one or more rivets, one or more welds, one or more adhesives, and combinations thereof. In another embodiment, the off-loading assembly 102 and the loading assembly 104 may be provided as a one-piece construction. In another embodiment, the off-loading assembly 102 may be set adjacent the loading assembly 104 as two independent assemblies during operation. In another embodiment, the off-loading assembly 102 and/or the loading assembly 104 may be fastened to the surface 1000 via one or more fasteners including, but not limited to wedge anchors, concrete screws, anchor bolts, adhesive anchors, hammer drive pin anchors, sleeve anchors, nailon pin drive anchors, split-drive anchors, and combinations thereof.

With reference now to FIG. 21, although one or more bundles of roof shingles 10 may be directed from a load carrying portable load bearing member 15 onto a first load receiving portable load bearing member 50 and a second load receiving portable load bearing member 55 as may be desired, in an embodiment a lifting device 40 (or "fork lifting device 40") may be utilized to perform such operation. For example, in an embodiment forks 42 (or fork tines 42) of a lifting device 40 may be used as contact surfaces to direct one or more bundles of roof shingles 10 off from a load carrying portable load bearing member 15. As shown in FIG. 21, in an embodiment a push member 45 may be attached to the forks 42 and used as a contact to direct one or more bundles of roof shingles 10 off from a load carrying portable load bearing member 15.

Referring to FIGS. 22 and 23, in an embodiment a push member 45 may include a rectangular frame comprising a left side frame member 60, a right side frame member 61, a first upper crossbar 63, a second upper crossbar 64, a lower crossbar 65 and a push bar 62. In this embodiment, the first upper crossbar 63 and the second upper crossbar 64 are spaced apart from the lower crossbar 65 by the left side frame member 60 and the right side frame member 61 providing an opening 68 as shown in FIG. 23. In this embodiment, the first upper crossbar 63, the second upper crossbar 64, the lower crossbar 65 and the push bar 62 are each attached to the left side frame member 60 and the right side frame member 61 in parallel, perpendicular to the left side frame member 60 and the right side frame member 61.

As shown in FIG. 22, in an embodiment a push bar 62 may include a planar outer contact surface 66 comprising a surface area effective to contact a desired number of bundles of roof shingles 10 including a desired number of rows of stacked bundles of roof shingles 10. In addition, the push bar 62 may be disposed between the left side frame member 60 and the right side frame member 61 whereby a bottom side 67 of the contact surface 66 may be located in space along a plane above, equal to, or below the corresponding forks 42 of a lifting device 40 during operation of the push member 45—see the bottom side 67 of the contact surface 66 of the push member 45 in the embodiment of FIG. 24, which is disposed between the left side frame member 60 and the right side frame member 61 lower than the bottom side 67 in the embodiment of FIG. 22.

In an embodiment, the push member 45 may be provided as a one-piece construction. As shown in FIG. 22, in an embodiment the push member 45 may be assembled via welds, threaded fasteners, and combinations thereof (see fasteners 69A, 69B connecting the first upper crossbar 63 to the left side frame member 60 and the right side frame member 61). Suitable fasteners include, but are not limited to threaded fasteners and/or the like.

Looking at FIG. 21, a push member 45 may be attached to the forks 42 of a lifting device 40 by slipping the forks 42 through the opening 68 until a proximal end 70 of the push member 45 contacts the vertical part 42A of the forks 42 whereby the first upper crossbar 63 and second upper crossbar 64 rest atop the forks 42 and the push bar 66 is spaced apart from distal ends of the forks 42 as shown. As shown, the location of the second upper crossbar 64 is effective to maintain the push member 45 in a horizontal or substantially horizontal alignment parallel or substantially parallel with surface 1000 (see FIG. 27). In addition, when the push member 45 is attached to the forks 42 the left side frame member 60 and the right side frame member 61 are suitably aligned parallel with the forks 42 (see FIG. 25) and the contact surface 66 of the push bar 62 is perpendicular or substantially perpendicular to the surface 1000 (see FIG. 26). As further shown in FIG. 25, during operation the push member 45 is suitably aligned with the assembly 100 whereby a center line 8 of the push member 45 is aligned with the center line 7 of the assembly 100.

In operation of an assembly 100 for separating stacked bundles of roof shingles 10 into two separate stacks of bundles of roof shingles 10, an operator 3 of a lifting device 40 directs the lifting device 40, or an operator of a second lifting device directs the second lifting device, to place a load carrying portable load bearing member 15 holding stacked bundles of roof shingles 10 on top of the off-loading platform 106 of the assembly 100 as described above and as shown in FIG. 28 (depicted as having a total of twelve rows of bundles of roof shingles 10). In a commercial setting, a plurality of load carrying portable load bearing members 15, each holding stacked bundles of roof shingles 10, may be stored in a designated on-site location and on or more lifting devices 40 may be used by operators to transport a desired number of load carrying portable load bearing member 15 each holding stacked bundles of roof shingles 10 from the on-site location onto one or more assemblies 100 that may be in use at the commercial location.

Once a load carrying portable load bearing member 15 and stacked bundles of roof shingles 10 are suitably positioned on the off-loading platform 106, the operator 3 then aligns the lifting device 40 with the assembly 100 as shown in FIG. 25. Once aligned, the lifting device 40 may be directed toward the stacked bundles of roof shingles 10 where, prior to contacting the stacked bundles of roof shingles 10, the operator 3 may adjust the forks 42 up or down (see Directional Arrow B in FIG. 27) as may be required to align the bottom side 67 of the contact surface 66 of the push bar 62 of the push member 45 with the bottom half of a target row 11 of bundles of roof shingles 10, e.g., see bottom half 11A of the sixth row of bundles of roof shingles 10 down from the top row in FIG. 26. Herein, such a target row of bundles of roof shingles 10 may be referred to as the "first load bottom row 11" of bundles of roof shingles 10, which defines the row where the stacked bundles of roof shingles 10 are to be separated or split into two separate stacks. As shown in FIG. 26, the contact surface 66 of the push bar 62 suitably includes a height effective to contact one or more rows of stacked bundles of roof shingles 10. In the illustration of FIG. 26, the contact surface 66 of the push bar 62 may contact at least the first load bottom row 11 and the immediate row 13 located on top of the first load bottom row 11.

Once the contact surface 66 of the push bar 62 is operably aligned with the first load bottom row 11, the operator 3 directs the lifting device 40 toward the assembly 100 and the stacked bundles of roof shingles 10 and upon contacting the stacked bundles of roof shingles 10 with the contact surface 66 of the push bar 62 the first load bottom row 11 and each of the rows of bundles of roof shingles 10 stacked on top of the first load bottom row 11 are directed onto the first load receiving portable load bearing member 50 by the push member 45 (see Directional Arrow C in FIGS. 26 and 29). Once a desired number of rows of stacked bundles of roof shingles 10 are directed onto the first load receiving portable load bearing member 50, the lifting device 10 may be directed apart from the assembly 100 as shown in FIG. 30.

Herein, a load of stacked bundles of roof shingles 10 directed onto a first load receiving portable load bearing member 50 may be referred to a "first load 10A" of stacked bundles of roof shingles 10. Once a first load 10A is formed as shown in FIG. 30, the lifting device 40, or a second lifting device, may remove the first load receiving portable load bearing member 50 with the first load 10A off from the loading platform 112 as shown in FIG. 31. For example, in this embodiment forks 42 of a lifting device 40 suitably engage fork pockets 50A and 50B of the first load receiving portable load bearing member 50 to lift the first load receiving portable load bearing member 50 with the first load 10A off from the loading platform 112 as understood in the art of portable load bearing members and fork lifting devices.

Once the first load receiving portable load bearing member 50 with the first load 10A is removed from the loading platform 112 as shown in FIG. 31, the loading platform 112 may then be directed to a second loading position as shown in FIG. 32 (see Directional Arrow D) exposing the second load receiving portable load bearing member 55 held by the base 110 as shown. Similar as described above, the operator 3 aligns the lifting device 40 with the assembly 100 and adjusts the forks 42 vertically to align the bottom side 67 of the contact surface 66 of the push bar 62 of the push member 45 with the bottom half of the bottom row 12 of stacked bundles of roof shingles 10 remaining on the off-loading platform 106 (see bottom half 12A of the bottom row 12 in FIG. 33). Herein, the bottom row of bundles of roof shingles 10 may be referred to as the "second load bottom row 12" of bundles of roof shingles 10. Similar as described above, the contact surface 66 of the push bar 62 suitably includes a height effective to contact the second load bottom row 12 and at least the immediate row 14 on top of the second load bottom row 12.

Once the contact surface 66 of the push bar 62 is operably aligned with the second load bottom row 12, the operator 3 directs the lifting device 40 toward the assembly 10 and the stacked bundles of roof shingles 10 and upon contacting the stacked bundles of roof shingles 10 on the off-loading platform 106 with the contact surface 66 of the push bar 62 the operator 3 the second load bottom row 12 and each of the rows of bundles of roof shingles 10 stacked on top of the second load bottom row 12 are directed onto the second load receiving portable load bearing member 55 as depicted in FIG. 34 (see Directional Arrow E in FIG. 34). Herein, a load of stacked bundles of roof shingles 10 directed onto a second load receiving portable load bearing member 55 may be referred to a "second load 10B" of stacked bundles of roof shingles 10.

Although a push member 45 may be configured to push a desired number of rows of stacked bundles of roof shingles 10 toward a loading assembly 104 regardless the orientation of a load carrying portable load bearing member 15 and corresponding stack of bundles of roof shingles 10 as placed onto an off-loading platform 106, in an embodiment an operator 3 may orient a load carrying portable load bearing member 15 with stacked bundles of roof shingles 10 onto a off-loading platform 106 in a manner effective for the push member 45 to direct one or more rows of bundles of roof shingles off from the load carrying portable load bearing member 15 onto a first load receiving portable load bearing member 50 and a second load receiving portable load bearing member 55. As shown in FIG. 35, in an embodiment where a load carrying portable load bearing member 15 carries stacked bundles of roof shingles 10 having three bundles of roof shingles per row, then the load carrying portable load bearing member 15 may be placed onto an off-loading platform 106 so that a longitudinal center line C1 of each of the bundles of roof shingles of a target row to be contacted by a push member 45 lie perpendicular to a biasing force to be applied to the target row by the push member 45 (see vector arrow V1). As shown in FIG. 36, in an embodiment where a load carrying portable load bearing member 15 carries stacked bundles of roof shingles 10 having four bundles of roof shingles per row, then the load carrying portable load bearing member 15 may be placed onto an off-loading platform 106 so that a longitudinal center line C1 of a distal bundle of roof shingles 16 of a target row to be contacted by a push member 45 lies perpendicular to a biasing force to be applied to the target row by the push member 45 (see vector arrow V2).

Similar as removing a first load receiving portable load bearing member 50 with the first load 10A from the loading platform 112, once a second load 10B is formed on a second load receiving portable load bearing member 55 as shown in FIG. 34, the lifting device 40, or a second lifting device, may then remove the second load receiving portable load bearing member 55 with the second load 10B from the base 110 as shown in FIG. 37. The empty load carrying portable load bearing member 15 as shown in FIG. 37 may be removed from the off-loading platform 106, e.g., either manually or via a lifting device 40, and the above described process may be repeated one or more times using different load carrying portable load bearing members 15 and stacked bundles of roof shingles 10 and different first and second load receiving portable load bearing members 50 and 55.

In an embodiment, an assembly 100 of this disclosure may also include a guide member 210 (or "guide stand 210") as shown in FIGS. 38-39 that is configured to align a push member 45 attached to forks 42 with an off-loading assembly 102 and a loading assembly 104 of assembly 100 as depicted in FIG. 40. As described below, a guide stand 210 of this disclosure is further configured to operably align the bottom side 67 of the contact surface 66 of the push bar 62 of the push member 45 with (1) a first load bottom row 11 and (2) a second load bottom row 12 of bundles of roof shingles 10 to separate a stacked bundles of roof shingles 10 into a first load 10A and a second load 10B.

Referring to FIG. 40, in an embodiment a guide stand 210 may include a right side guide rack 215 and an opposing left side guide rack 216 spaced apart from the right side guide rack 215 a distance effective to receive a load carrying portable load bearing member 15 linearly there through during operation of the assembly 100. As depicted in FIG. 40, the right side guide rack 215 is configured to guide a right side 45A of a push member 45 toward the off-loading assembly 102 and the left side guide rack 216 is configured to guide a left side 45B of a push member 45 toward the off-loading assembly 102 when a push member 45 is being directed toward the off-loading assembly 102 by the lifting device 40 (see Directional Arrow F).

Referring to FIGS. 41 and 42, in an embodiment a right side guide rack 215 of a guide stand 210 may include elongated linear vertical members 218 and 219 spaced apart in parallel as shown and configured as vertical supports for an elongated linear upper right guide rail 220 and an elongated linear lower right guide rail 221 disposed along inner surfaces of the vertical members 218 and 219 perpendicular to the vertical members 218 and 219. Likewise, a left side guide rack 216 of a guide stand 210 may include an arrangement that mirrors the right side guide rack 215 including elongated linear vertical members 225 and 226 spaced apart in parallel and configured as vertical supports for an elongated linear upper left guide rail 228 and an elongated linear lower left guide rail 229. In addition, the upper and lower right guide rails 220 and 221 are oriented parallel to the upper and lower left guide rails 228 and 229 as shown. In general, the opposing upper guide rails 220 and 228 are configured to align the push member 45 with the stacked bundles of roof shingles 10 at a height effective to form a first load 10A and the opposing lower guide rails 221 and 229 are configured to align the push member 45 with the stacked bundles of roof shingles 10 at a height effective to form a second load 10B.

With particular reference to FIG. 41, in an embodiment the guide stand 210 may further include an elongated first base member 233 configured as a support for vertical members 218 and 225 and an elongated second base member 234 disposed parallel to the first base member 233 and configured as a support for vertical members 219 and 226. As shown, in an embodiment the first base member 233 may include an elongated planar member of a minimal height when set against a surface 1000 to provide ease of travel of a lifting device 40 over the first base member 233.

In another embodiment, a guide stand 210 may include a base member configured as a support for vertical members 218 and 219 and/or a base member configured as a support for vertical members 225 and 226. In another embodiment, a guide stand 210 may include a separate base member for each of the vertical members 218, 219, 225 and 226, e.g., a rectangular or circular shaped base member. In another embodiment, a guide stand 210 may include a floor member that is configured as a single base member supporting both the right side guide rack 215 and the left side guide rack 216 thereon.

In an embodiment of a guide stand 210, the one or more of the vertical members 218, 219, 225 and 226 may also comprise one or more angle braces as shown. In this embodiment, each angle brace includes an elongated bottom member connected to its corresponding base member and an elongated angle member interconnecting the bottom member and its corresponding vertical member (see bottom members 240A, 241A, 242A, 243A and angle members 240B, 241B, 242B, 243B). In another embodiment, one or more corner brackets may be included as part of the guide stand 210 to secure one or more of the vertical members 218, 219, 225 and 226 to their corresponding base member 233 or 234.

With reference to FIG. 42, in an embodiment each of the upper and lower right guide rails 220 and 221 of the right side guide rack 215 and each of the upper and lower left guide rails 228 and 229 of the left side guide rack 216 may have a horizontal planar guide surface (see guide surfaces 220A, 221A, 228A, 229A) and a vertical planar guide surface (see side guide surfaces 220B, 221B, 228B, 229B) configured to align a push member 45 to desired vertical positions during operation of the assembly 100 (see FIGS. 43 and 44).

Referring again to FIG. 23, in an embodiment the left side frame member 60 and the right side frame member 61 of the push member 45 may include elongated planar horizontal surfaces comprising elongated planar wear strips 60A and 61A attached to the left side frame member 60 and the right side frame member 61 via threaded fasteners 71 (see FIG. 22) that are configured as face-down contact surfaces effective to slide along face-up guide surfaces 220A, 221A, 228A, 229A during operation of the assembly 100. In another embodiment, and depending on the materials of construction of the push member 45 and/or the guide stand 210, the left side frame member 60 and the right side frame member 61 of the push member 45 may be provided without wear strips 60A and 61A.

With reference to FIGS. 42, 43 and 45, the guide surface 220A of the upper right guide rail 220 and the guide surface 228A of the upper left guide rail 228 are set at a height along a horizontal plane effective to align a bottom side 67 of the contact surface 66 of the push bar 62 with a bottom half 11A of a first load bottom row 11 (see FIG. 26) when the push member 45 is mated with the upper guide rails 220 and 228, e.g., when the wear strips 60A and 61A of the push member 45 are set against guide surfaces 220A and 228A as shown. With reference to FIGS. 44 and 46, the guide surface 221A of the lower right guide rail 221 and the guide surface 229A of the lower left guide rail 229 are set at a height along a horizontal plane effective to align a bottom side 67 of the contact surface 66 of the push bar 62 of the push member 45 with a bottom half 12A of a second load bottom row 12 when the push member 45 is mated with the lower guide rails 221 and 229, i.e., when the wear strips 60A and 61A of the push member 45 are set against guide surfaces 221A and 229A as shown. Accordingly, the upper right guide rail 220 and the upper left guide rail 228 may be referred to collectively as "first load 10A guide rails" and the lower right guide rail 221 and the lower left guide rail 229 may be referred to collectively as "second load 10B guide rails." As understood by the skilled artisan, the height of the second load 10B guide rails may be established according to a predetermined combined height of the off-loading assembly 102 and a load carrying portable load bearing member 15 located on the off-loading assembly 102. As also understood by the skilled artisan, the height of the first load 10A guide rails may be established according to a predetermined height of a bottom side of a first load bottom row 11 located on top of a load carrying portable load bearing member 15 that is located on the off-loading assembly 102. Suitably, the guide surfaces 220A, 221A, 228A, 229A, 220B, 221B, 228B, 229B and the wear strips 60A and 61A of the push member 45 are planar smooth type surfaces effective for the wear strips 60A and 61A to easily slide along the upper and lower right guide rails 220 and 221 and the upper and lower left guide rails 228 and 229 during operation.

Referring again to FIGS. 41 and 42, in an embodiment a guide stand 210 may include a linear horizontal cross member 245 disposed between the vertical member 219 and the vertical member 226. In addition to providing structural strength to the guide stand 210, the cross member 245 is also configured as a ninth stop member to prevent a lifting device 40 from contacting the off-loading assembly 102 and the load carrying portable load bearing member 15 as the stacked bundles of roof shingles 10 are being directed from the off-loading assembly 102 onto a second load receiving portable load bearing member 55.

In an embodiment, a guide stand 210 may be releasably fastened to an off-loading assembly 102 during operation. As shown in FIGS. 41 and 42, in an embodiment a second base member 234 of the guide stand 210 may include an upright vertical surface comprising one or more apertures 247 and 248 configured to align with corresponding apertures disposed along the vertical supports 122 and 123 of the off-loading assembly 102 (see aperture or opening 134 of vertical support 123 in FIGS. 8 and 11) for receiving fasteners 239 there through to maintain desired alignment of the assembly 100 during operation. In an embodiment, the guide stand 210 may be releasably fastened to the off-loading assembly 102 via one or more fasteners the same or similar as the one or more fasteners 103A and 103B described above. In an embodiment, the second base member 234 may include an elongated angle bar member as understood by the skilled artisan, e.g., steel angle, angle aluminum, and/or the like.

In another embodiment, a guide stand 210 may include a right side guide rack 215 having vertically adjustable upper and lower right guide rails 220 and 221 and a left side guide rack 216 having vertically adjustable upper and lower left guide rails 228 and 229. In such embodiment, each of the guide rails may be adjusted vertically along the vertical members 218, 219, 225 and 226 to (1) set the guide surface 220A of the upper right guide rail 220 and the guide surface 228A of the upper left guide rail 228 at a height along a horizontal plane effective to align a bottom side 67 of the contact surface 66 of the push bar 62 with a bottom half 11A of a first load bottom row 11 for a particular operation and (2) set the guide surface 221A of the lower right guide rail 221 and the guide surface 229A of the lower left guide rail 229 at a height along a horizontal plane effective to align a bottom side 67 of the contact surface 66 of the push bar 62 of the push member 45 with a bottom half 12A of a second load bottom row 12 for a particular operation.

Although vertical adjustment of the upper and lower right guide rails 220 and 221 and upper and lower left guide rails 228 and 229 may be accomplished as desired, in an embodiment each of the vertical members 218, 219, 225 and 226 may include a plurality of female type mating surfaces disposed vertically along each of the vertical members 218, 219, 225 and 226, e.g., a plurality of female type mating surfaces disposed vertically along each of the inner surfaces of the vertical members 218, 219, 225 and 226, for establishing different points of attachment for the corresponding guide rails 220, 221, 228, 229. In another embodiment, each of the vertical members 218, 219, 225 and 226 may include a plurality of male type mating members disposed vertically along each of vertical members 218, 219, 225 and 226 for establishing different points of attachment for corresponding guide rails 220, 221, 228, 229 comprising female type mating surfaces.

With reference to FIGS. 47-55, in an embodiment each of the vertical members 218, 219, 225 and 226 may include (1) an upper guide rail attachment surface disposed along each vertical member 218, 219, 225 and 226 (see upper attachment surfaces 250, 252, 254, 256) for releasable attachment of the upper right and left guide rails 220 and 228 and (2) a lower guide rail attachment surface disposed along each vertical member 218, 219, 225 and 226 (see lower guide rail attachment surfaces 251, 253, 255, 257) for releasable attachment of the lower right and left guide rails 221 and 229. As shown in FIGS. 50 and 51, each of the upper and lower guide rail attachment surfaces 250-257 may be provided as a mounting plate type member secured to a corresponding vertical member 218, 219, 225 and 226 in a manner effective to space each of the corresponding guide rails 220, 221, 228, 229 apart from the vertical members 218, 219, 225 and 226 providing space or clearance for a push member 45 apart from the vertical member 218, 219, 225 and 226 during operation as described below. In an embodiment, the upper and lower guide rail attachment surfaces 250-257 may be permanently secured to the vertical members 218, 219, 225 and 226. In an embodiment, the upper and lower guide rail attachment surfaces 250-257 may be releasably attached to the vertical members 218, 219, 225 and 226.

In an embodiment, the upper and lower guide rail attachment surfaces 250-257 may be provided as like members each having a plurality of vertically aligned female type mating surfaces in the form of mounting slots (see mounting slots 256A-256E of upper guide rail attachment surface 256 in FIG. 49). In an embodiment, the upper and lower right guide rails 220 and 221 and the upper and lower left guide rails 228 and 229 may be provided as like members each having male type mating members configured to mate with corresponding mounting slots to hold each of the guide rails 220, 221, 228, 229 in a fixed operable position at desired altitudes along the vertical members 218, 219, 225 and 226 as shown in FIGS. 50 and 51.

Referring to the non-limiting embodiment of an upper left guide rail 228 as shown in FIGS. 52-55, each of the upper and lower guide rails of a particular guide stand 210 may include planar members 230 and 231 at or near each end of the guide rail 228 configured as attachment surfaces for one or more corresponding male type mating pins or locating pins 235A, 235B and 236A, 236B and also configured as abutment surfaces with the upper and lower guide rail attachment surfaces 250-257 as shown in FIGS. 50 and 51. Accordingly, each of the upper and lower guide rail attachment surfaces 250-257 may also be referred to herein as "locating pin plates 250-257."

Referring to FIG. 52, the locating pins 235A, 235B and 236A, 236B extend out from the planar members 230 and 231 a distance effective to be releasably mated with mounting slots 254A 254E of the upper guide rail attachment surface 254 and mounting slots 256A-256E of the upper guide rail attachment surface 256 as shown in FIGS. 50 and 51. As stated above, since the upper and lower right guide rails 220 and 221 and the upper and lower left guide rails 228 and 229 may be provided as like members each of the guide rails may be configured for use with any pair of upper and lower guide rail attachment surfaces 250-257, e.g., the upper right guide rail 220 may be releasably connected to the lower guide rail attachment surfaces 251 and 253 for use as a lower right guide rail.

For purposes of this disclosure, the configuration of the mounting slots and the corresponding locating pins of the guide rails 220, 221, 228, 229 may vary in size and shape as desired or as may otherwise be required for one or more particular operations. As depicted in FIG. 55, in an embodiment the one or more locating pins 235A, 235B and 236A, 236B may include large head locating pins for use with mounting slots 256A-256E configured as shown in FIG. 49. At the time of this disclosure, each of the guide rails 220, 221, 228, 229 may include, but are not limited to locating pins such as those commercially available from McMaster-Carr Supply Company; Elmhurst, Illinois, including, but not limited to locating pins under Product Number 8511A417.

With reference to FIG. 47, in an embodiment the right side guide rack 215 may include at least one linear right side horizontal support rail 260 interconnecting vertical members 218 and 219 and the left side guide rack 216 may include at least one linear left side horizontal support rail 261 interconnecting vertical members 225 and 226 in a manner effective to maintain each of the vertical members 218, 219, 225 and 226 in a vertical orientation as shown. As depicted in FIGS. 47 and 48, in an embodiment each of the right and left side horizontal support rails 260 and 261 may comprise an elongated angle bar member, e.g., steel angle, angle aluminum, and/or the like. In another embodiment, one or more of the right and left side horizontal support rails 260 and 261 may include square tubing as understood by the skilled artisan, e.g., steel square tubing, aluminum square tubing; and/or square bars, e.g., steel square bars, aluminum square bars; and/or rod members, e.g., steel rods, aluminum rods; and/or the like.

With further reference to FIG. 47, in an embodiment the elongated second base member 234 may include an elongated vertical member at each end (see angle members 234A and 234B) and an elongated planar member 234C disposed there between. In this embodiment, the one or more apertures 247 and 248 are disposed along the upright angle members 234A and 234B. Suitably, the elongated planar member 234C comprises a height when set against a surface 1000 similar as the first base member 233 effective for ease of travel of a lifting device 40 over the second base member 234. For use with a lifting device 40 as described herein, in an embodiment the height of planar first base member 233 and planar second base member 234 may range from or about 0.3175 cm (0.125 inches) to or about 0.9525 cm (0.375 inches). In an embodiment, the planar first base member 233 and the planar second base member 234 each may have a height of or about 0.635 cm (0.25 inches).

Referring to FIGS. 47 and 48, in an embodiment the vertical members 219 and 226 may also comprise one or more angle supports 265 and 266 interconnecting the vertical members 219 and 226 and the angle members 234A and 234B as shown. In an embodiment, the one or more angle supports 265 and 266 may include planar members attached to a corresponding vertical member 219 or 226 at a first end and attached to an upper portion of a corresponding angle member 234A or 234B at a second end. As shown, the one or more angle supports 265 and 266 may comprise one or more apertures 267 and 268 configured to align with corresponding apertures disposed along the vertical supports 122 and 123 of the off-loading assembly 102 for receiving fasteners 239 there through (see aperture 196 of vertical support 123 in FIG. 11 and FIG. 56).

Operation of an assembly 100 comprising a guide stand 210 is performed similar as described above in an embodiment of the assembly 100 comprised of only the off-loading assembly 102 and the loading assembly 104. For example, FIG. 57 illustrates the position of the push member 45 as the push member 45 is being mated with the first load 10A guide rails (see Directional Arrow G). FIG. 58 illustrates formation of a first load 10A of stacked bundles of roof shingles 10. As shown in FIG. 59, once the first load receiving portable load bearing member 50 with the first load 10A is removed from the loading platform 112 and the lifting device 40 is set apart from the guide stand 210, the forks 42 may be directed downward (see Directional Arrow H) a distance effective to direct the push member 45 to a mated position with the second load 10B guide rails (see Directional Arrow I in FIG. 60) for forming the second load 10B as shown in FIG. 61. Similar as described above, the lifting device 40, or a second lifting device, may then remove the second load receiving portable load bearing member 55 with the second load 10B from the base 110 as shown in FIG. 62. The empty load carrying portable load bearing member 15 may be removed from the off-loading platform 106, e.g., either manually or via a lifting device 40, or a second lifting device, and the above described process may be repeated one or more times using different load carrying portable load bearing members 15 and stacked bundles of roof shingles 10 and different first and second load receiving portable load bearing members 50 and 55.

Although an assembly 100 may be constructed from one or more materials suitable for use with one or more particular loads, for use with bundles of roof shingles 10 an off-loading assembly 102, loading assembly 104 and guide stand 210 are suitably constructed from one or more metals, one or more woods, one or more polymeric materials, one or more composite materials, and combinations thereof. As stated above, in an embodiment where the off-loading assembly 102, loading assembly 104 and guide stand 210 are constructed from one or more metals, the individual components making up the off-loading assembly 102, loading assembly 104 and guide stand 210 may be secured via welds, fasteners, adhesive, and combinations thereof. Suitable metals may include, but are not limited to steel, stainless steel, aluminum, and combinations thereof. In another embodiment, any one of the off-loading assembly 102, loading assembly 104 and guide stand 210 may be provided as a one-piece construction.

A system, apparatus, assembly 100 and method of the present disclosure may be described according to one or more of the following Embodiments.

Embodiment 1. An assembly apparatus, comprising:

a first member having a first support surface; and a second member having a second support surface;

wherein the first support surface is configured to hold a load carrying portable load bearing member;

wherein the second support surface is configured to hold a first load receiving portable load bearing member; and wherein the second member is configured to hold a second load receiving portable load bearing member below the second support surface.

Embodiment 2. The assembly apparatus of Embodiment 1, wherein the second support surface is moveable between a first position and a second position.

Embodiment 3. The assembly apparatus of Embodiment 1, wherein the first member includes one or more first stop members and one or more adjustable second stop members configured as abutment surfaces for the load carrying portable load bearing member.

Embodiment 4. The assembly apparatus of Embodiment 3, wherein the assembly apparatus comprises a first center line and wherein the one or more adjustable second stop members may be located at one or more set positions effective to align a center line of the load carrying portable load bearing member with the first center line.

Embodiment 5. The assembly apparatus of Embodiment 1, wherein the second member includes a base and a raised platform comprising the second support surface, wherein the raised platform is pivotally attached to the base.

Embodiment 6. The assembly apparatus of Embodiment 5, wherein the second member is configured to hold the second load receiving portable load bearing member within the base.

Embodiment 7. The assembly apparatus of Embodiment 1, wherein the second member includes one or more third stop members and one or more fourth stop members configured as abutment surfaces for the first load receiving portable load bearing member.

Embodiment 8. The assembly apparatus of Embodiment 5, wherein the raised platform is pivotally attached to the base via one or more biased hinge assemblies.

Embodiment 9. A system for moving stackable items, comprising:

a plurality of portable load bearing members; and an assembly apparatus, including:

a first member having a first support surface; and a second member having a second support surface;

wherein the first support surface is configured to hold a load carrying portable load bearing member of the plurality of portable load bearing members;

wherein the second support surface is configured to hold a first load receiving portable load bearing member of the plurality of portable load bearing members;

wherein the second member is configured to hold a second load receiving portable load bearing member of the plurality of portable load bearing members below the second support surface;

wherein the second support surface is moveable between a first position and a second position;

wherein a first part of a load of stackable items may be directed off from the first load carrying portable load bearing member onto the first load receiving portable load bearing member when the second support surface is in the first position; and wherein a second part of the load of stackable items may be directed off from the first load carrying portable load bearing member onto the second load receiving portable load bearing member when the second support surface is in the second position.

Embodiment 10. The system of Embodiment 9, wherein the first member includes one or more first stop members and one or more adjustable second stop members configured as abutment surfaces for the load carrying portable load bearing member.

Embodiment 11. The system of Embodiment 9, wherein the second member includes one or more third stop members and one or more fourth stop members configured as abutment surfaces for the first load receiving portable load bearing member.

Embodiment 12. The system of Embodiment 11, wherein the one or more fourth stop members are configured as one or more abutment surfaces for at least part of the first part of a load of stackable items directed off from the first load carrying portable load bearing member onto the first load receiving portable load bearing member.

Embodiment 13. The system of Embodiment 9, further including a lifting device comprising forks and a push member releasably attachable to the forks.

Embodiment 14. An assembly apparatus, comprising:

a first member having a first support surface at a first altitude; and a second member having a second support surface at a second altitude greater than the first altitude;

wherein the first support surface is configured to hold a load carrying portable load bearing member;

wherein the second support surface is configured to hold a first load receiving portable load bearing member; and wherein the second member is configured to hold a second load receiving portable load bearing member below the second support surface.

Embodiment 15. The assembly apparatus of Embodiment 14, wherein the second member includes a base and a raised platform comprising the second support surface, wherein the raised platform is pivotally attached to the base.

Embodiment 16. An assembly apparatus, comprising:

a first member having a first support surface; and a second member having a second support surface moveable between a first position and a second position;

wherein the first support surface is configured to hold a load carrying portable load bearing member;

wherein the second support surface is configured to hold a first load receiving portable load bearing member when the second support surface is in the first position; and wherein the second member is configured to hold a second load receiving portable load bearing member below the second support surface.

Embodiment 17. A system, comprising:

an assembly, including:

a first member having a first support surface;

a second member having a second support surface;

one or more load carrying portable load bearing members including a first load carrying portable load bearing member; and at least two load receiving portable load bearing members including a first load receiving portable load bearing member and a second load receiving portable load bearing member;

wherein the first support surface is configured to hold the first load carrying portable load bearing member;

wherein the second support surface is configured to hold the first load receiving portable load bearing member;

wherein the second member is configured to hold the second load receiving portable load bearing member; and wherein the second member is configured so that the first load receiving portable load bearing member may receive a first part of a load from the first load carrying portable load bearing member and the second load receiving portable load bearing member may receive a second part of the load from the first load carrying portable load bearing member.

Embodiment 18. As assembly, comprising:

a first member configured to hold a load carrying portable load bearing member at a first altitude; and a second member configured to hold a first load receiving portable load bearing member at a second altitude and a second load receiving portable load bearing member at a third altitude;

wherein the second member is configured so that the first load receiving portable load bearing member may receive a first part of a load from the load carrying portable load bearing member and the second load receiving portable load bearing member may receive a second part of the load from the load carrying portable load bearing member.

Embodiment 19. An apparatus, comprising:

a framework;

wherein the framework is configured to hold a load carrying portable load bearing member, a first load receiving portable load bearing member and a second load receiving portable load bearing member; and wherein the framework is configured so that the first load receiving portable load bearing member may receive a first part of a load from the load carrying portable load bearing member and the second load receiving portable load bearing member may receive a second part of the load from the load carrying portable load bearing member.

Embodiment 20. An apparatus, comprising:

an off-loading member configured to hold a load carrying portable load bearing member;

a loading member configured to hold a first load receiving portable load bearing member and a second load receiving portable load bearing member;

wherein the loading member is configured so that the first load receiving portable load bearing member may receive a first part of a load from the load carrying portable load bearing member and the second load receiving portable load bearing member may receive a second part of the load from the load carrying portable load bearing member.

Embodiment 21. The apparatus of Embodiment 20, wherein the loading member is configured so that the second load receiving portable load bearing member may receive the second part of the load when the first load receiving portable load bearing member is absent from the loading member.

Embodiment 22. The apparatus of Embodiment 20, wherein the off-loading member comprises an assembly including an off-loading platform configured to hold the load carrying portable load bearing member.

Embodiment 23. The apparatus of Embodiment 20, wherein the off-loading member comprises an assembly including an off-loading platform with one or more first stop members configured as one or more abutment surfaces for the load carrying portable load bearing member located on the off-loading platform and one or more second stop members configured to align the load carrying portable load bearing member with the off-loading platform.

Embodiment 24. The apparatus of Embodiment 20, wherein the loading member comprises an assembly including a base and a raised platform.

Embodiment 25. The apparatus of Embodiment 20, wherein the loading member comprises an assembly including a base and a raised platform pivotally attached to the base.

Embodiment 26. The apparatus of Embodiment 20, wherein the off-loading member is releasably assembled to the loading member.

Embodiment 27. The apparatus of Embodiment 24, wherein the off-loading member is releasably assembled to the loading member.

Embodiment 28. The apparatus of Embodiment 23, wherein the loading member comprises an assembly including a base and a raised platform pivotally attached to the base, wherein the raised platform includes a support surface for the first load receiving portable load bearing member and includes one or more stop members configured to align the first load receiving portable load bearing member with the raised platform and the off-loading platform.

Embodiment 29. The apparatus of Embodiment 20, wherein the first load receiving portable load bearing member may receive the first part of a load from the load carrying portable load bearing member (1) when the second load receiving portable load bearing member is held by the loading member and (2) when the second load receiving portable load bearing member is absent from the loading member.

Embodiment 30. An apparatus, comprising:

an off-loading member configured to hold a load carrying portable load bearing member;

a loading member configured to hold a first load receiving portable load bearing member and a second load receiving portable load bearing member when the loading member is set to a first position;

wherein when the loading member is set to the first position then the loading member is configured so that the first load receiving portable load bearing member may receive a first part of a load from the load carrying portable load bearing member; and wherein when the loading member is set to a second position then the loading member is configured so that the second load receiving portable load bearing member may receive a second part of the load from the load carrying portable load bearing member.

Embodiment 31. An apparatus, comprising:

an off-loading member configured to hold a load carrying portable load bearing member;

a loading member configured to hold a first load receiving portable load bearing member and a second load receiving portable load bearing member;

wherein the loading member is configured so that when a first part of a load is directed off from the load carrying portable load bearing member toward the loading member then the first load receiving portable load bearing member is configured to receive the first part of the load thereon; and wherein the loading member is configured so that when a second part of the load is directed off from the load carrying portable load bearing member toward the loading member then the second load receiving portable load bearing member is configured to receive the second part of the load thereon.

Embodiment 32. An assembly, comprising:

an off-loading assembly; and a loading assembly;

wherein the off-loading assembly is configured to hold a load carrying portable load bearing member;

wherein the loading assembly is configured to hold a first load receiving portable load bearing member and a second load receiving portable load bearing member; and wherein the loading assembly is configured so that the first load receiving portable load bearing member may receive a first part of a load from the load carrying portable load bearing member and the second load receiving portable load bearing member may receive a second part of the load from the load carrying portable load bearing member.

Embodiment 33. The assembly of Embodiment 32, further comprising a guide stand adjacent the off-loading assembly.

Embodiment 34. An assembly, comprising:

an off-loading assembly; and a loading assembly adjacent the off-loading assembly;

wherein the off-loading assembly is configured to hold a load carrying portable load bearing member;

wherein the loading assembly is configured to hold a first load receiving portable load bearing member and a second load receiving portable load bearing member; and wherein the loading assembly is configured so that the first load receiving portable load bearing member may receive a first part of a load from the load carrying portable load bearing member and so that the second load receiving portable load bearing member may receive a second part of the load from the load carrying portable load bearing member.

Embodiment 35. An assembly, comprising:

an off-loading assembly; and a loading assembly;

wherein the off-loading assembly is configured to hold a load carrying portable load bearing member;

wherein the loading assembly includes a platform having a support surface configured to hold a first load receiving portable load bearing member thereon and wherein the loading assembly is configured to hold a second load receiving portable load bearing member below the support surface; and wherein the loading assembly is configured so that the first load receiving portable bearing load member may receive a first part of a load from the load carrying portable load bearing member; and wherein the loading assembly is configured so that the second load receiving portable load bearing member may receive a second part of the load from the load carrying portable load bearing member when the first load receiving portable load bearing member is absent from the loading assembly.

Embodiment 36. An assembly, comprising:

an off-loading assembly; and a loading assembly adjacent the off-loading assembly;

wherein the off-loading assembly is configured to hold a load carrying portable load bearing member;

wherein the loading assembly is configured to hold a first load receiving portable load bearing member and a second load receiving portable load bearing member;

wherein the loading assembly is configured so that when a first part of a load is directed off from the load carrying portable load bearing member toward the loading assembly then the first load receiving portable load bearing member is configured to receive the first part of the load thereon; and wherein the loading assembly is configured so that when a second part of the load is directed off from the load carrying portable load bearing member toward the loading assembly then the second load receiving portable load bearing member is configured to receive the second part of the load thereon.

Embodiment 37. A system, comprising:

an apparatus, including:

an off-loading member configured to hold a load carrying portable load bearing member;

a loading member configured to hold two load receiving portable load bearing members;

a lifting device comprising forks; and a push member releasably attachable to the forks.

Embodiment 38. The system of Embodiment 37 including a plurality of load receiving portable load bearing members configured for repeated use.

Embodiment 39. The system of Embodiment 37 including a plurality of load receiving portable platform assemblies wherein at least a first part of each of the plurality of load receiving portable platform assemblies is configured for repeated use.

Embodiment 40. A system, comprising:

an apparatus, including:

an off-loading member;

a loading member;

at least two load receiving portable load bearing members including at least a first load receiving portable load bearing member and a second load receiving portable load bearing member;

a lifting device comprising forks; and a push member releasably attachable to the forks;

wherein when a load carrying portable load bearing member comprising a load is located on the off-loading member and wherein when the first load receiving portable load bearing member and the second load receiving portable load bearing member are held by the loading member, then the lifting device is configured to direct the push member against the load in a manner effective to direct a first part of the load onto the first load receiving portable load bearing member and direct a second part of the load onto the second load receiving portable load bearing member.

Embodiment 41. The system of Embodiment 40 further comprising a guide stand configured to align the push member with the load located on the load carrying portable load bearing member at a first point along the load and at a second point along the load.

Embodiment 42. A system, comprising:

an assembly, including:

an off-loading assembly; and a loading assembly releasably assembled to the off-loading assembly;

a guide stand releasably assembled to the off-loading assembly;

a plurality of load receiving portable load bearing members;

wherein the off-loading assembly is configured to hold a load carrying portable load bearing member;

wherein the loading assembly is configured to hold a first load receiving portable load bearing member and a second load receiving portable load bearing member of the plurality of load receiving portable load bearing members; and wherein the loading assembly is configured so that the first load receiving portable load bearing member may receive a first part of a load from the load carrying portable load bearing member and the second load receiving portable load bearing member may receive a second part of the load from the load carrying portable load bearing member.

Embodiment 43. A method, comprising:

directing items of a load off of a load carrying portable load bearing member onto two load receiving portable load bearing members by placing the load carrying portable load bearing member and the two load receiving portable load bearing members onto an assembly apparatus comprising:

a first off-loading member configured to hold the load carrying portable load bearing member;

a second loading member configured to hold the two load receiving portable load bearing members;

wherein the second loading member is configured so that a first of the two load receiving portable load bearing members may receive a first part of the items from the load carrying portable load bearing member and a second of the two load receiving portable load bearing members may receive a second part of the items from the load carrying portable load bearing member.

Embodiment 44. The method of Embodiment 43, wherein the items are directed off of the load carrying portable load bearing member onto the two load receiving portable load bearing members via a push member attached to forks of a lifting device.

Embodiment 45. The method of Embodiment 43, wherein the items are directed off of the load carrying portable load bearing member onto the two load receiving portable load bearing members by pushing the items toward the two load receiving portable load bearing members.

Embodiment 46. A method, comprising:

directing a load of stacked items off of a load carrying portable load bearing member onto a first load receiving portable load bearing member and onto a second load receiving portable load bearing member by placing the load carrying portable load bearing member, the first load receiving portable load bearing member, and the second load receiving portable load bearing member onto an assembly comprising:

an off-loading assembly; and a loading assembly;

wherein the off-loading assembly is configured to hold the load carrying portable load bearing member;

wherein the loading assembly is configured to hold the first load receiving portable load bearing member and the second load receiving portable load bearing member; and wherein the loading assembly is configured so that the first load receiving portable load bearing member may receive a first part of the stacked items from the load carrying portable load bearing member and the second load receiving portable load bearing member may receive a second part of the stacked items from the load carrying portable load bearing member.

Embodiment 47. The method of Embodiment 46, wherein the stacked items are pushed onto the first load receiving portable load bearing member and the second load receiving portable load bearing member.

Embodiment 48. The method of Embodiment 46, wherein the stacked items are pushed onto the first load receiving portable load bearing member and then pushed onto the second load receiving portable load bearing member once the first load receiving portable load bearing member is removed from the loading assembly.

Embodiment 49. A loading apparatus, comprising:

an off-loading member configured to hold a load carrying portable load bearing member;

a loading member including:

a base; and a raised platform moveably coupled to the base;

wherein the raised platform is configured to hold a first load receiving portable load bearing member for receiving a first load thereon when the loading member is set to a first loading position; and wherein the base is configured to hold a second load receiving portable load bearing member for receiving a second load thereon when the loading member is set to a second loading position.

Embodiment 50. An apparatus for moving a load of stacked items, comprising:

an off-loading member;

a loading member including:

a base; and a raised platform moveably coupled to the base;

wherein the off-loading member is configured to hold a first portable load bearing member holding the load of stacked items; and wherein the loading member is configured to hold a second portable load bearing member for receiving a first part of the stacked items and a third portable load bearing member for receiving a second part of the stacked items from the first portable load bearing member.

Embodiment 51. A loading apparatus, comprising:

an off-loading member;

a loading member, comprising:

a base; and a raised platform;

wherein the off-loading member is configured to hold a load carrying portable load bearing member at a first altitude;

wherein the loading assembly is configured to hold a first load receiving portable load bearing member at a second altitude greater than the first altitude; and wherein the loading member is configured to hold a third load receiving portable load bearing member at a third altitude less than the first altitude.

Embodiment 52. An assembly, comprising:

an off-loading assembly; and a loading assembly, comprising:

a base; and a raised platform moveably coupled to the base;

wherein the off-loading member is configured to hold a load carrying portable load bearing member;

wherein the loading assembly is configured to hold a first load receiving portable load bearing member and a second load receiving portable load bearing member;

wherein when the loading assembly is set to a first loading position then the raised platform is configured so that the first load receiving portable load bearing member may receive a first part of a load from the load carrying portable load bearing member; and wherein when the loading assembly is set to a second loading position then the raised platform is configured so that the second load receiving portable load bearing member may receive a second part of the load from the load carrying portable load bearing member.

Embodiment 53. A pallet off-loading and loading assembly, comprising:

an off-loading assembly for holding a first pallet holding a load to be off-loaded from the first pallet; and a loading assembly for holding a second pallet for receiving a first part of the load from the first pallet and a third pallet for receiving a second part of the load from the first pallet when the loading assembly is set to a first position;

wherein the loading assembly includes a raised platform for supporting the second pallet thereon when the loading assembly is set to a first loading position; and wherein the loading assembly is configured so that the third pallet may receive the second part of the load when the loading assembly is set to a second loading position.

Embodiment 54. A system, comprising:

at least a first load receiving portable load bearing member and a second load receiving portable load bearing member;

an assembly including:

an off-loading assembly configured to hold a load carrying portable load bearing member;

a loading assembly releasably assembled to the off-loading assembly, comprising: a base; and a raised platform moveably coupled to the base;

wherein the raised platform defines a first placement location for a first load receiving portable load bearing member when the loading assembly is set to a first loading position;

wherein the base defines a second placement location for a second load receiving portable load bearing member when the loading assembly is set to the first loading position and to a second loading position;

wherein when the loading assembly is set to the first loading position then the first load receiving portable load bearing member may receive a first part of a load from the load carrying portable load bearing member; and wherein when the loading assembly is set to the second loading position then the second load receiving portable load bearing member may receive a second part of the load from the load carrying portable load bearing member.

Embodiment 55. An assembly apparatus, comprising:

a first member having a first support surface; and a second member having a second support surface;

wherein the assembly apparatus has a first center line;

wherein the first support surface is configured to hold a load carrying portable load bearing member thereon in a manner effective to align a second center line of the load carrying with the first center line of the assembly apparatus;

wherein the second support surface is configured to hold a first load receiving portable load bearing member in a manner effective to align a third center line of the first load receiving portable load bearing member with the first center line of the assembly apparatus; and wherein the second member is configured to hold a second load receiving portable load bearing member below the second support surface in a manner effective to align a fourth center line of the second load receiving portable load bearing member with the first center line of the assembly apparatus.

Embodiment 56. A method, comprising:

moving items stacked in a plurality of rows off from a first load carrying portable load bearing member onto a first load receiving portable load bearing member and onto a second load receiving portable load bearing member via an assembly apparatus including:

a first member having a first support surface configured to hold the first load carrying portable load bearing member; and a second member having a moveable second support surface configured to hold a first load receiving portable load bearing member when the second support surface is set at a first position;

wherein the second member is configured to hold the second load receiving portable load bearing member below the second support surface;

by directing at least one row of the items off from the first load carrying portable load bearing member onto the first load receiving portable load bearing member when the second support surface is set at the first position; and, with the second support surface set at a second position directing at least one row of the items off from the first load carrying portable load bearing member onto the second load receiving portable load bearing member.

Embodiment 57. The method of Embodiment 56, wherein the items stacked in a plurality of rows are directed off from the first load carrying portable load bearing member onto the first load receiving portable load bearing member and the second load receiving portable load bearing member via a lifting device comprising forks and a push member releasably attachable to the forks.

Embodiment 58. The assembly apparatus of Embodiment 1, wherein the second member is releasably assembled to the first member.

Embodiment 59. An assembly apparatus, comprising:

a first member having a first support surface; and a second member having a base and a raised platform comprising a second support surface, the base having a guide track for the raised platform for directing the raised platform horizontally between a first position and a second position;

wherein the first support surface is configured to hold a load carrying portable load bearing member;

wherein the second support surface is configured to hold a first load receiving portable load bearing member; and wherein the second member is configured to hold a second load receiving portable load bearing member below the second support surface when the raised platform is set at a first position.

Although the present disclosure is described above in terms of various exemplary embodiments and implementations, it should be understood that the various features and functionality described in one or more of the individual embodiments are not limited in their applicability to the particular embodiment with which they are described, but instead might be applied, alone or in various combinations, to one or more other embodiments whether or not such embodiments are described and whether or not such features are presented as being a part of a described embodiment. Thus, the breadth and scope of the claimed invention should not be limited by any of the above-described embodiments.

Persons of ordinary skill in the art will recognize that many modifications may be made to the present disclosure without departing from the spirit and scope of the disclosure. The embodiment(s) of this disclosure are meant to be illustrative only and should not be taken as limiting the invention, which is defined in the claims.

I claim:

1. An assembly apparatus, comprising:

a first member having a first support surface; and a second member having a second support surface;

wherein the first support surface is configured to hold a load carrying portable load bearing member;

wherein the second support surface is configured to hold a first load receiving portable load bearing member; and wherein the second member is configured to hold a second load receiving portable load bearing member below the second support surface.

2. The assembly apparatus of claim 1, wherein the second support surface is moveable between a first position and a second position.

3. The assembly apparatus of claim 1, wherein the first member includes one or more first stop members and one or more adjustable second stop members configured as abutment surfaces for the load carrying portable load bearing member.

4. The assembly apparatus of claim 3, wherein the assembly apparatus comprises a first center line and wherein the one or more adjustable second stop members may be located at one or more set positions effective to align a center line of the load carrying portable load bearing member with the first center line.

5. The assembly apparatus of claim 1, wherein the second member includes a base and a raised platform comprising the second support surface, wherein the raised platform is pivotally attached to the base.

6. The assembly apparatus of claim 5, wherein the second member is configured to hold the second load receiving portable load bearing member within the base.

7. The assembly apparatus of claim 1, wherein the second member includes one or more third stop members and one or more fourth stop members configured as abutment surfaces for the first load receiving portable load bearing member.

8. The assembly apparatus of claim 5, wherein the raised platform is pivotally attached to the base via one or more biased hinge assemblies.

9. A system for moving stackable items, comprising:

a plurality of portable load bearing members; and an assembly apparatus, including:

a first member having a first support surface; and a second member having a second support surface;

wherein the first support surface is configured to hold a load carrying portable load bearing member of the plurality of portable load bearing members;

wherein the second support surface is configured to hold a first load receiving portable load bearing member of the plurality of portable load bearing members;

wherein the second member is configured to hold a second load receiving portable load bearing member of the plurality of portable load bearing members below the second support surface;

wherein the second support surface is moveable between a first position and a second position;

wherein a first part of a load of stackable items may be directed off from the first load carrying portable load bearing member onto the first load receiving portable load bearing member when the second support surface is in the first position; and wherein a second part of the load of stackable items may be directed off from the first load carrying portable load bearing member onto the second load receiving portable load bearing member when the second support surface is in the second position.

10. The system of claim 9, wherein the first member includes one or more first stop members and one or more adjustable second stop members configured as abutment surfaces for the load carrying portable load bearing member.

11. The system of claim 9, wherein the second member includes one or more third stop members and one or more fourth stop members configured as abutment surfaces for the first load receiving portable load bearing member.

12. The system of claim 11, wherein the one or more fourth stop members are configured as one or more abutment surfaces for at least part of the first part of a load of stackable items directed off from the first load carrying portable load bearing member onto the first load receiving portable load bearing member.

13. The system of claim 9, further including a lifting device comprising forks and a push member releasably attachable to the forks.

14. An assembly apparatus, comprising:

a first member having a first support surface at a first altitude; and a second member having a second support surface at a second altitude greater than the first altitude;

wherein the first support surface is configured to hold a load carrying portable load bearing member;

wherein the second support surface is configured to hold a first load receiving portable load bearing member; and wherein the second member is configured to hold a second load receiving portable load bearing member below the second support surface.

15. The assembly apparatus of claim 14, wherein the second member includes a base and a raised platform comprising the second support surface, wherein the raised platform is pivotally attached to the base.

* * * * *